US011549247B2

(12) United States Patent
Just et al.

(10) Patent No.: US 11,549,247 B2
(45) Date of Patent: Jan. 10, 2023

(54) SINK

(71) Applicant: Zurn Industries, LLC, Milwaukee, WI (US)

(72) Inventors: Paul Joseph Just, Glenview, IL (US); Michael Earl Hiser, Jr., Yorkville, IL (US); Matthew D. Gjertson, Chicago, IL (US); John Joseph Wojcik, Des Plaines, IL (US); Glen William Trickle, Elm Grove, WI (US)

(73) Assignee: Zurn Industries, LLC, Milwaukee, WI (US)

( * ) Notice: Subject to any disclaimer, the term of this patent is extended or adjusted under 35 U.S.C. 154(b) by 0 days.

(21) Appl. No.: 17/091,966

(22) Filed: Nov. 6, 2020

(65) Prior Publication Data

US 2022/0090367 A1 Mar. 24, 2022

Related U.S. Application Data

(63) Continuation of application No. 17/073,127, filed on Oct. 16, 2020.

(Continued)

(51) Int. Cl.
*E03C 1/264* (2006.01)
*E03C 1/126* (2006.01)
(Continued)

(52) U.S. Cl.
CPC ..... *E03C 1/264* (2013.01); *E03C 1/126* (2013.01); *E03C 1/14* (2013.01); *E03C 1/22* (2013.01); *E03C 2201/50* (2013.01)

(58) Field of Classification Search
CPC ..... E03C 1/14; E03C 1/22; E03C 1/26; E03C 1/264; E03C 1/182; B21D 39/04; F16L 13/10; F16L 13/14; F16L 13/16
See application file for complete search history.

(56) References Cited

U.S. PATENT DOCUMENTS 597,482 A 1/1898 Russell
1,070,424 A * 8/1913 Danver ..... E03C 1/22 4/288

(Continued)

FOREIGN PATENT DOCUMENTS

CA 304602 A 10/1930
CA 2784382 A1 1/2014

(Continued)

OTHER PUBLICATIONS

Affluence Seamless Sink, "Affluence Seamless Sink a choice at new development," Jul. 2009, 1 page.

(Continued)

*Primary Examiner* — Janie M Loeppke

(74) *Attorney, Agent, or Firm* — Michael Best & Friedrich LLP

(57) ABSTRACT

A sink including a body defining a vessel volume having an interior surface, wherein the body includes a bowl, where the bowl includes a base wall and at least one side wall extending from the base wall, where the bowl at least partially defines the interior surface, and a cup, where the cup includes a strainer plate defining one or more apertures therein and at least one side wall, where the cup at least partially defines the interior surface, where the body is formed from a single continuous piece of sheet material, and where the minimum thickness of the material forming the cup is no less than 50% of the maximum thickness of the material forming the bowl.

24 Claims, 68 Drawing Sheets

Related U.S. Application Data

(60) Provisional application No. 63/085,953, filed on Sep. 30, 2020, provisional application No. 63/083,629, filed on Sep. 25, 2020, provisional application No. 63/080,602, filed on Sep. 18, 2020.

(51) Int. Cl.
*E03C 1/22* (2006.01)
*E03C 1/14* (2006.01)

(56) References Cited

U.S. PATENT DOCUMENTS

| | | | | |
|---|---|---|---|---|
| 1,092,579 | A | 4/1914 | Kohler | |
| 1,751,877 | A | 3/1930 | Nance | |
| 1,760,659 | A | 5/1930 | Pasman | |
| 1,975,865 | A | 10/1934 | Rabinovich | |
| 2,021,410 | A | 11/1935 | Foose | |
| 2,038,852 | A | 4/1936 | Pasman | |
| 2,163,453 | A | 6/1939 | Schultis | |
| 2,273,606 | A | 2/1942 | Webber | |
| 2,278,566 | A | 4/1942 | Schaible | |
| 2,296,527 | A | 9/1942 | Kuhnle | |
| 2,413,308 | A | 12/1946 | Arnold | |
| 2,456,065 | A | 12/1948 | Just | |
| 2,583,300 | A | 1/1952 | Marcussen | |
| 2,617,997 | A | 11/1952 | Hiertz | |
| 2,905,951 | A | 9/1959 | Weddendorf, Jr. | |
| 2,965,317 | A | 12/1960 | Jacobs | |
| 3,096,527 | A | 7/1963 | Eynon | |
| 3,119,123 | A | 1/1964 | Fracalanza | |
| 3,525,105 | A | 8/1970 | Richards | |
| 3,588,928 | A | 6/1971 | Hiertz | |
| 3,796,382 | A | 3/1974 | Jordan | |
| 3,802,001 | A | 4/1974 | Richards | |
| 3,911,508 | A | 10/1975 | Goldberg | |
| 4,150,472 | A | 4/1979 | Derain | |
| 4,232,407 | A | 11/1980 | Williams | |
| 4,405,159 | A | 9/1983 | Spelber | |
| 4,541,655 | A * | 9/1985 | Hunter | F16L 13/161 285/55 |
| 4,571,751 | A | 2/1986 | Barlow | |
| 4,692,948 | A | 9/1987 | Martin | |
| 5,165,118 | A | 11/1992 | Cendrowski | |
| 5,318,230 | A | 6/1994 | Ferguson et al. | |
| 5,369,815 | A | 12/1994 | Martin | |
| 5,418,983 | A | 5/1995 | Garguillo et al. | |
| 5,535,455 | A | 7/1996 | Liu | |
| 5,560,052 | A | 10/1996 | Ferguson et al. | |
| 5,692,248 | A | 12/1997 | Ball | |
| 5,745,931 | A | 5/1998 | Ball | |
| 5,940,898 | A | 8/1999 | Rowe | |
| 6,016,579 | A | 1/2000 | Erbs | |
| 6,219,861 | B1 | 4/2001 | Chen | |
| 7,458,141 | B2 | 12/2008 | Goldburt et al. | |
| 7,500,626 | B2 | 3/2009 | Berger et al. | |
| 7,503,083 | B2 | 3/2009 | Ball | |
| 8,214,934 | B2 * | 7/2012 | Sullivan | E03C 1/22 4/287 |
| 8,220,731 | B2 | 7/2012 | Berger et al. | |
| 8,424,123 | B2 | 4/2013 | Svensson | |
| 8,490,277 | B1 | 7/2013 | Dahood | |
| 8,782,824 | B2 | 7/2014 | Shoop et al. | |
| 9,057,185 | B2 * | 6/2015 | Childs | E03C 1/262 |
| D743,013 | S | 11/2015 | Eilmus et al. | |
| 9,752,314 | B2 | 9/2017 | Wiebke | |
| 9,783,968 | B2 | 10/2017 | Childs et al. | |
| 9,850,643 | B2 | 12/2017 | Eilmus et al. | |
| 9,863,129 | B2 * | 1/2018 | Lin | E03C 1/264 |
| 10,030,373 | B1 | 7/2018 | Batista | |
| 10,208,467 | B2 * | 2/2019 | Lin | E03C 1/262 |
| 10,465,370 | B2 | 11/2019 | Donnelly | |
| 10,519,632 | B2 | 12/2019 | Campomanes et al. | |
| 10,519,637 | B2 | 12/2019 | Childs et al. | |
| 10,626,586 | B2 | 4/2020 | Childs et al. | |
| 10,877,493 | B2 | 12/2020 | Limberg et al. | |
| 2003/0182721 | A1 | 10/2003 | Li | |
| 2004/0133976 | A1 | 7/2004 | Higgins | |
| 2004/0144703 | A1 | 7/2004 | Davenport | |
| 2006/0195976 | A1 | 9/2006 | McAlpine | |
| 2007/0113329 | A1 | 5/2007 | Luk | |
| 2007/0180602 | A1 | 8/2007 | Lin | |
| 2008/0086812 | A1 | 4/2008 | Yu | |
| 2011/0289667 | A1 * | 12/2011 | Oropallo | B23P 17/04 4/287 |
| 2014/0075662 | A1 * | 3/2014 | Gayoso | E03C 1/2306 4/292 |
| 2017/0030059 | A1 | 2/2017 | Lin | |
| 2018/0112381 | A1 | 4/2018 | Lin et al. | |
| 2019/0161946 | A1 | 5/2019 | Childs et al. | |
| 2019/0277012 | A1 | 9/2019 | Hamann | |
| 2020/0248441 | A1 | 8/2020 | Childs et al. | |

FOREIGN PATENT DOCUMENTS

| | | | |
|---|---|---|---|
| DE | 1933347 | A1 | 2/1971 |
| DE | 6926043 | U | 6/1971 |
| EP | 0874091 | A2 | 10/1998 |
| EP | 2711475 | A1 | 3/2014 |
| EP | 2789753 | A1 | 10/2014 |
| EP | 2839921 | A1 | 2/2015 |
| EP | 3301233 | A1 | 4/2018 |
| GB | 441358 | A | 1/1936 |
| GB | 1191211 | A | 5/1970 |
| GB | 1300065 | A | 12/1972 |
| JP | 3208472 | U | 1/2017 |

OTHER PUBLICATIONS

Affluence Seamless Sink, "Affluence Seamless Sink debuts," Apr. 2009, 1 page.

Affluence Seamless Sink, "Affluence Seamless Sink lands industry honor," May 2009, 1 page.

Affluence Seamless Sink, "Affluence Seamless Sink to Debut at Kitchen/Bath Industry Show in Atlanta," Mar. 2009, 2 pages.

Elkay, "LRAD191850-CU, Elkay CuVerro Antimicrobial Copper 19" x 18" x 5", Single Bowl Drop-in ADA Sink," <https://www.elkay.com/products/lrad191850-cu.html> webpage publicly available as early as Jul. 16, 2020.

American Welding Society, "ACR Welding (AW)" <https://awo.aws.org/glossary/arc-welding-aw/> webpage publicly available as early as Jul. 7, 2020.

American Welding Society, "Brazing," <https://awo.aws.org/glossary/brazing/> webpage publicly available as early as Jul. 7, 2020.

American Welding Society, "Resistance Welding (RW)" <https://awo.aws.org/glossary/resistance-welding-rw/> webpage publicly available as early as Jul. 7, 2020.

American Welding Society, "Standard Welding Terms and Definitions," AWS A3.0M/A3.0:2020, An American National Standard, 13th Edition, Oct. 22, 2019, 10 pages.

Bathroom Vessel Sinks, "How to install a vessel sink & faucet," <https://www.bathroomvesselsinks.com/articles-how-to-install-a-vessel-sink.asp> webpage accessed Mar. 2, 2020.

Builder, "Seamless Sink Affluence Line," <https://www.builderonline.com/products/seamless-sink-affluence-line_o> Nov. 2, 2010.

Central Restaurant Products, "Cone Cover, 15", Stainless Steel, With Feed Hole—For Food Disposers," <https://www.centralrestaurant.com/Cone-Cover-15-in-Stainless-Steel-With-Feed-Hole---For-Food-Disposers-c252p30095.html> webpage accessed on Dec. 16, 2019.

Commercial Food Waste Disposers, Service Manual, publicly available prior to Sep. 17, 2020, 28 pages.

Customer Builder Online, "PermaClean Drain System," <customerbuilderonline.com/permaclean-drain-system> Published Jul. 23, 2011.

Cuverro, Bactericidal Copper Surfaces, <https://cuverro.com/resources> webpage publicly available as early as Jun. 2, 2019.

Diamond Spas, "The hottest trends in kitchen and bath," <blog.diamondspas.com/blog/press-media/the-hottest-trends-in-kitchen-and-bath> publicly available as early as Sep. 17, 2020.

(56) References Cited

OTHER PUBLICATIONS

Elkay seamless sink, Weld-in drain/disposal cone, publicly available as early as Sep. 17, 2020.
Elkay, "Perfect Drain Installation Instructions," Part No. 74180340_B, 2011, 1 page.
Emerson, "Insinkerator, Disposer Mounting," publicly available prior to Sep. 17, 2020, 1 pages.
Emerson, "Insinkerator, Large Capacity Disposers," 2016, 2 pages.
Emerson, "Insinkerator, Type B Bowl (12:, 15", 18")" <https://insinkerator.emerson.com/en-us/shop/insinkerator/insinkerator-typebbowl> webpage accessed on Dec. 16, 2019.
Emerson, "Insinkerator, WasteXpress Food Waste Reduction Systems," <https://insinkerator.emerson.com/en-us/shop/insinkerator/products/foodservice-equipment/insinkerator-wx500> webpage accessed on Dec. 16, 2019.
Emerson, "Wastexpress, Food Waste Reduction Systems, insinkerator," 2016, 4 pages.
Examples of Just sinks that have weld-in drain cones seamlessly welded in, publicly available as early as Sep. 17, 2020.
Hobart, "Catalog of Replacement Parts, FD Food Waste Disposers," Mar. 2002, 8 pages.
Hobart, "FD3-150 FD3-200 FD3-300 Foodwaste Disposers," 2006, 4 pages.
Hobart, "FD3-50 FD3-75 FD3-125 Foodwaste Disposers," 2003, 4 pages.
Hobart, "FD4/150 FD4/200 FD4/300 Foodwaste Disposers," 2014, 4 pages.
Hobart, "FD500 Foodwaste Disposers," Aug. 2003, 4 pages.
Houzz, "Affluence Seamless Sinks, Discussions," <https://www.houzz.com/discussions/2404917/affluence-seamless-sinks> webpage accessed on Dec. 13, 2019.
HybridH2O, "Smarty Bee," <https://sustainablerestroomproducts.com/wp-content/uploads/2014/05/Smarty-Bee-Brochure-May14.pdf> May 2014.
HybridH2O, "Sustainable Restroom Products," <https://sustainablerestroomproducts.com/> webpage available as early as Jun. 20, 2012.
Just Integra Disposer Cone Drawing, publicly available as early as Sep. 17, 2020, 1 page.
Just Integra Disposer Drawing, publicly available as early as Sep. 17, 2020, 1 page.
Just Integra Drain Drawing, publicly available as early as Sep. 17, 2020, 1 page.
Just Integra Sink, Weld-in drain cone, publicly available as early as Sep. 17, 2020.
Just Manufacturing Company, "A-28065, Cup Sink—Round—16 Gauge Type 316 Stainless Steel," <http://justmfg.com/ProductsDetails?ProductID=1307> webpage visited on Dec. 10, 2019.
Just Manufacturing Company, "A-28065/A-28066 Round Cup Sinks Non-Self Rim," webpage visited on Dec. 10, 2019.
Just Manufacturing Company, "Custom Built Stainless Steel & Galvanized Dish Tables," Custom Pricing Guide, Jul. 1, 1985, p. 10.
Just Manufacturing Company, "Designers and Fabricators of Radiiluxe Stainless Steel Sinks, Cabinet Tops and other Sanitary Equipment for Homes, Schools, Hospitals, Hotels, Office Buildings, Institutions, Also for Industrial and Marine Installations," 1946, 37 pages.
Just Manufacturing Company, "Drawing No. 101-154, A41962," Jan. 3, 1995, 1 page.
Just Manufacturing Company, "Drawing No. A-36213, Self-Rim Disposable Sink Double Compartment," Jan. 14, 1965, 1 page.
Just Manufacturing Company, "Drawing No. A-36215, Self-Rim Disposer Sink Single Compartment," Jan. 14, 1965, 1 page.
Just Manufacturing Company, "Drawing No. A-40259, Self-Rim Disposer Corner Sink," Feb. 12, 1969, 1 page.
Just Manufacturing Company, "Drawing No. A-55359, Just Cone Disposer Cone," Apr. 15, 2003, 1 page.
Just Manufacturing Company, "Drawing No. A-58627," Oct. 2009, 1 page.
Just Manufacturing Company, "Drawing No. A-58630," Oct. 2009, 1 page.
Just Manufacturing Company, "Drawing No. A-62811, Disposer Cup Drain Modified," Apr. 29, 2015, 1 page.
Just Manufacturing Company, "Drawing No. A-SLN-2125-A, Grip-Rim Bowl," Apr. 20, 2015.
Just Manufacturing Company, "Drawing No. A-WDD-2233-A-L, Self-Rim Disposer Sink Double Compartment," Oct. 19, 1994, 1 page.
Just Manufacturing Company, "Drawing No. A-WDD-2238-A-L, Self-Rim Disposer Sink Double Compartment," Oct. 19, 1994, 1 page.
Just Manufacturing Company, "Drawing No. Unknown, Just Disposer Cone," Oct. 10, 2003, 1 page.
Just Manufacturing Company, "Drawing No. WDS-2225-A, 114-015 WDS2225A1" Oct. 19, 1994, 1 page.
Just Manufacturing Company, Excerpt from Catalog, Aug. 1987, p. 9.
Just Manufacturing Company, Excerpt from Catalog, Aug. 1988, p. 13.
Just Manufacturing Company, Metal Sink Photos, publicly available as early as Sep. 17, 2020, 8 pages.
Just Manufacturing, "Fixtures, Sinks & Hand Wash Stations Produced with CuVerro® Antimicrobial Copper Surfaces to MAXIMIZE Healthcare Environments!," <https://www.justmfg.com/antimicrobial-copper-sinks.html> webpage publicly available as early as Jan. 15, 2012.
Kitchen Design Notes, "Reports from KBIS: What's new in sinks," <https://kitchendesignnotes.wordpress.com/category/seamless-sinks/> May 6, 2009.
Kitchen Studio of Naples, Inc., "Affluence Seamless Sink," <https://annporter.wordpress.com/2009/05/18/affluence-seamless-sink/> May 18, 2009.
LENOVA PermaClean Drain System, "Affluence Seamless Sink to Debut at Kitchen/Bath Industry Show in Atlanta," <www.lenovapermaclean.com/press_200903.php> Published Mar. 2009.
LENOVA PermaClean Drain System, "PermaClean Drain System," <www.lenovapermaclean.com/afflence.php> publicly available as early as Sep. 17, 2020.
Moen, "Sani-Sink, Suggested Specifications for Commercial Sinks," 1990, 1 page.
Moen, "Specifications, CAMELOT, Single Bowl Drop-In Sink with Faucet, Model 22240," 2010, 1 page.
Moen, "Specifications, Sani-Sink, Single Bowl Kitchen Sink, Model 22120," 1997, 1 page.
Moen, "Stainless Steel Sinks, Various Models," Excerpt from Catalog, 1986.
Pictures of Sink Drain, publicly available prior to Sep. 17, 2020, 4 pages.
Pictures of Sink Strainer, publicly available prior to Sep. 17, 2020, 3 pages.
P-SUN Int'l Co., Ltd, "Drawing No. A01495BZ00," JB Integra, Oct. 6, 2014, 1 page.
SALVAJOR CA, "Cone Assembly for Disposer Models: 100—200—300—500," 2018, 2 pages.
Seamless Sinks, "Kitchen Design Notes," <https://kitchendesignnotes.wordpress.com/category/seamless-sinks/> webpage accessed on Mar. 2, 2020.
StainlessDrains.com, <http://stainlessdrains.com/foodservice.html> webpage accessed Mar. 2, 2020.
Standard drain with cup strainer and Integra-drain with cup strainer, publicly available as early as Sep. 17, 2020.
UltraClean Sinks by Create Goods, publicly available as early as Sep. 17, 2020, 1 page.
Waste King, Installation Instructions, Commercial Disposer Models 2000, 3000, 5000 and 1000, publicly available prior to Sep. 17, 2020, 8 pages.
Youtube, "Affluence Seamless Sink," <https://www.youtube.com/watch?v=hfYvWrUQ7n8> Publicly available on Oct. 15, 2008.
Youtube, "Lenova PermaClean Sink Installation Video," <https://www.youtube.com/watch?v=88GzmHV-xLo> Published Jul. 31, 2019.

* cited by examiner

SINK

RELATED APPLICATIONS

The present application is a continuation-in-part of U.S. patent application Ser. No. 17/073,127, filed Oct. 16, 2020, which claims priority to U.S. Provisional Patent Application No. 63/080,602, filed Sep. 18, 2020; U.S. Provisional Patent Application No. 63/083,629, filed Sep. 25, 2020; and U.S. Provisional Patent Application No. 63/085,953, filed Sep. 30, 2020. The present application also claims priority to U.S. Provisional Patent Application No. 63/080,602, filed Sep. 18, 2020; U.S. Provisional Patent Application No. 63/083,629, filed Sep. 25, 2020; and U.S. Provisional Patent Application No. 63/085,953, filed Sep. 30, 2020. The entire contents of each application are hereby incorporated by reference.

FIELD

The disclosure relates to sinks and strainers and more specifically sinks and strainers with anti-microbial, bacteriostatic, bactericidal and/or anti-viral capabilities.

BACKGROUND

Sinks are regularly installed in hospitals and other facilities that require high standards of hygiene and cleanliness.

SUMMARY

In one embodiment, a sink including a bowl, where the bowl includes a base wall and at least one side wall extending from the base wall, a cup, where the cup includes a bottom wall and at least one side wall extending between the bottom wall and the base wall, where the cup and bowl at least partially define a vessel volume having an interior surface, and an adapter extending from the bottom wall of the cup opposite the bowl. Also, where the base wall, the at least one side wall of the bowl, and the at least one side wall of the cup are all formed from a first piece of sheet material, where the bottom wall of the cup and the adapter are formed from a second piece of sheet material, and where the first piece of sheet material is fused to the second piece of sheet material such that a portion of the interior surface formed by the at least one side wall of the cup is continuous with a portion of the interior surface formed by the bottom wall of the cup.

In another embodiment, a sink including a first piece of sheet material including a base wall having a periphery, a first side wall extending from the base wall at the periphery thereof to at least partially form a bowl, and a second side wall extending from the base wall opposite the first side wall to at least partially form a cup, and wherein the second side wall includes an inner surface, an outer surface, and an end surface at a distal end thereof, and a second piece of sheet material including a strainer plate and an adapter body extending from the strainer plate, and where the end surface of the second side wall fused to the second piece of sheet material.

In another embodiment, a sink including a vessel volume having an interior surface, where the vessel volume includes a base wall, a first side wall extending from the base wall to at least partially form a bowl, a second side wall extending from the base wall opposite the first side wall to at least partially form a cup, and a strainer plate extending from the second side wall opposite the base wall, a first piece of sheet material at least partially defining the interior surface of the vessel volume, and a second piece of sheet material fused to the first piece of sheet material, where the second piece of sheet material at least partially defines the interior surface of the vessel volume.

In another embodiment, a method of making a sink having a vessel volume with an interior surface, the method including forming a first piece of sheet material to produce a bowl base wall, a bowl side wall extending from the bowl base wall, and a cup side wall extending from the bowl base wall opposite the bowl side wall, where the cup side wall includes an inner surface at least partially defining the interior surface of the vessel volume, an outer surface, and an end surface. The method also including forming a second piece of sheet material to produce a strainer plate and an adapter extending from the strainer plate, where the interface between the strainer plate and the adapter produces an edge, and where the strainer plate includes an upstream surface at least partially defining the interior surface of the vessel volume, positioning the first piece of sheet material and the second piece of sheet material so the end surface of the cup side wall is opposite the edge of the second piece of sheet material, and fusing the first piece of sheet material to the second piece of sheet material so the inner surface of the cup side wall becomes continuous with upstream surface of the strainer plate.

In another embodiment, a sink including a body defining a vessel volume having an interior surface, wherein the body includes a bowl, where the bowl includes a base wall and at least one side wall extending from the base wall, where the bowl at least partially defines the interior surface, and a cup, where the cup includes a strainer plate defining one or more apertures therein and at least one side wall, where the cup at least partially defines the interior surface, where the body is formed from a single continuous piece of sheet material, and where the minimum thickness of the material forming the cup is no less than 50% of the maximum thickness of the material forming the bowl.

In another embodiment, a sink including a body defining a vessel volume having an interior surface, wherein the body includes a bowl, where the bowl includes a base wall and at least one side wall extending from the base wall, where the bowl at least partially defines the interior surface, and a cup, where the cup includes a strainer plate defining one or more apertures therein and at least one side wall, where the cup at least partially defines the interior surface, where the body is formed from a single continuous piece of sheet material, and where the minimum thickness of the material forming the cup is no less than 50% of the maximum thickness of the material forming the bowl.

In other embodiments, a sink including, a body defining a vessel volume having an interior surface, the body including a bowl, where the bowl includes a base wall and at least one side wall extending from the base wall, where the bowl at least partially defines the interior surface, and a cup, where the cup includes a strainer plate defining one or more apertures therein and at least one side wall, where the cup at least partially defines the interior surface, and an adapter, where the adapter defines a channel therethrough, and where the adapter is coupled to the cup by a locking member.

In another embodiment, a sink including, a vessel volume having an interior surface, a bowl, where the bowl includes a base wall and at least one side wall extending from the base wall, where the bowl at least partially defines the interior surface, a cup, where the cup includes a strainer plate defining one or more apertures and at least one side wall, where the cup at least partially defines the interior surface, a first piece of material forming the base wall of the bowl, the at least one side wall of the bowl, and the at least one side wall of the cup, and a second piece of material forming the strainer plate, and where the second piece of material is mechanically coupled to the first piece of material.

DETAILED DESCRIPTION

Figure 1:
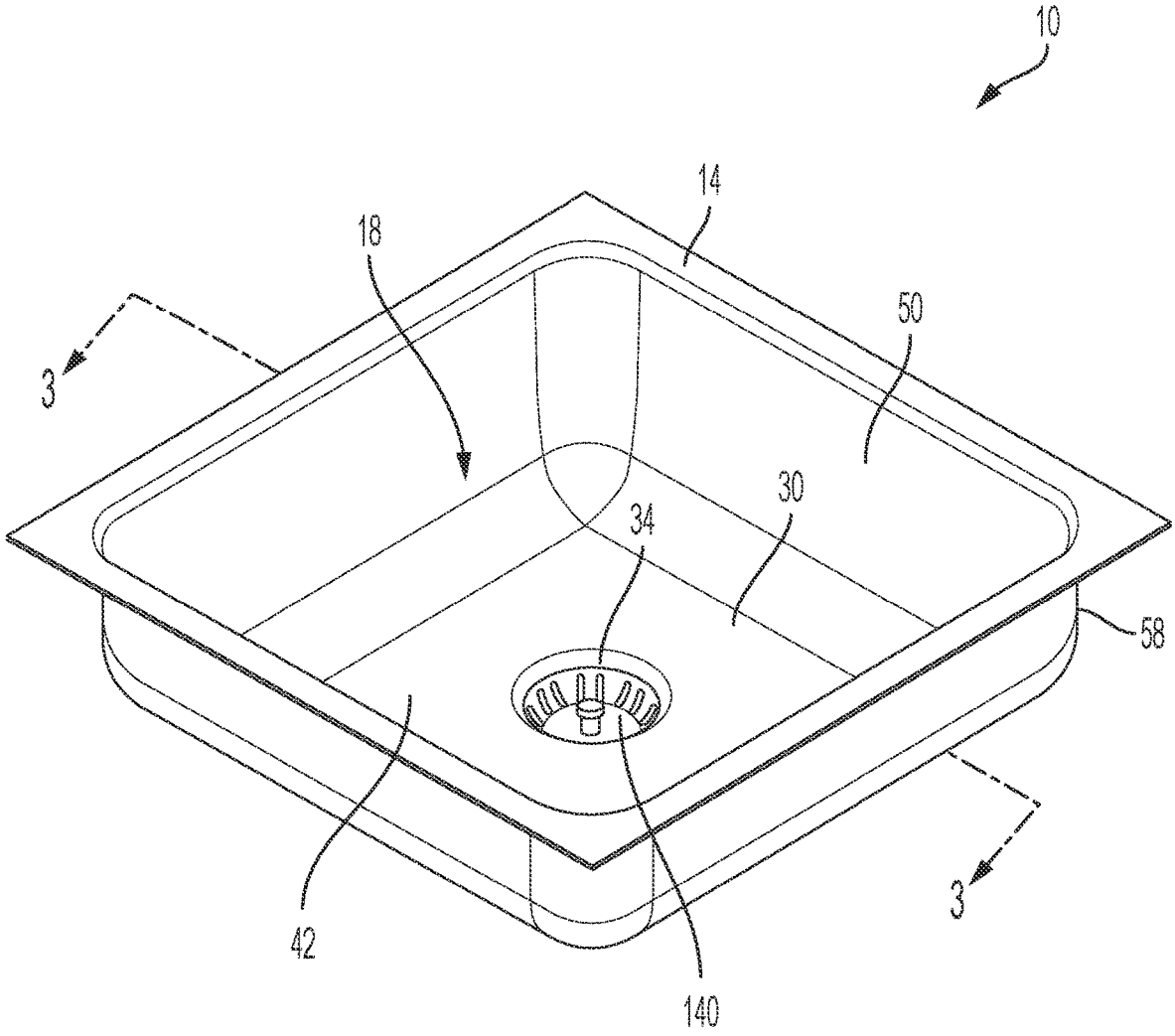
FIG. 1 is a top perspective view of a sink.

Before any embodiments of the disclosure are explained in detail, it is to be understood that the disclosure is not limited in its application to the details of construction and the arrangement of components set forth in the following description or illustrated in the following drawings. The disclosure is capable of supporting other embodiments and of being practiced or of being carried out in various ways.

FIGS. 1-9 illustrate a sink 10 having improved anti-microbial, bacteriostatic, bactericidal and/or anti-viral capabilities. More specifically, the sink 10 includes a body 14 at least partially defining a vessel volume 18 and an outlet or drain 22. When installed, the drain 22 of the sink 10 is plumbed to a corresponding plumbing system 26 so that water exiting the drain 22 can be disposed of appropriately.

Figure 2:
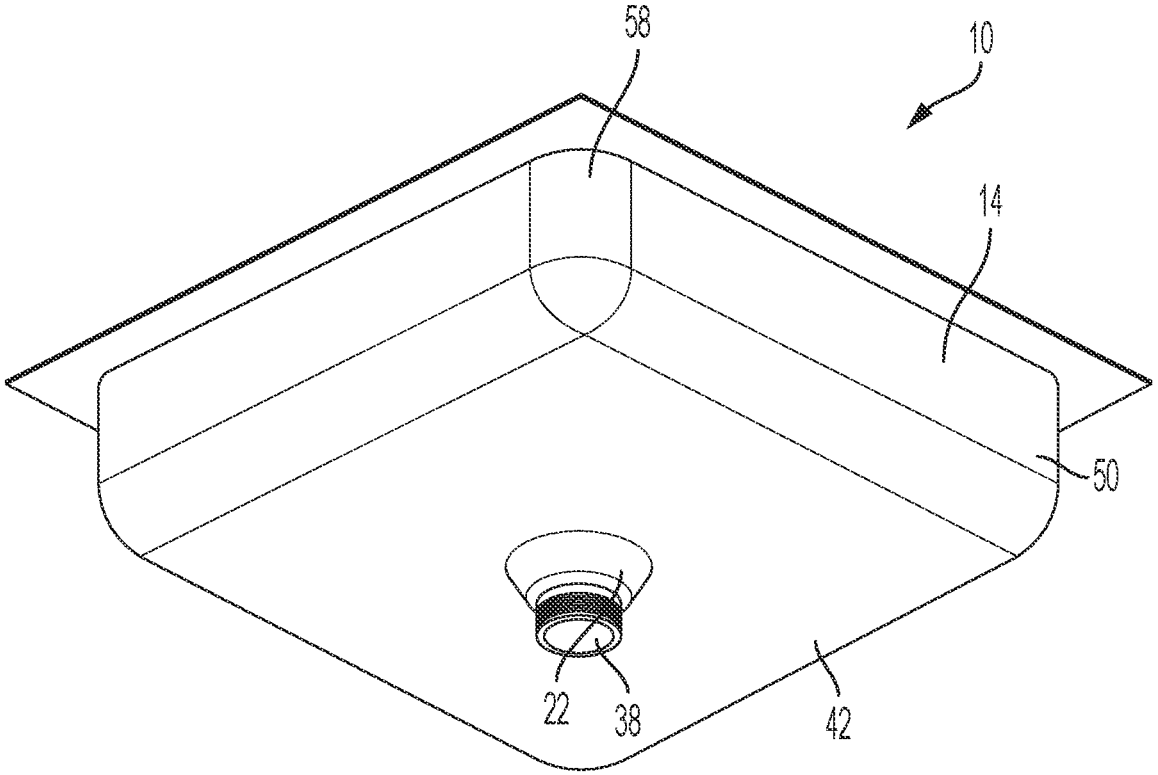
FIG. 2 is a bottom perspective view of the sink of FIG. 1.
Figure 3:
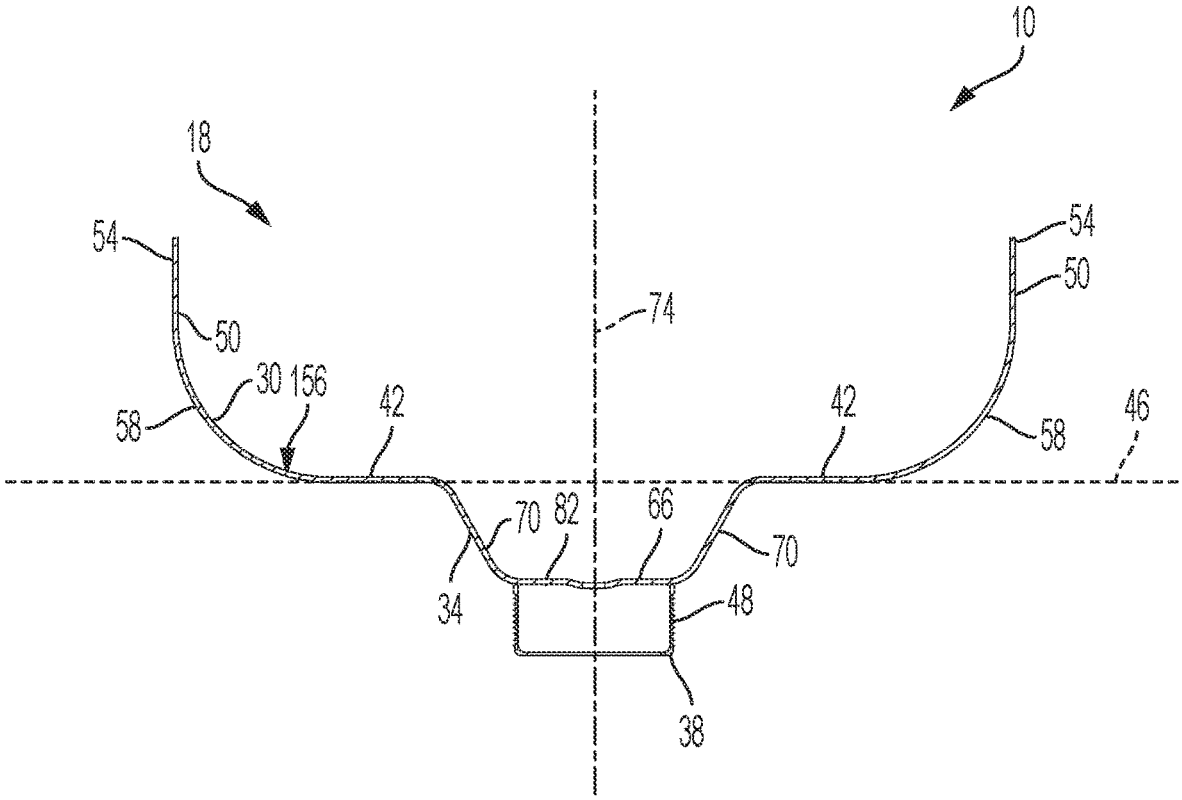
FIG. 3 is a section view taken along line 3-3 of FIG. 1.

As shown in FIG. 3, the body 14 of the sink 10 includes a bowl 30, a cup 34 extending below and open to the bowl 30, and an adapter or drainpipe 38 at least partially forming the drain 22 and configured to be coupled to the existing plumbing system 26. The bowl 30 of the sink 10 includes a base wall 42 defining a base plane 46, and one or more side walls 50 extending upwardly from the base wall 42 to define an opening or top 54. In the illustrated embodiment, the bowl 30 includes four side walls 50 so that the bowl 30 has a substantially rectangular horizontal cross-sectional shape (see FIGS. 1 and 2). However, in alternative embodiments more or fewer side walls 50 may be present producing different horizontal cross-sectional shapes such as, but not limited to, circular, triangular, pentagonal, and the like. In still other embodiments, the base wall 42 and side walls 50 may produce non-polygonal cross-sectional such as "U" shapes, "L" shapes, and the like. In some embodiments, the bowl 30 may also include a flange or flanges extending from the side walls 50 to aid in the installation and mounting of the sink 10.

In the illustrated embodiment, the side walls 50 of the sink 10 transition smoothly into the base wall 42 and between each other via corresponding radii 58 (see FIGS. 1-3). However, in alternative embodiments, the side walls 50 and base wall 42 may include alternative transition styles. Still further, while each of the illustrated side walls 50 are substantially planar, in alternative embodiments the side walls 50 may include, among other things, multiple steps, flats, curved portions and the like (not shown).

While the illustrated sink 10 includes a single bowl 30 having a substantially rectangular cross-sectional shape, it is understood that in alternative embodiments, the sink 10 may include two or more bowls (not shown) positioned adjacent to each other and forming a single unit. In such embodiments, the adjacent bowls 30 may potentially share one or more side walls 50. Furthermore, each bowl of a multi-bowl sink may define its own vessel volume 18 (described below) and have its own corresponding cup 34 and drain 22. Such individual bowls may be all formed from a single piece of material, or formed separately and combined together.

Figure 5:
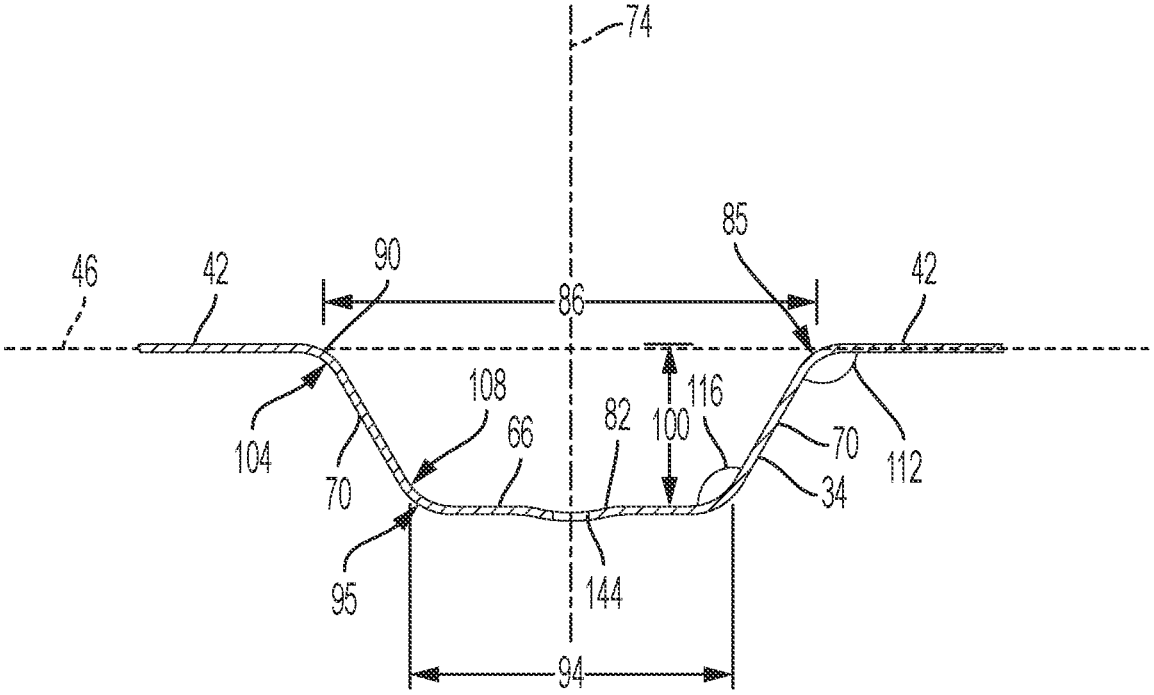
FIG. 5 is a detailed view of the cup of the sink of FIG. 1.
Figure 6:
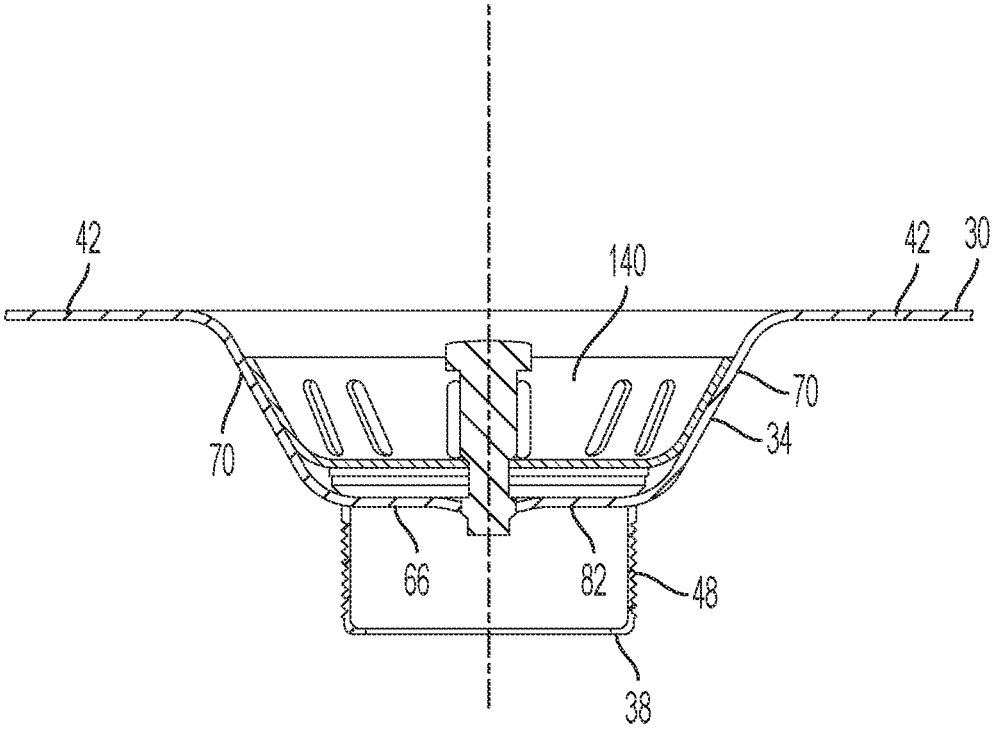
FIG. 6 is a detailed view of the cup, adapter, and strainer cup of FIG. 1.
Figure 7A:
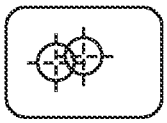
FIGS. 7A-7J are top views of various embodiments of a sink.
Figure 7B:
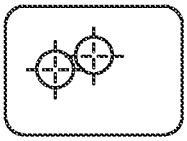
Figure 7C:
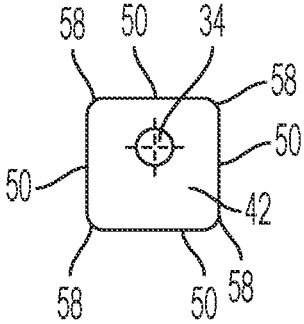
Figure 7D:
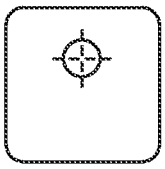
Figure 7E:
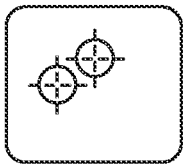
Figure 7F:
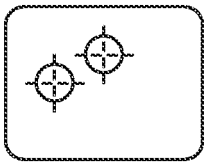
Figure 7G:
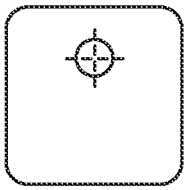
Figure 7H:
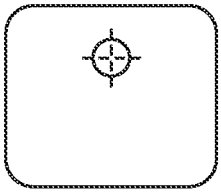
Figure 7I:
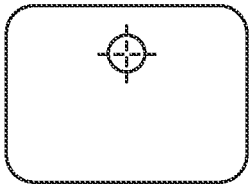
Figure 7J:
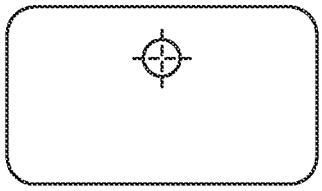

As shown in FIGS. 3 and 5-6, the cup 34 of the sink 10 is a depression formed into and extending below the base wall 42 (e.g., the base plane 46). During use, the cup 34 forms a low point for water or other fluids to collect under the force of gravity and be directed into the drain 22. The cup 34 includes a floor 66 and one or more side walls 70 extending between the floor 66 and the base wall 42 of the bowl 30 (e.g., opposite the side walls 50 of the bowl 30). The cup 34 also defines a cup axis 74 extending therethrough in the direction the cup 34 extends below the base wall 42 (e.g., generally perpendicular to the base plane 46). In the illustrated embodiment, the floor 66 of the cup 34 defines one or more apertures 120 which together form a strainer or strainer plate 82 through which fluid may flow as it exits the sink 10 (e.g., via the drain 22) and into the plumbing system 26 (described below).

The cup 34 continuously reduces in cross-sectional shape as it extends below the base wall 42 and toward the cup floor 66 (see FIG. 5). More specifically, the cup 34 defines a first cross-sectional value 84 and first critical dimension 86 both generally corresponding to the cross-sectional shape of the cup 34 taken at the inlet 90 thereof (e.g., at the interface between the cup 34 and the bowl 30) and oriented substantially normal to the cup axis 74 (e.g., horizontally). The cup 34 also defines a second cross-sectional value 92 and a second critical dimension 94 generally corresponding with the cross-sectional shape of the cup 34 taken proximate the floor 66 and oriented substantially normal to the cup axis 74. The cross-sectional value of the cup 34 at any given location is the cross-sectional area enclosed by the cup 34 at that particular location (e.g., the first cross-sectional value 84 is the cross-sectional area enclosed by the cup 34 at the inlet 90). Generally speaking, the critical dimensions 86, 94 are a consistent dimension representative of cross-sectional area at a particular location of the cup 34. For example, in embodiments where the cross-sectional shape of the cup 34 is a circle (see FIG. 8), the diameter would constitute a critical dimension. In other embodiments where the cross-sectional shape of the cup 34 is a rectangle, a diagonal would constitute the critical dimension.

In the illustrated embodiment, the cup 34 forms a frusto-conical shape producing a first critical dimension (i.e., diameter) 86 and a first cross-sectional value 84 at the inlet 90, and a second critical dimension (i.e., diameter) 94 and a second cross-sectional value 92 taken proximate the floor 66. The second critical dimension 94 is smaller than the first critical dimension 86 and the second cross-sectional value 92 is smaller than the first cross-sectional value 84. The cup 34 also defines a cup depth 100 measuring the axial height between the inlet 90 and the floor 66, a first transition radius 104 at the transition between the base wall 42 of the bowl 30 and the side wall 70 of the cup 34, and a second transition radius 108 between the side wall 70 of the cup 34 and the floor 66. The cup 34 also defines a first material thickness 85 at the first transition radius 104 and a second material thickness 95 at the second transition radius 108.

In some embodiments, the first critical dimension 86 is between 1.1 to 6 times greater than the second critical dimension 94. In other embodiments, the first critical dimension 86 is between 1.25 and 4 times greater than the second critical dimension 94. In other embodiments the first critical dimension 86 is between 1.25 to 2.5 times greater than the second critical dimension 94. In other embodiments, the first critical dimension 86 is 1.5 to 2.3 times greater than the second critical dimension 94. In still other embodiments, the first critical dimension 86 is approximately 2.3 times greater than the second critical dimension 94. In still other embodiments, the first critical dimension 86 is 1.9 times greater than the second critical dimension 94. In still other embodiments, the first cross-sectional value 84 is between 2 to 5.5 times greater than the second cross-sectional value 92. In still further embodiments, the first cross-sectional value 84 is between 2.3 to 5.3 times greater than the second cross-sectional value 92. In still other embodiments, the first cross-sectional value 84 is approximately 5.3 times greater than the second cross-sectional value 92. In still other embodiments, the first cross-sectional value 84 is 3.5 times greater than the second cross-sectional value 92.

The first critical dimension 86 is between 0.5 to 6 times larger than the cup depth 100. In other embodiments, the first critical dimension 86 is between 2.5 to 4 times larger than the cup depth 100. In other embodiments, the first critical dimension 86 is between 2.5 to 3.5 times larger than the cup depth 100. In still other embodiments, the first critical dimension 86 is between 2.9 to 3.4 times larger than the cup depth 100. In still other embodiments, the first critical dimension 86 is approximately 3 times the cup depth 100. In still other embodiments, the first critical dimension 86 is approximately 3.7 times the cup depth 100.

The second critical dimension 94 is between 0.5 to 3 times larger than the cup depth 100. In other embodiments, the second critical dimension 93 is between 1 and 2.5 times larger as the cup depth 100. In other embodiments, the second critical dimension 94 is between 1.4 and 2 times as large as the cup depth 100. In still other embodiments, the second critical dimension 94 is approximately 1.7 times as large as the cup depth. In still other embodiments, the second critical dimension 94 is approximately 1.9 times as large as the cup depth.

The first cross-sectional value 84 is between 7.5 and 10.5 times greater than the cup depth 100. In other embodiments, the first cross-sectional value 84 is between 7.6 and 10.2 times greater than the cup depth 100. In still other embodiments, the first cross-sectional value 84 is approximately 8.9 times greater than the cup depth 100.

The second cross-sectional value 92 is between 1.5 to 3.5 times greater than the cup depth 100. In other embodiments, the second cross-sectional value 92 is between 1.9 to 3.3 times greater than the cup depth 100. In still other embodiments, the second cross-sectional value 92 is approximately 2.6 times greater than the cup depth 100.

As shown in FIG. 5, the side wall 70 of the cup 34 forms a first depression angle f relative to the base wall 42 of the bowl 30. In some embodiments, the first depression angle 112 is between 100 to 179 degrees. In other embodiments, the first depression angle 112 is between 100 to 160 degrees. In still other embodiments, the first depression angle 112 is between 100 to 130 degrees. In other embodiments, the first depression angle 112 is between approximately 115 to 130 degrees. In still other embodiments, the first depression angle 112 is approximately 117 degrees.

The side wall 70 of the cup 34 also forms a second depression angle 116 relative to the floor 66 of the cup 34. In some embodiments, the second depression angle 116 is between 100 to 179 degrees. In other embodiments, the second depression angle 116 is between 100 to 160 degrees. In still other embodiments, the second depression angle 116 is between 100 to 130 degrees. In other embodiments, the second depression angle 116 is between approximately 115 to 130 degrees. In still other embodiments, the second depression angle 116 is approximately 117 degrees.

The first critical dimension 86 is between 8.5 and 10.5 times the first transition radius 104. In other embodiments, the first critical dimension 86 is between 10.2 and 8.8 times the first transition radius 104. In still other embodiments, the first critical dimension 86 is approximately 9.5 times the first transition radius 104. In still other embodiments, the first transition radius 104 may be a zero radius. In still other embodiments, the first transition radius 104 may be between 0 and 1 inch. In still other embodiments, the first transition radius 104 may be between 0 and ½ inches.

The second critical dimension 94 is between 4 and 6 times the second transition radius 108. In other embodiments, the second critical dimension 94 is between 4.4 and 5.8 times the second transition radius 108. In still other embodiments, the second critical dimension 94 is approximately 5 times the second transition radius 108. In still other embodiments, the second transition radius 108 may be a zero radius. In still other embodiments, the second transition radius 108 may be between 0 and 1 inch. In still other embodiments, the second transition radius 108 may be between 0 and ½ inches.

The material from which the sink 10 is formed has a standard or nominal thickness, generally defined as the thickness of the stock material before it undergoes any pressing, stamping forming, punching and/or other processes. More specifically, the stock material is between approximately 0.0598 inches thick and 0.0478 inches thick. In other embodiments, the stock material is between approximately 0.06 and 0.04 inches thick. In still other embodiments, the stock material is between 16 and 18 gauge. In still other embodiments, the stock material is between 22 gauge and 12 gauge. In still other embodiments, the material forming the bowl 30 has a maximum thickness generally defined as the thickest point in the material forming the bowl 30.

In such embodiments, the minimum thickness of the material forming the cup 34 is no less than 40% of the nominal thickness of the stock material forming the cup 34. For the purposes of this application, the "minimum thickness" is defined as the thinnest point in the material forming the cup 34. In other embodiments, the minimum thickness of the cup 34 is no less than 45% of the nominal thickness of the stock material. In still other embodiments, the minimum thickness of the cup 34 is no less than 60% of the nominal thickness of the stock material. In still other embodiments, the material forming the cup 34 is no less than 0.1 times the nominal thickness of the stock material forming the bowl and no greater than 24 times the nominal thickness of the stock material forming the bowl. In still other embodiments, the minimum thickness is no less than 60%, 50%, 45%, or 40% of the maximum thickness of the material forming the bowl 30.

For the purposes of this application, the numeric ranges and ratios may vary by as much as 5% to 10%.

Figure 8:
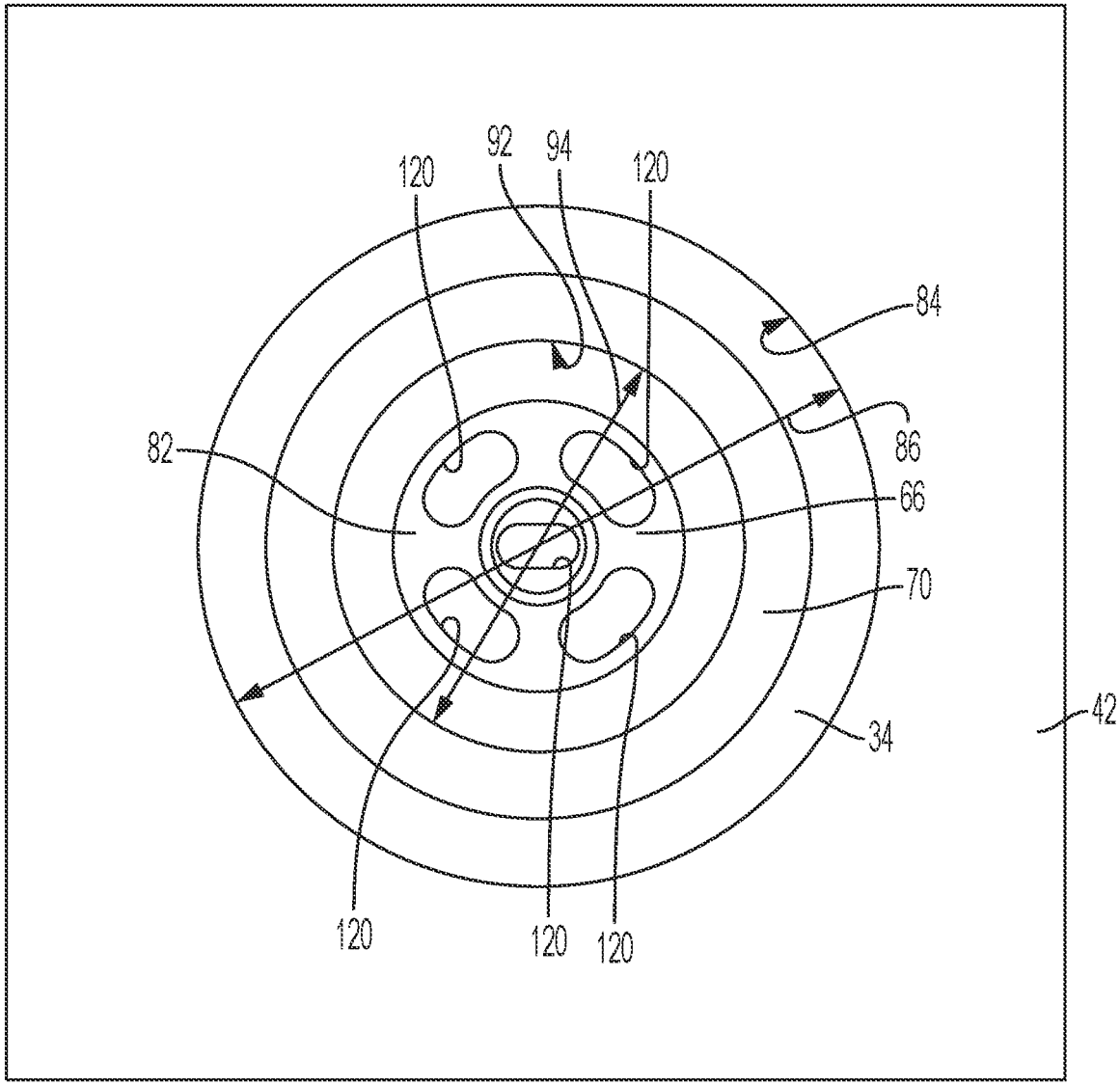
FIG. 8 is a top view of the cup of the sink of FIG. 1.
Figure 9:
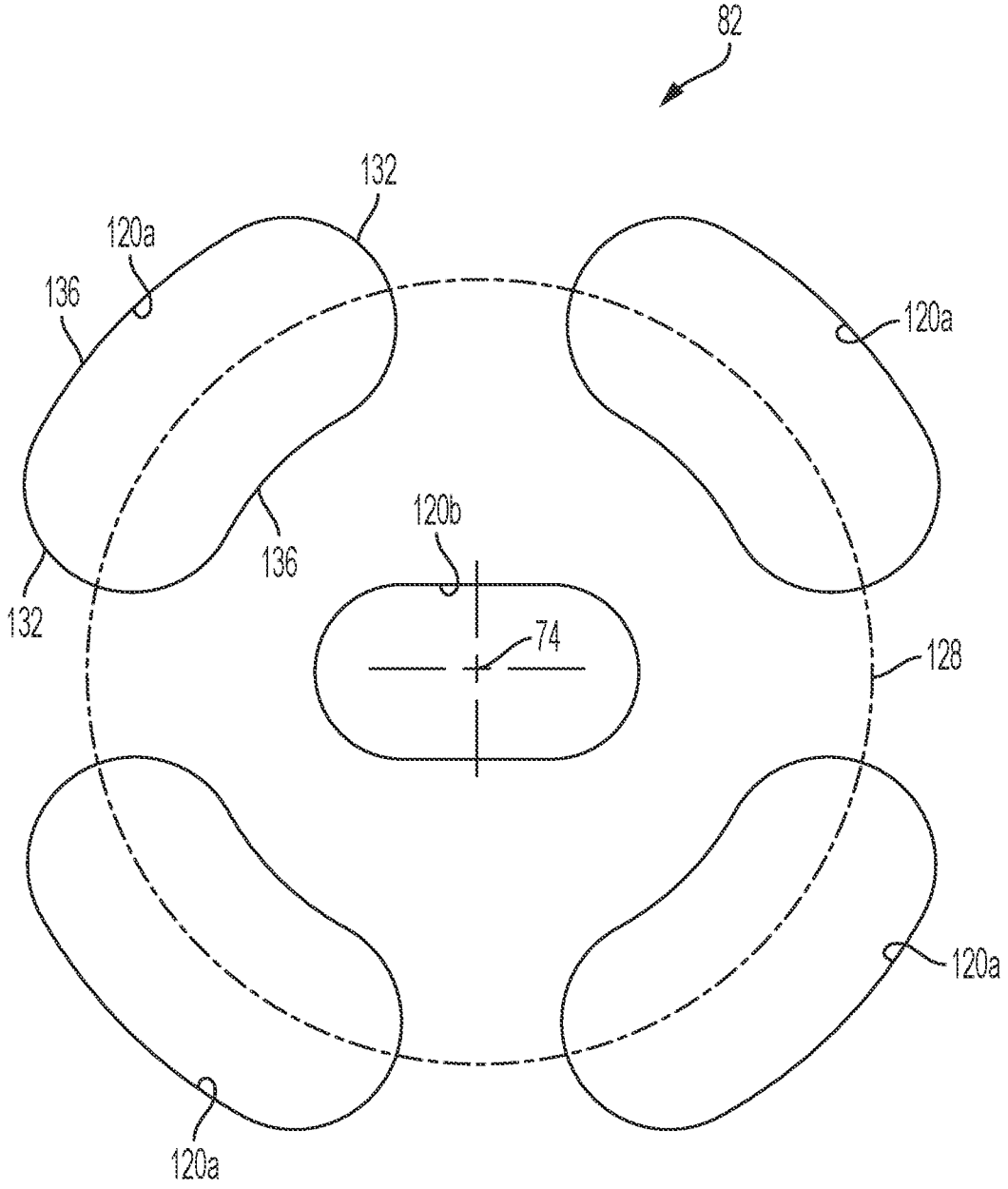
FIG. 9 is a top detailed view of the strainer of the cup of the sink of FIG. 1.
Figure 10A:
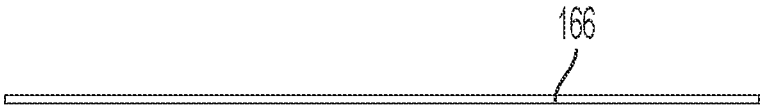
FIGS. 10A-10D illustrate the assembly process of the sink of FIG. 1.
Figure 10B:
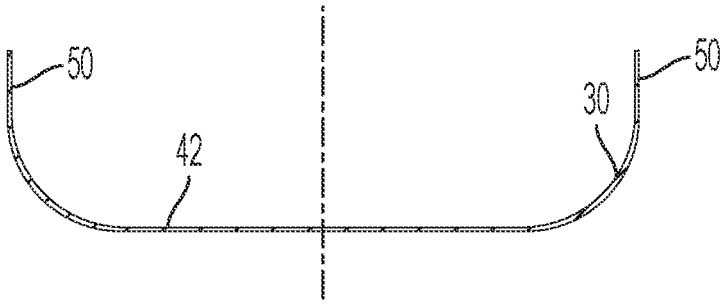
Figure 10C:
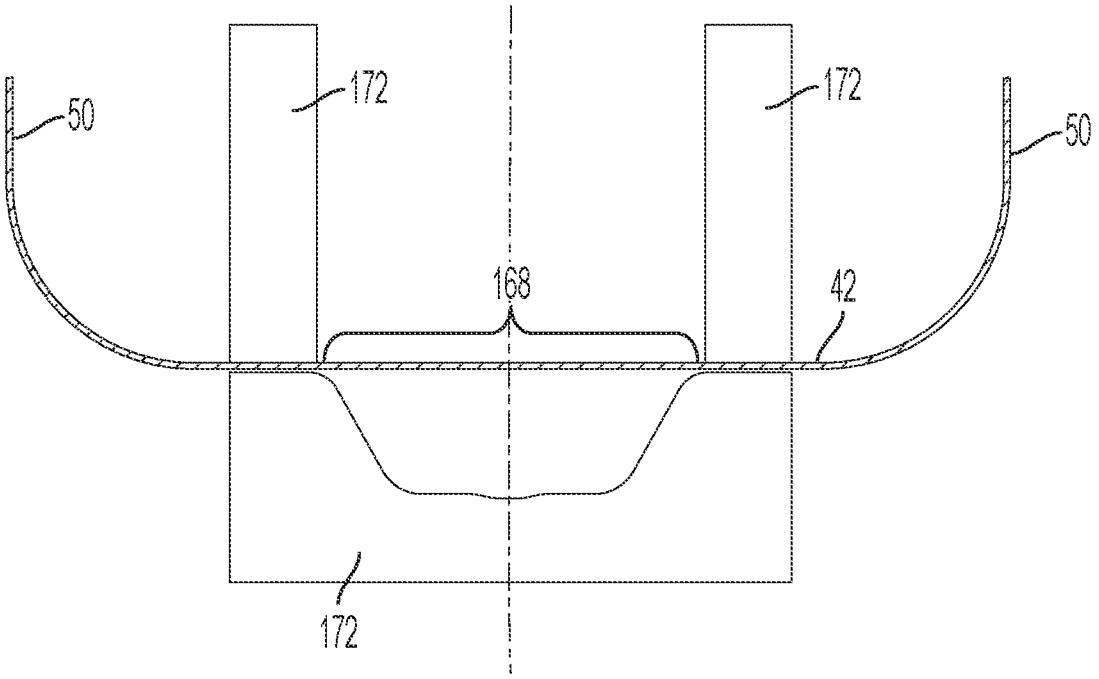
Figure 10D:
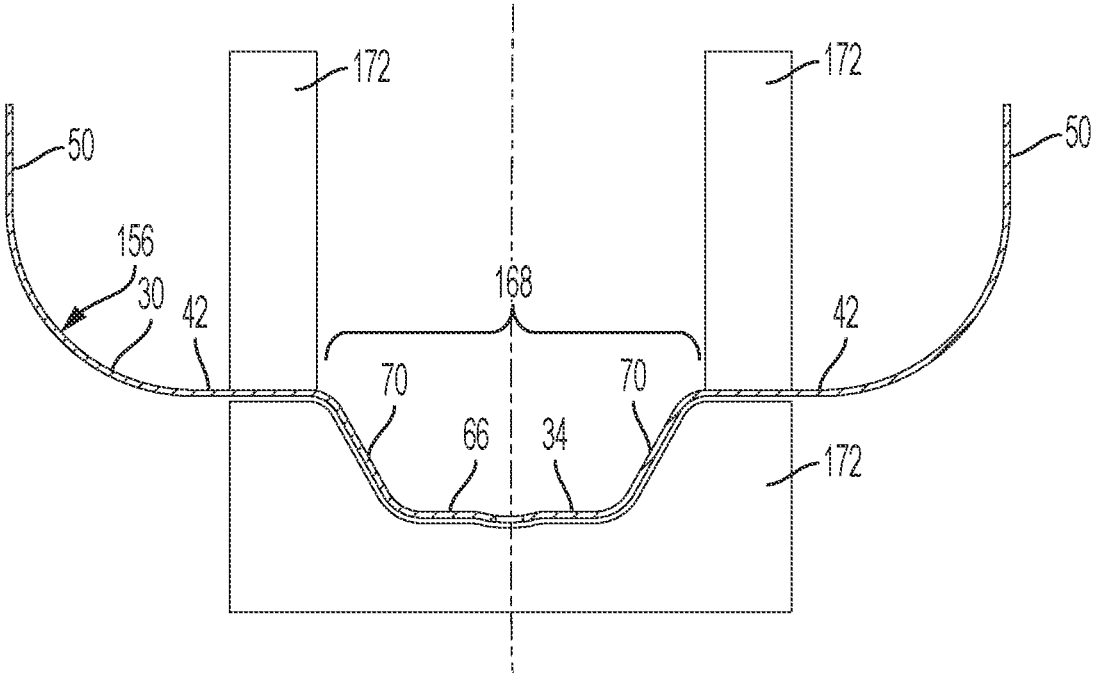

As shown in FIGS. 8 and 9, the floor 66 of the cup 34 defines one or more apertures 120 therein to form a strainer 82. The strainer 82, in turn, is configured to restrict the passage of larger items therethrough so that they cannot pass into the plumbing system 26 and form potential clogs while still permitting fluids and smaller debris to pass into and through the plumbing system 26. In the illustrated embodiment, the floor 66 defines four outer apertures 120*a*, each spaced equally along the circumference of a reference circle 128 centered on the cup axis 74. Each aperture 120*a*, in turn, is substantially elongated in shape having a pair of radiused ends 132 and connected by a pair of curved sides 136. In the illustrated embodiment, the curved sides 136 are also centered on the cup axis 74 to produce a "kidney bean" shape. While four outer apertures 120*a* are shown in the illustrated embodiment, more or fewer outer apertures 120*a* may be present. Furthermore, while all four outer apertures 120*a* of the illustrated embodiment are similar in size and shape, in alternative embodiments the individual apertures 120*a* may vary.

The floor also includes a central aperture 120*b* positioned at the center of the floor 66 (e.g., such that the cup axis 74 is positioned therein). The central aperture 120*b* is generally configured to receive at least a portion of a corresponding strainer cup 140 (described below) therein. More specifically, the central aperture 120*b* is configured to receive and selectively couple to the strainer cup 140 to position and retain the strainer cup 140 relative to the body 14 of the sink 10 (e.g., within the cup 34). In the illustrated embodiment, the central aperture 120*b* is substantially elongated in shape such that a portion of the strainer cup 140 may be passed through the aperture 120*b* (e.g., so that an elongated portion of the cup 140 aligns with the elongated portion of the aperture 120*b*), and subsequently rotated approximately 90 degrees so that it becomes axially locked therein. In other embodiment, the aperture 120*b* may be circular in shape. In still other embodiments, the central aperture 120*b* may include a cylindrical insert (see element 1316' of FIG. 12) configured to interact with a check ball contained in the strainer cup 140.

As shown in FIG. 5, the floor 66 also includes a small depression 144 formed therein and configured to act as a local "low point." While the illustrated floor 66 is substantially planar with a depression formed therein, in alternative embodiments the floor 66 may be completely planar or take on other shapes such as, but not limited to, dished, domed, and the like.

In the illustrated embodiment, the cup 34 is positioned within the base wall 42 so that it is offset from the direction of spray of any corresponding faucets (not shown). More specifically, the cup 34 is not positioned in the geometric center of the base wall 42 but is offset so that the stream of the corresponding faucets will impact the base wall 42 and not flow directly into the cup 34. FIGS. 7A-7J illustrate multiple potential offset cup 34 locations for various cross-sectional sink 10 shapes. In still other embodiments, the cup 34 may not be offset (e.g., positioned in the geometric center of the base wall 42 and/or aligned with the spray of the faucet).

Figure 4:
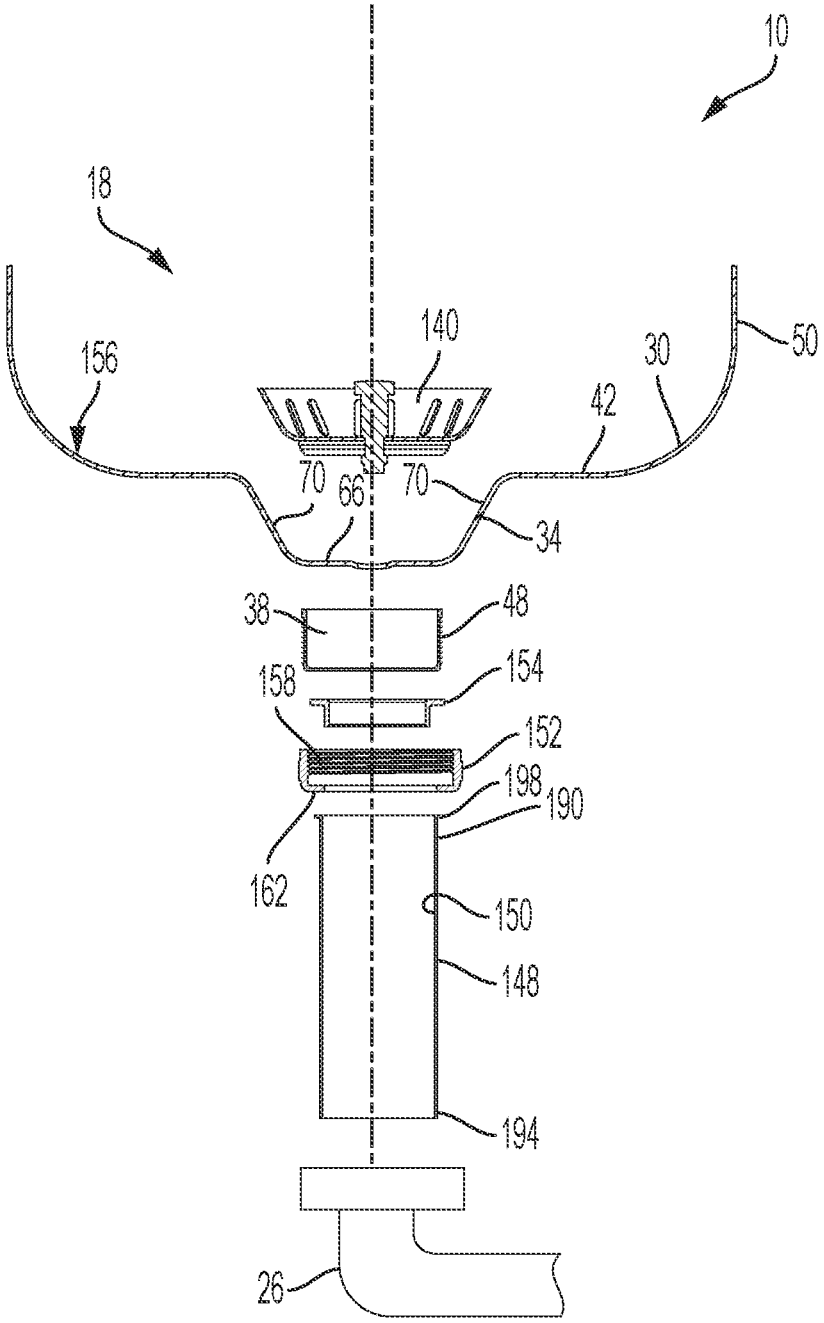
FIG. 4 is an exploded view of FIG. 3.

As shown in FIGS. 3-4, the adapter 38 of the sink 10 extends downstream of the strainer 82 and serves as the drain or outlet 22. During use, the adapter 38 is configured to act as a connection point to which the local plumbing system 26 may be attached (e.g., via the tail pipe 148). In the illustrated embodiment, the adapter 38 is substantially cylindrical in shape defining a channel 150 therethrough and having a set of exterior threads 48 formed thereon. As shown in FIGS. 3 and 4, the adapter 38 is configured to operate together with a coupling nut 152 (described below) and a washer or gasket 154 to form a watertight seal with a corresponding tail pipe 148 (described below).

The coupling nut 152 of the sink 10 is substantially cylindrical in shape defining a set of internal threads 158 and a bottom lip 162. During use, the coupling nut 152 is configured to be threaded onto the adapter 38 of the sink 10 such that it captures and secures a washer or gasket 154 and a portion of the tail pipe 148 therebetween. The resulting connection produces a watertight seal to the exterior while allowing water to flow between the channel 150 of the adapter and the tail pipe 148.

The tail pipe 148 of the sink 10 is an elongated pipe configured to be received within and coupled to the roughed-in piping of the plumbing system 26. The tail pipe 148 is substantially cylindrical in shape having a first end 190 configured to be coupled to the adapter 38 and a second end 194 configured to be coupled to the roughed-in piping of the plumbing system 26. As shown in FIG. 4, the first end 190 of the tail pipe 148 includes a flange 198 extending radially outwardly therefrom and configured to engage the lip 162 of the coupling nut 152 and sealingly engage the gasket 154.

Together, the bowl 30 and cup 34 form the vessel volume 18 of the sink 10. The vessel volume 18, in turn, is at least partially defined by an interior surface 156 of the body 14. In the illustrated embodiment, the interior surface 156 is formed by the side walls 50 of the bowl 30, the base wall 42 of the bowl 30, the side walls 70 of the cup 34, and the floor 66 of the cup 34. In alternative embodiments, additional surfaces, such as but not limited to, built in shelves, dividers, flanges, and the like may also define a portion of the interior surface 156.

In the illustrated embodiment, at least a portion of the interior surface 156 forming the vessel volume 18 has anti-microbial, bacteriostatic, bactericidal and/or anti-viral properties. For the purposes of this application, a surface has anti-microbial properties if it is capable of killing or preventing the growth of micro-organisms thereon. More specifically, an anti-microbial surface may be capable of killing at least 99.9% of micro-organisms positioned thereon within 2 hours of exposure. A surface has bactericidal properties if it is capable of killing bacteria positioned thereon. More specifically, a bactericidal surface may be capable of killing at least 99.9% of bacteria within 2 hours of exposure. A surface has bacteriostatic properties if it is capable of inhibiting the buildup and growth of bacteria thereon. More specifically, a bacteriostatic surface may be capable of inhibiting the buildup or growth of bacteria within 2 hours of exposure. Furthermore, for the purposes of this application, a surface has "anti-viral properties" if it is capable of killing viruses positioned thereon. More specifically, an anti-viral surface may be capable of killing at least 99.9% of viruses within 2 hours of exposure. Together, a surface may be considered to have "hygienic properties" if it has any combination of anti-microbial, bacteriostatic, bactericidal, and/or anti-viral capabilities.

In some embodiments, the entire interior surface 156 of the vessel volume 18 may have hygienic properties. However, in alternative embodiments, only a portion of the interior surface 156 may have hygienic properties. For example, in some embodiments only the portion of the interior surface 156 defined by the cup 34 (e.g., the side walls 70 and floor 66) may have hygienic properties (see interior surface 3156 of FIG. 14). In still other embodiments, only the exterior surfaces of the strainer 82 (e.g., the floor 66 of the cup 34) may have hygienic properties (see floor 1066 of FIG. 12). In still other embodiments, the sink 10 may define a horizontal reference plane whereby any portion of the interior surface 156 located below the plane may have hygienic properties. In still other embodiments, any portion of the interior surface 156 located vertically below the base plane 46 may have hygienic properties (see base plane 3046 of FIG. 14). In still other embodiments, the sink 10 may define a reference perimeter 164 centered on the cup axis 74 (see FIG. 15). In such embodiments, any interior surface 156 that is located within the reference perimeter 164 may have hygienic properties.

Furthermore, the hygienic properties of the interior surface 156 of the sink 10 may be established in various ways. In some embodiments, the hygienic properties may be produced by coating the underlying substrate (e.g., the material forming the body 14 of the sink 10) with a material having hygienic properties (e.g., with Microban and/or Silvershield). In other embodiments, the substrate material itself may have hygienic properties (e.g., by being made from copper-nickel alloys). In still other embodiments, the substrate material may be treated (e.g., chemically and the like) so that the interior surface of the substrate acquires long-lasting hygienic properties. In still other embodiments, a combination of the above listed tactics may be used.

As shown in FIGS. 3 and 10A-10D, the elements forming the vessel volume 18 are formed from a single piece of continuous sheet material 166 (e.g., stainless steel, CuVerro, copper-nickel alloys, and the like). More specifically, the bowl 30, cup 34, and strainer 82 of the body 14 are all formed from the single piece of continuous sheet material 166 while the adapter 38 is formed separately and coupled (e.g., welded, brazed, pressed, crimped, and/or threaded) thereto. As shown in FIGS. 1 and 2, the illustrated body 14 does not contain any internal welded seams therein.

To form the vessel 18 from the single piece of sheet material 166, the sink 10 undergoes a multi-step stamping process. First, the raw stock sheet material 166 (e.g., stainless steel, CuVerro, copper-nickel alloys and the like) is placed in and secured relative to a press. (See FIG. 10A). The stock sheet material then undergoes a first pressing action whereby the bowl 30 is formed (e.g., the side walls 50 and base wall 42). No cup 34 is present. (See FIG. 10B).

With the bowl 30 formed, the sink 10 is then re-secured to a press such that a portion of the base wall 42 is mechanically isolated from the rest of the sink body 14 forming an isolated zone 168. (See FIG. 10C). More specifically, clamps 172 clamp down onto the base wall 42 forming the isolated zone 168 therein. The clamps 172 are configured such that any forces applied to the material located within the isolated zone 168 are not transmitted to the material positioned outside the isolated zone 168. More specifically, the clamping action (e.g., grasping an enclosed perimeter of material in direct contact with the clamps 172) isolates the forces from inside the isolated zone 168 with the material located outside the isolated zone 168. As shown, the clamps 172 of the illustrated embodiment are substantially annular in shape forming a circular isolated zone 168 within the base wall 42 of the sink 10.

With the sink 10 secured to the press, the sink 10 then undergoes a second pressing action whereby the cup 34 is formed into the base wall 42 within the isolated zone 168. (See FIG. 10D). More specifically, the pressing apparatus engage the material within the isolated zone 168 such that the material located therein is re-formed to form the cup 34. As discussed above, because the pressing action occurs within the isolated zone 168, the forces and material deformation that occurs as a result of the second pressing action is limited to the material located within the isolated zone 168.

In the illustrated embodiment, the single-piece of sheet material 166 forming the sink 10 has hygienic properties. As such, all of the resulting exposed surfaces, including the interior surfaces 156 forming the vessel volume 18 have hygienic properties. Such sheet material may include, but is not limited to, CuVerro and the like.

In some embodiments, the pressing apparatus may also include a punch assembly contained therein. In such embodiments, the punch assembly is configured to punch the apertures 120 of the strainer 82 during the second pressing action. In alternative embodiments, the apertures 120 of the strainer 82 may be formed as part of a separate action or during the first pressing action.

With the bowl 30 and cup 34 formed from the single piece of stock material, the adapter 38 is then coupled downstream of the strainer 82 (e.g., to the bottom of the cup 34). In the illustrated embodiment, the adapter 38 is joined to the cup 34 (e.g., by welding, soldering, brazing, and the like) to produce a water-tight fit such that fluid flowing through the apertures 120 of the strainer 82 are directed into and flow through the adapter 38 (see FIG. 4). In alternative embodiments, the adapter 38 may be attached to the cup 34 using alternative methods such as, but not limited to, pressing the adapter 38 onto the cup 34, threading the adapter 38 onto the cup 34, crimping the adapter 38 to the cup 34, and/or using rivets or other types of mechanical fasteners. In still other embodiments, a combination of attaching methods may be used.

With the sink 10 assembled, the sink 10 may then be installed. To install the sink 10, the body 14 is first supported or mounted in the desired location. The user then places the drain 22 in fluid communication with the corresponding plumbing system 26.

To do so, the user first assembles the coupling nut 152 and the tail pipe 148 so that the flange 198 of the pipe 148 engages the lip 162 of the nut 152. The user then assembles the washer 154 so that it rests within the coupling nut 152 and in contact with the flange 198 of the pipe 148. The user may then attach the second end 194 of the pipe 148 to the rough plumbing of the plumbing system 26.

With the pipe 148 attached to the plumbing system 26, the user may then thread the nut 152 onto the adapter 38 so that the washer 154 is captured between the flange 198 of the pipe 148 and the adapter 38 forming a water tight seal therebetween. The resulting connection forms a watertight corridor between the strainer 82 and the plumbing system 26 for water to flow.

While the illustrated single piece of material is formed from a continuous single type of material (e.g., entirely stainless steel or entirely CuVerro), in alternative embodiments, the vessel 18 may be formed from a single piece of hybrid material formed from two or more types of materials joined together. More specifically, the underlying sheet 202 may include one or more sub-portions 206 formed from a second, different material that has one or more unique attributes. For example, the underlying sheet 202 may be formed from a material that does not have hygienic properties (e.g., stainless steel) while the sub-portions 206 may be formed from a second material that does have hygienic properties (e.g., CuVerro). In such embodiments, the size, shape, and location of the sub-portions 206 may be configured to correspond with select locations and details of the finished sink 10 where it is desirable to have the properties of the second material. For example, a sub-portion 206 of the second material having hygienic properties may be located in the single piece of stock material so that it corresponds with the cup 34. In such an example, the resulting cup 34 would have hygienic properties while the remainder of the sink 10 (e.g., corresponding with the areas of the stock sheet material formed from the first material) would not.

In still other embodiments, the continuous single type of material may be treated such that a sub-portion 206 there of treated and/or coated so that the sub-portion 206 has one or more properties that are different than the rest of the material. For example, the sub-portion 206 may be treated with a coating having hygienic properties while the rest of the material may not. Furthermore, while the illustrated material is shown having a single sub-portion 206, it is understood that two or more sub-portions 206 may be present.

Figure 12:
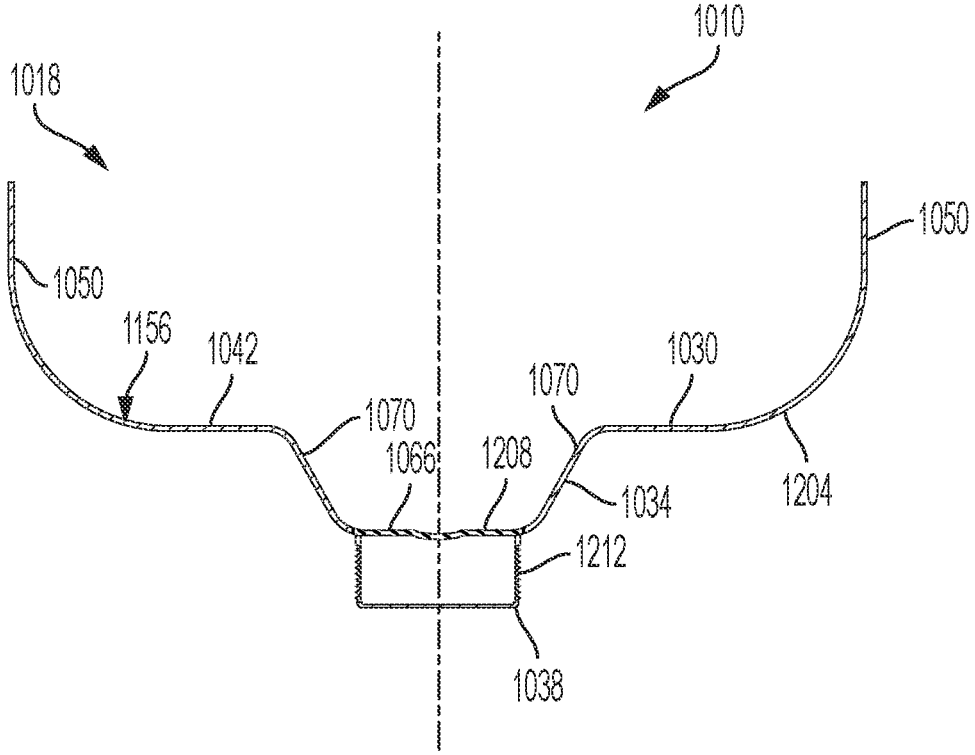
FIGS. 12-20J illustrate other embodiments of the sink.
Figure 12A:
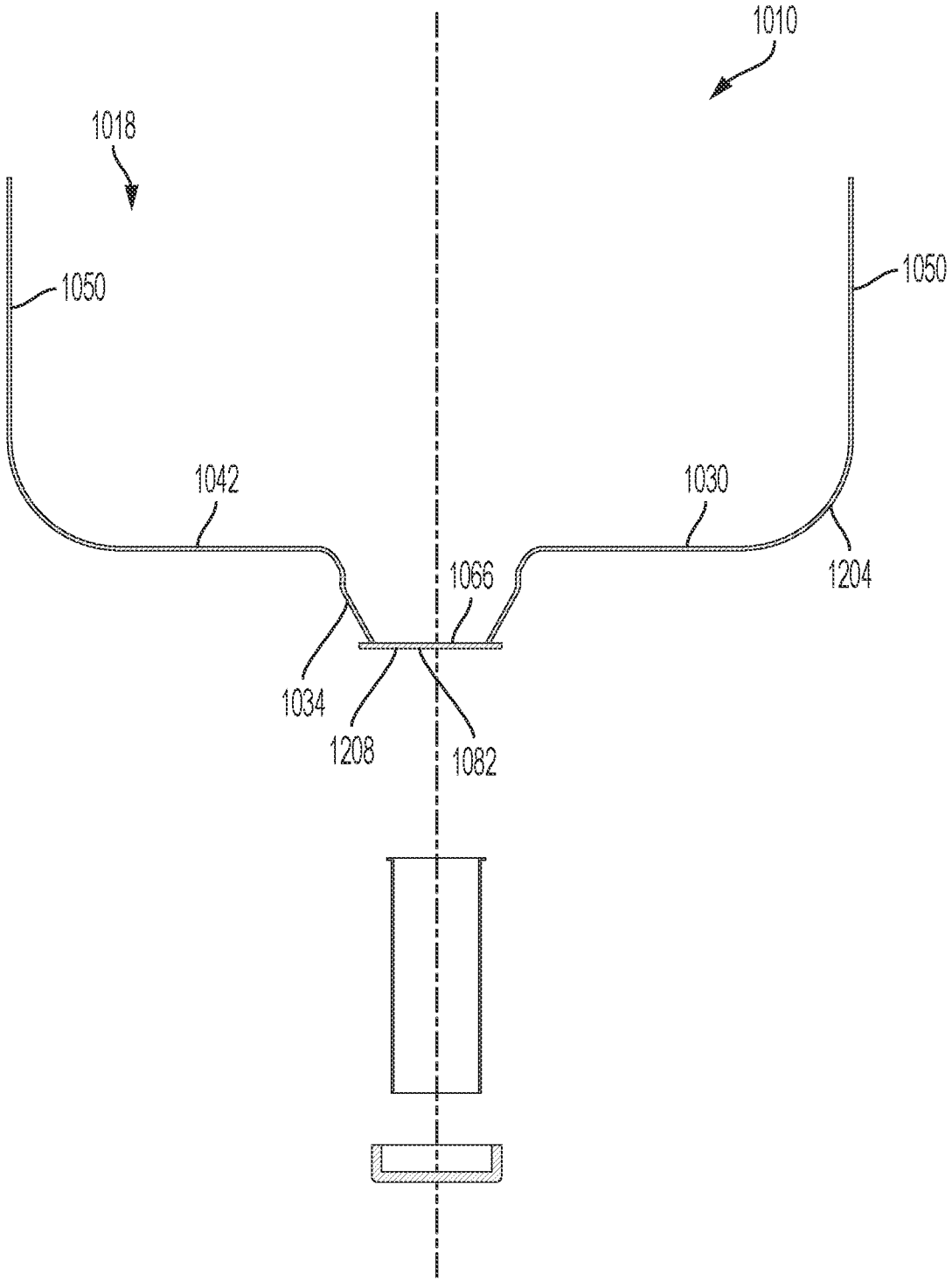

FIGS. 12 and 12A illustrate another embodiment of the sink 1010 where the vessel volume 1018 is formed from multiple pieces of sheet material. The sink 1010 is substantially similar to the sink 10 so only the differences will be discussed herein. The sink 1010 includes a first piece of sheet material 1204 forming a first portion of the vessel volume 1018 and a second piece of sheet material 1208 forming a second portion of the vessel volume 1018. In the illustrated embodiment, the two pieces of sheet material 1204, 1208 are formed from different materials having different properties. For example, the first piece of sheet material 1204 does not have hygienic properties while the second piece of sheet material 1208 does have hygienic properties. Other property differences may include, but are not limited to, material thickness, material type, coatings applied (e.g., with hygienic properties), textures applied, and the like.

As shown in FIG. 12, the first piece of sheet material 1204 forms the bowl 1030 (e.g., the side walls 1050 and base wall 1042) and a portion of the cup 1034 (e.g., the side walls 1070) while the second piece of sheet material 1208 forms the strainer 1082 (e.g., the floor 1066 of the cup 1034). In such embodiments, the adapter 1038 is formed from a third piece of material 1212.

To manufacture the sink 1010, the user first forms the first piece of sheet material 1204 into the desired shape using one or more stamping, forming, and/or punching processes. The user then forms the second piece of sheet material 1208 into the strainer 1082 using one or more separate stamping and/or forming processes. With the two pieces prepared, the first piece of sheet material 1204 is joined to the second piece of sheet material 1208 (e.g., welded, soldered, brazed, and the like) to form a water tight joint and a completed vessel volume 1018. The resulting structure produces a vessel volume 1018 where the strainer 1082 may have different material properties than the material of the rest of the vessel volume 1018. For example, the surfaces of the strainer 1082 may have hygienic properties while the interior surfaces 1156 of the rest of the vessel volume 1018 do not. While the illustrated second piece of sheet material 1208 is fused to the first piece 1204, it is to be understood that alternative forms of connection may also be used such as, but not limited to, crimped, threaded, pressed, and the like.

Figure 12B:
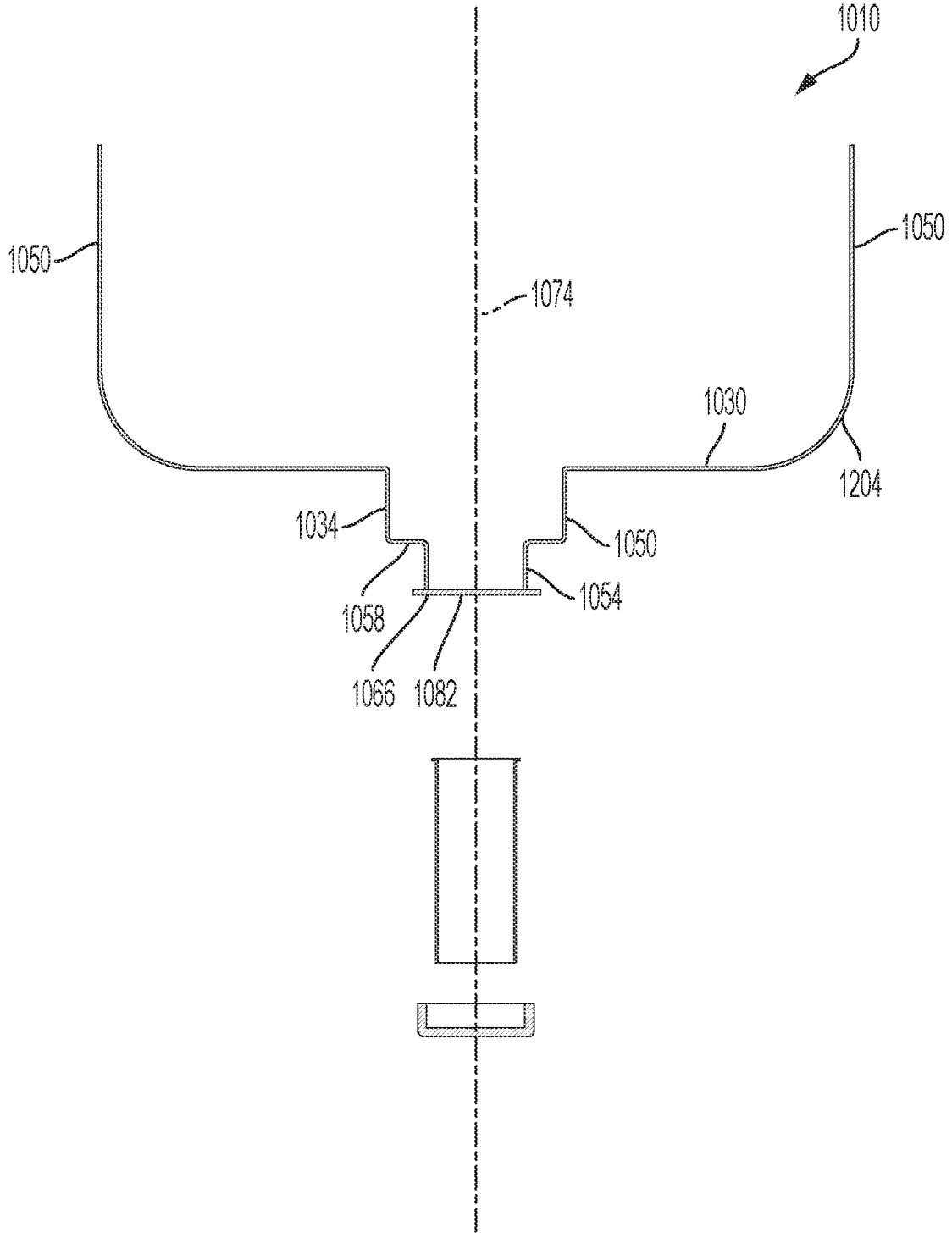

With the bowl 1030 and cup 1034 created, the remainder of the sink 1010 can be manufactured and installed as described above. While the cup 1034 of the sink 1010 may have a substantially frusto-conical shape in other embodiments other shapes may be used. For example, FIG. 12B illustrates the cup 1034 with a "stepped" cross-sectional shape. The stepped shape includes a first cylindrical portion 1250 having a first diameter and a second cylindrical portion 1254 having a second diameter less than the first diameter. The two portions 1250, 1254 are interconnected by an intermediate wall 1258 extending therebetween. The intermediate wall 1258 may be perpendicular to the cup axis 1074 or oblique to the axis 1074.

Figure 12C:
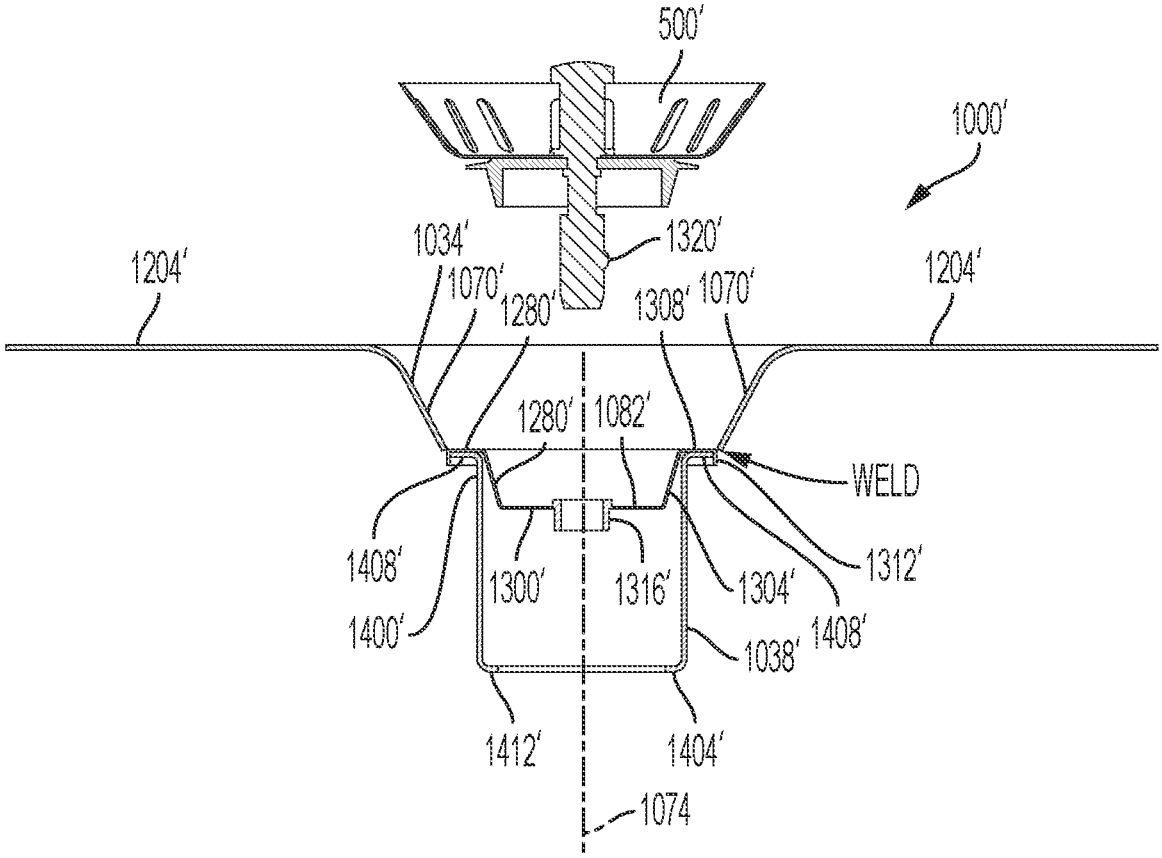
Figure 12D:
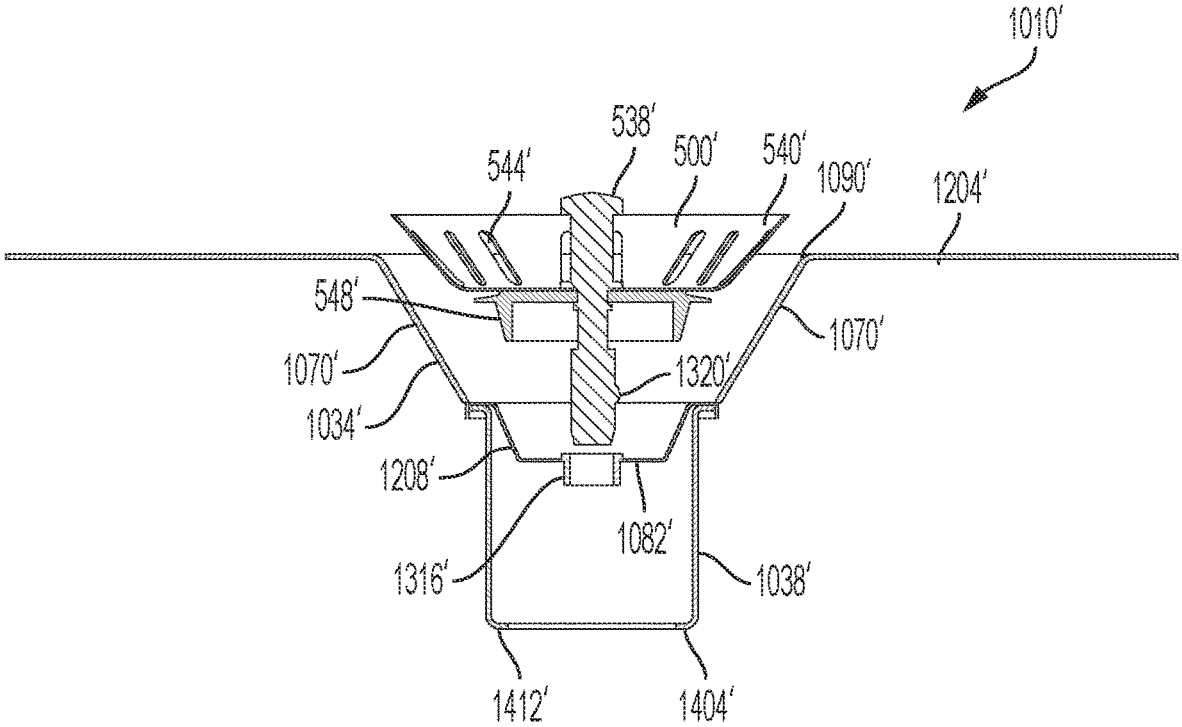

FIGS. 12C-12D illustrates another embodiment of the sink 1010'. The sink 1010' is substantially similar to the sink 1010 so only the differences will be discussed herein. The second piece of sheet material 1208' forms the strainer 1082' and a plurality of locating or alignment features 1280' configured to interact with both the adapter 1038' and the first piece of sheet material 1204.

The shape of the strainer 1082' includes a bottom or straining wall 1300', a strainer side wall 1304' extending upwardly and radially outwardly from the straining wall 1300', a first locating wall 1308' extending from the top of the strainer side wall 1304' opposite the straining wall 1300' and oriented substantially perpendicular to the cup axis 1074, and a second locating wall 1312' oriented substantially parallel to the cup axis 1074. Together, the first locating wall 1308' and the second locating wall 1312' are configured to engage the adapter 1038 to position the strainer 1082' relative thereto. More specifically, the locating walls 1308', 1312' are configured to engage the adapter 1038 and position the strainer 1082' so that it is concentric with the adapter 1038' and positioned proximate the first end 1400 thereof (described below). As shown in FIG. 13C, the straining wall 1300' of the strainer 1082' also forms a strainer boss 1316' configured to receive at least a portion of the strainer 500' therein and locate the strainer concentric with the straining wall 1300'. More specifically, the strainer boss 1316' is configured to operate together with a strainer 500' having a check ball 1320' for securing the strainer 500' to the strainer boss 1316' (see FIGS. 12D and 112E).

The adapter 1038' is substantially cylindrical in shape and includes a first end 1400', a second end 1404' opposite the first end 1400'. The adapter 1038' also includes an annular flange 1408' extending radially outwardly from the first end 1400' and a sealing surface 1412' extending radially inwardly from the second end 1404' to interact with a gasket 154 (see FIG. 4). In some embodiments, the adapter 1038' also includes a set of external threads (not shown) to threadably engage with the coupling nut 152 (see FIG. 4) to secure the gasket 154 against the sealing surface 1412'.

When assembled, the first and second locating walls 1308', 1312' of the strainer 1082' interact with the annular flange 1408' of the adapter 1038' to relatively align the two items both axially and radially. The two items 1082', 1038' are then fused together (e.g., by welding, brazing, and the like) to form a sub-assembly. In other embodiments, the two items 1082', 1038' may be attached by other methods such as, but not limited to, crimping, pressing, threading, fastening, and the like.

With the strainer 1082' and adapter 1038' sub-assembly formed, the sub-assembly may then be fused to the first piece of sheet material 1204' to complete the vessel volume 1018'. More specifically, the sub-assembly is welded to the bottom edge of the side walls 1070' of the cup 1034' (e.g. the first locating wall 1308' is placed in contact with the side walls 1070'). In the illustrated embodiment, the welds are located on the outside of the assembly. However, in alternative embodiments, the welds may be on the inside and ground flat to produce a smoother look. While the illustrated embodiment is welded together, in other embodiments the sink 1010' may be brazed, fused, crimped, pressed, threaded, and the like. Still further, a combination of such connecting styles may be used depending on the size, location, and type of materials included in the resulting joint.

Figure 12E:
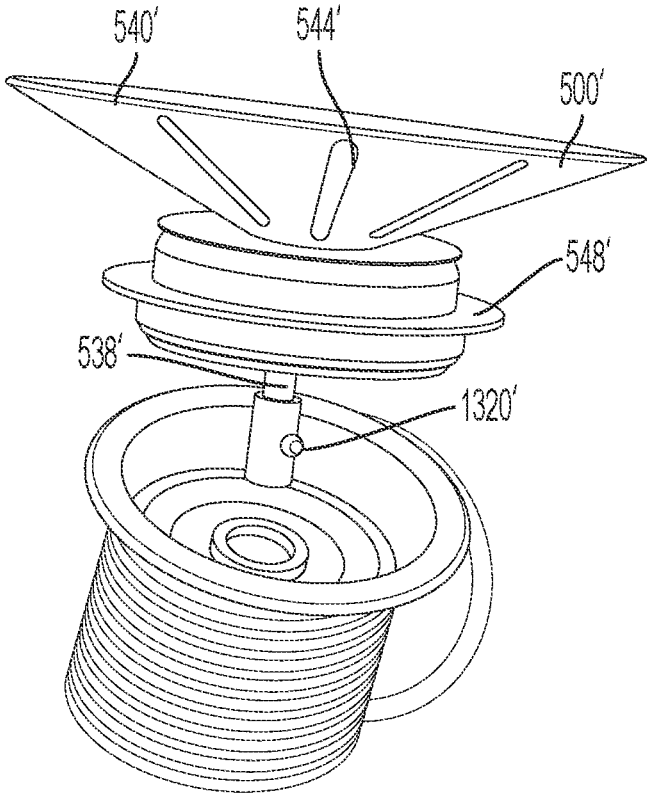

As shown in FIGS. 12D and 12E, the strainer cup 500' may include a core 538', dish 540' extending radially outwardly from the core 538', and a baffle 544'. During use, the strainer cup 500' is movable axially relative to the cup 1034' between a closed position (see FIG. 6) in which the baffle 544' engages the interior surface of the cup 1034' and does not permit fluid to flow through the strainer 1082', and an open position (see FIG. 28) in which the baffle 544' is spaced from the cup 1034' and fluid is able to flow past the strainer cup 500' and through the strainer 1082'.

The dish 540' of the strainer cup 500' is substantially frusto-conical in shape having a base wall 554' oriented substantially normal to the core 538', and a sidewall 548' extending axially upwardly and radially outwardly from the base wall 544'. The dish 540' also defines a plurality of apertures 544' for fluid to flow therethrough. As shown in FIG. 12D, the side wall 548' of the dish 540' is oriented at substantially the same angle as the sidewall 1070' of the cup 1034'. Because both the cup 1034' and the dish 540' are angled and produce a conical shape, upward axial displacement of the dish 540' relative to the cup 1034' (e.g., from the closed toward the open positions) causes a substantially even gap 552' to form along the entire length of the sidewall 548'. In the illustrated embodiment, the strainer cup 500' is configured so that the gap 552' is substantially equal to the width of the apertures 544' when the strainer cup 500' is in the open position.

The strainer 500' also includes a locking detent or check ball 1320' that is adjustable by the user between a locked position, where the ball 1320' extends out from the core 538' (e.g., radially outwardly) and an unlocked position, where the ball 1320' does not extend out from the core 538'. During use, the user is able to manipulate the ball 1320' between the locked and unlocked positions through a button or input. When the ball 1320' is in the unlocked position, the strainer 500' is able to freely travel axially within the strainer boss 1316' and even be removed completely therefrom (see FIG. 12D). When the ball 1320' is in the locked position, the strainer 500' may be locked in one of the open or closed positions. More specifically, when the ball 1320' is in the locked position and rests atop the strainer boss 1316', the strainer 500' remains in the open position (see FIG. 28). However, when the ball 1320' is in the locked position and contacts the bottom of the strainer boss 1316', the strainer 500' is locked in the closed position.

The baffle 548' is configured to sealingly engage with the cup 1034 to seal-off the strainer 1082' and not permit any fluid to flow therethrough. When manufactured, any part or sub-group of parts of the strainer 500' (e.g., the core 538', dish 540', baffle 548', and the like) may be formed from materials having hygienic properties.

While the strainer 500' is shown installed on sink 1010', it is understood that the strainer 500' may be incorporated into other sink embodiments, including those described herein.

Figure 12F:
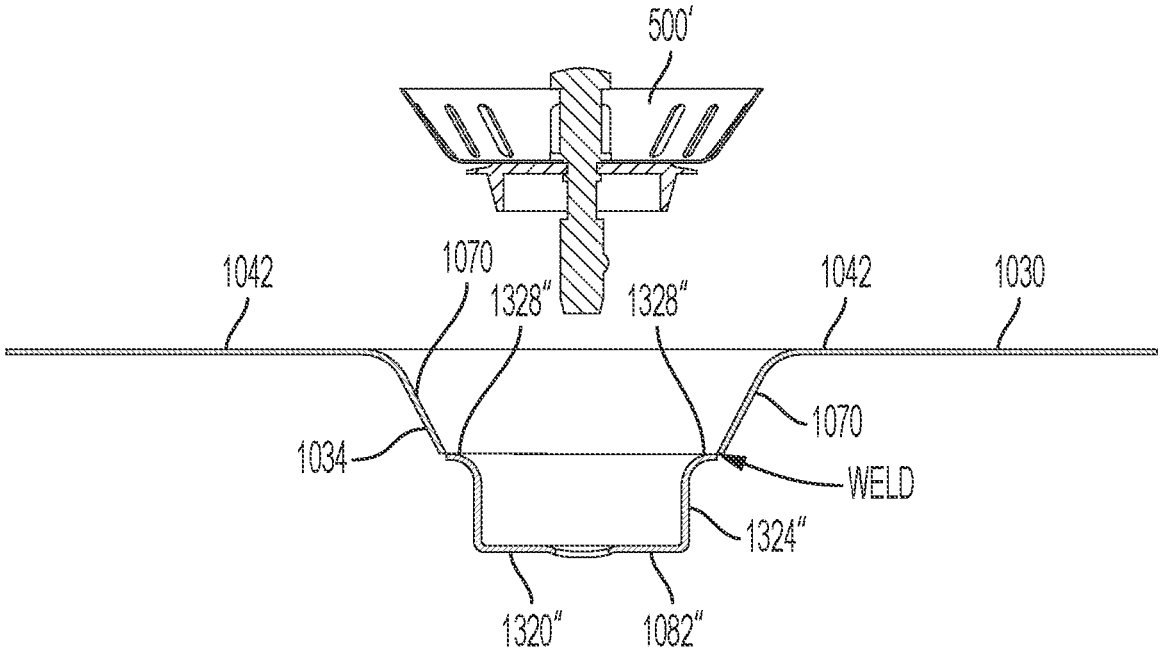

FIG. 12F illustrates a strainer 1082" with a different shape. More specifically, the strainer 1082" is substantially "funnel" shaped having a base wall 1320", side walls 1324" extending axially upwardly from the base wall 1320", and an annular flange 1328" extending radially outwardly from the side walls 1324". The flange 1328', in turn, is coupled to the side walls 1070 of the cup 1034. Together, the strainer 1082" and cup 1034 produce a "stepped" shape that decreases in cross-sectional size as it extends downwardly away from the base walls 1042 of the bowl 1030. In the illustrated embodiment, the strainer 1082" is fused (e.g., welded, brazed, soldered) to the side walls 1070 of the cup 1034.

Figure 12G:
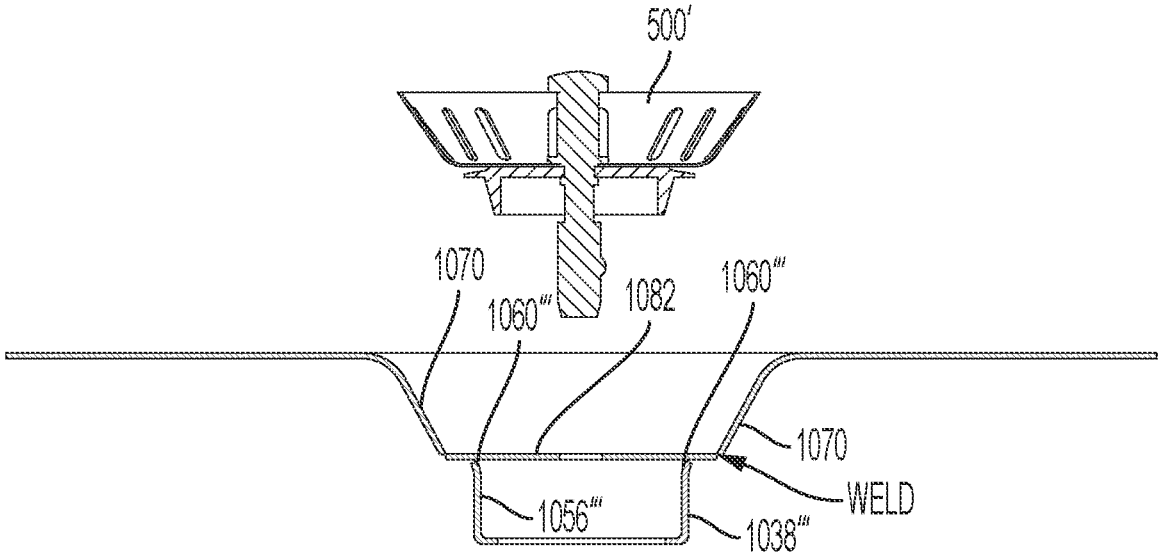

FIG. 12G illustrates an adapter 1038'. The adapter 1038'" includes a body 1056' with a radially outwardly extending flange 1060' on one end. The flange 1060'" is sized such that it is smaller than the outer diameter of the strainer 1082 to produce a gap therebetween. In turn, this produces two separate weld locations on the exterior of the assembly. As such, the adapter 1038' is only attached to the strainer 1082 and not directly to the side walls 1070 of the cup 1034.

Figure 13:
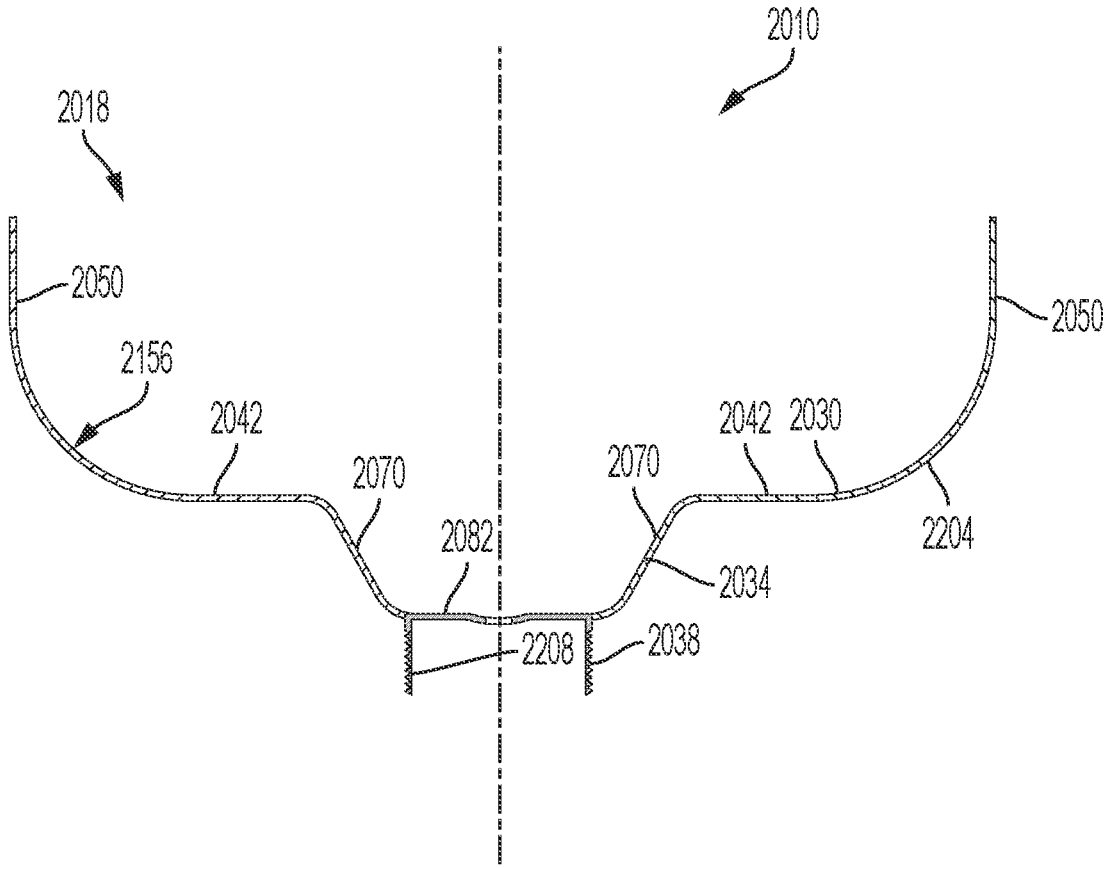
Figure 13A:
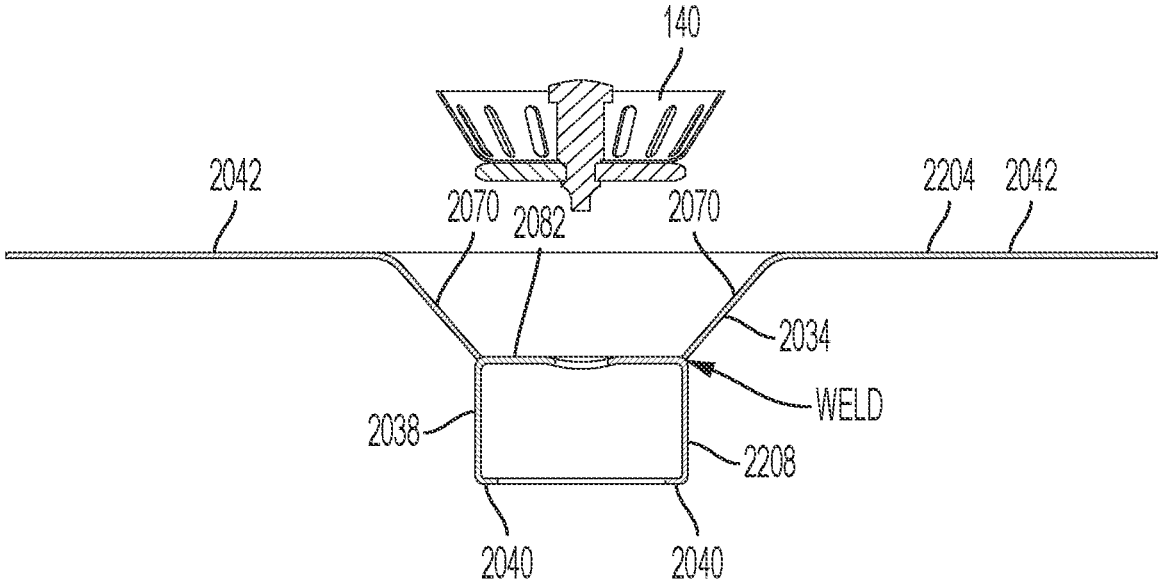
Figure 13B:
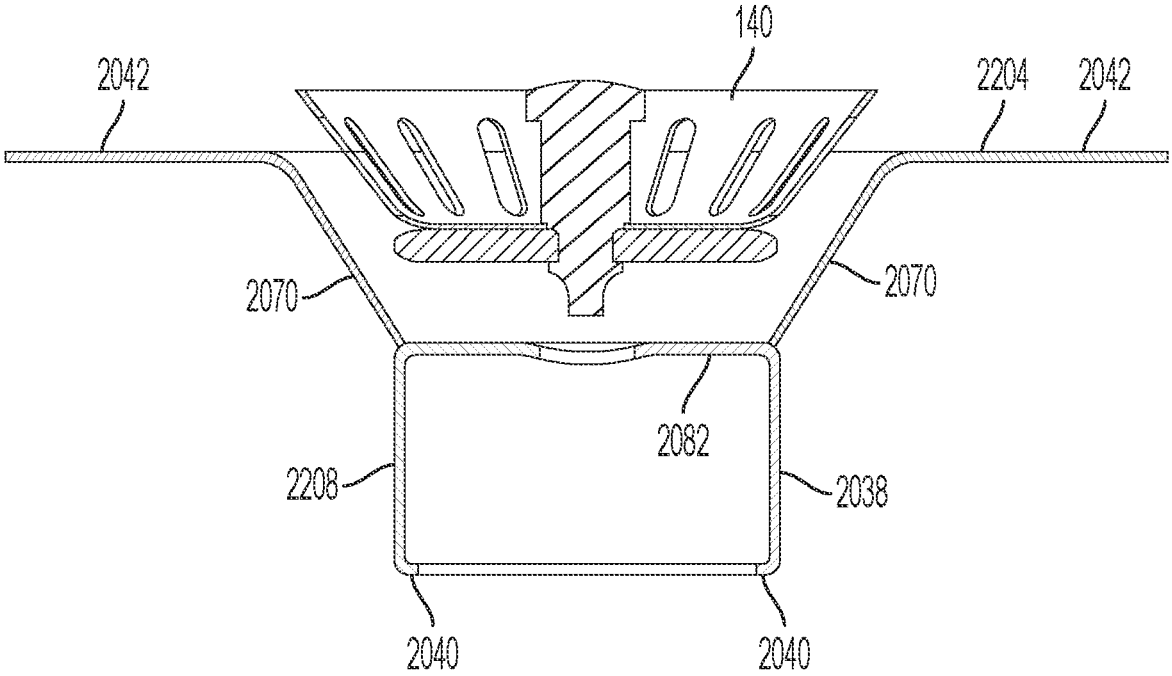
Figure 13C:
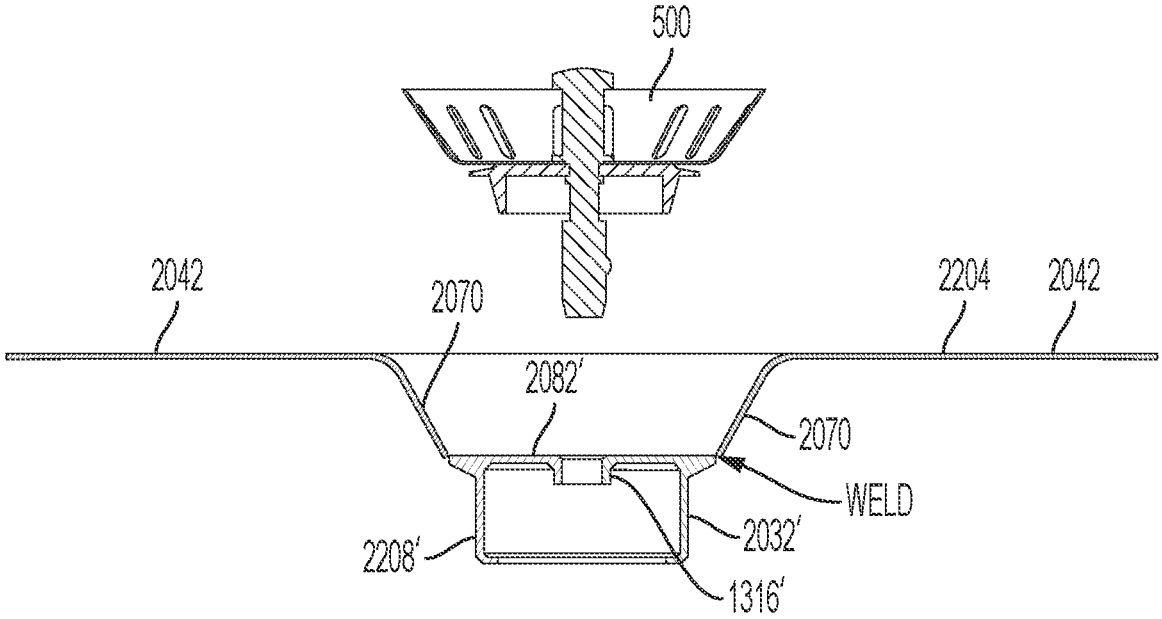

FIGS. 13-13B illustrates other embodiments of the sink 2010 and 2010'. Both embodiments of the sink 2010, 2010' are substantially similar to the sink 1010 so only the differences will be discussed in detail herein. As shown in FIGS. 13, 13A, and 13B, the first piece of sheet material 2204 forms the bowl 2030 (e.g., the side walls 2050 and base wall 2042) and a portion of the cup 2034 (e.g., the side walls 2070) while the second piece of sheet material 2208 forms the strainer 2082 (e.g., the floor 1066 of the cup 1034) and the adapter 2038 as a single piece.

As described above, the two pieces of materials 2204, 2208 are formed separately (e.g., via various pressing, forming, and punching actions) and then joined together (e.g., welded, brazed, soldered, crimped, pressed, threaded, and the like) to produce a water-tight joint. In instances where welding is used, the weld may be positioned on the outside of the assembly or inside where it is ground smooth.

The resulting structure produces a vessel volume 2018 where the surfaces of the strainer 1082 and adapter 38 may have different properties than the interior surfaces 2156 of the rest of the vessel volume 2018. For example, the strainer 2082 and adapter 38 may have hygienic properties while the interior surfaces 1156 of the rest of the vessel volume 1018 may not.

While the adapter 2038 of FIG. 13 has a substantially open bottom, it is understood that the adapter 2038 may also include a sealing flange 2040 positioned opposite the strainer 1082 and configured to interact with a gasket 154) and form a seal therewith (see FIG. 13A, 13B).

Figure 13D:
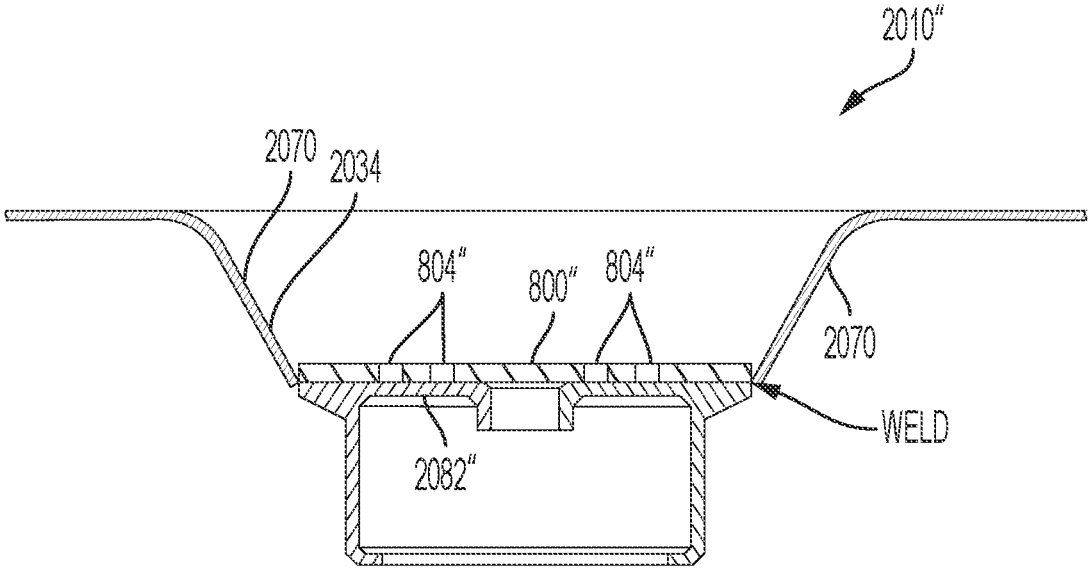
Figure 13E:
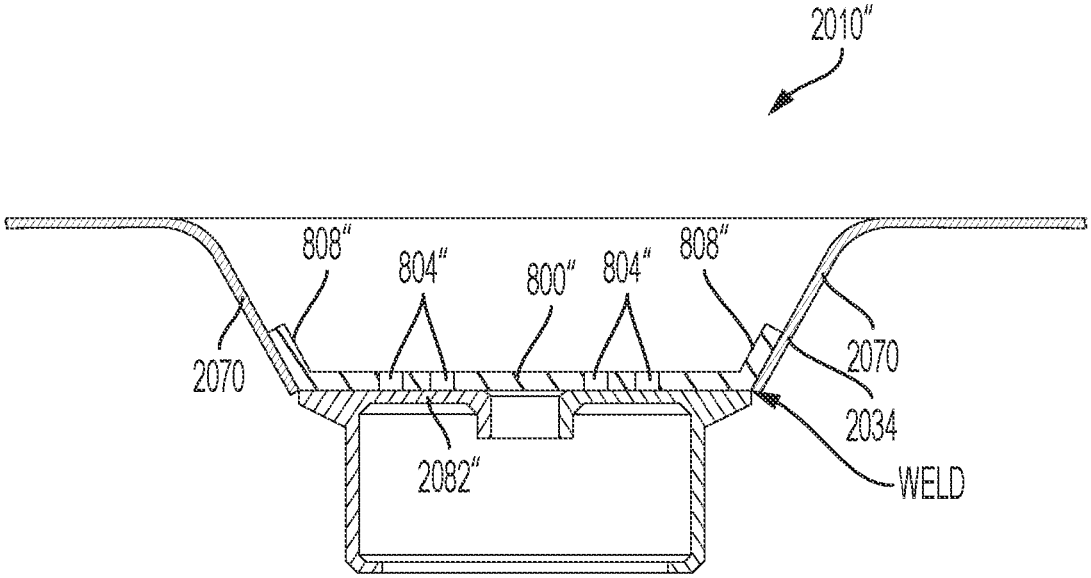
Figure 13F:
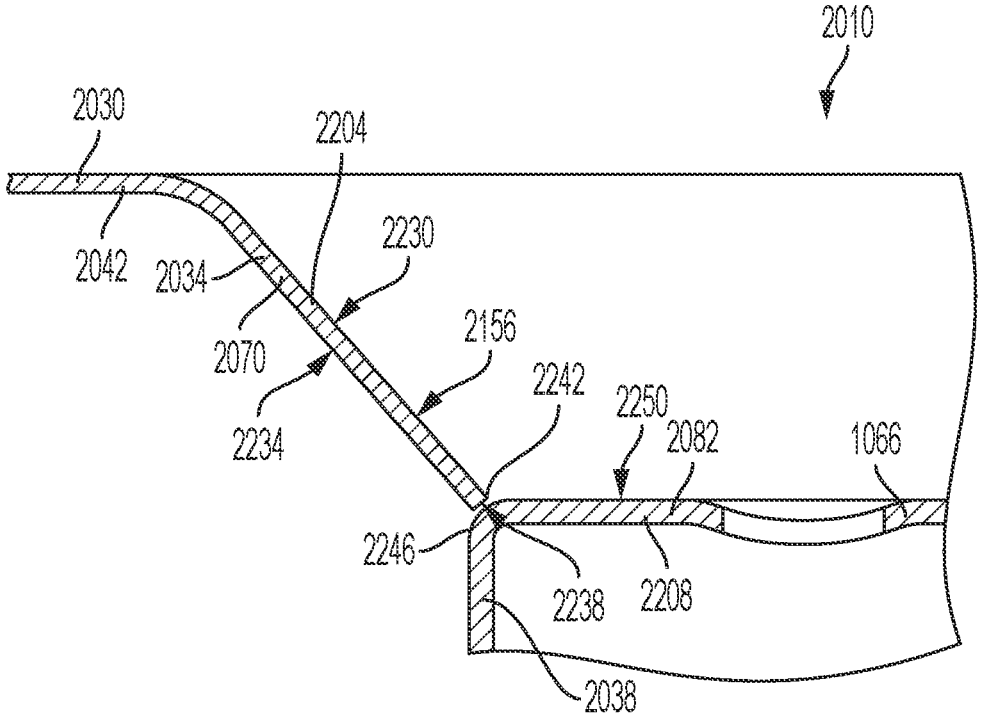
Figure 13G:
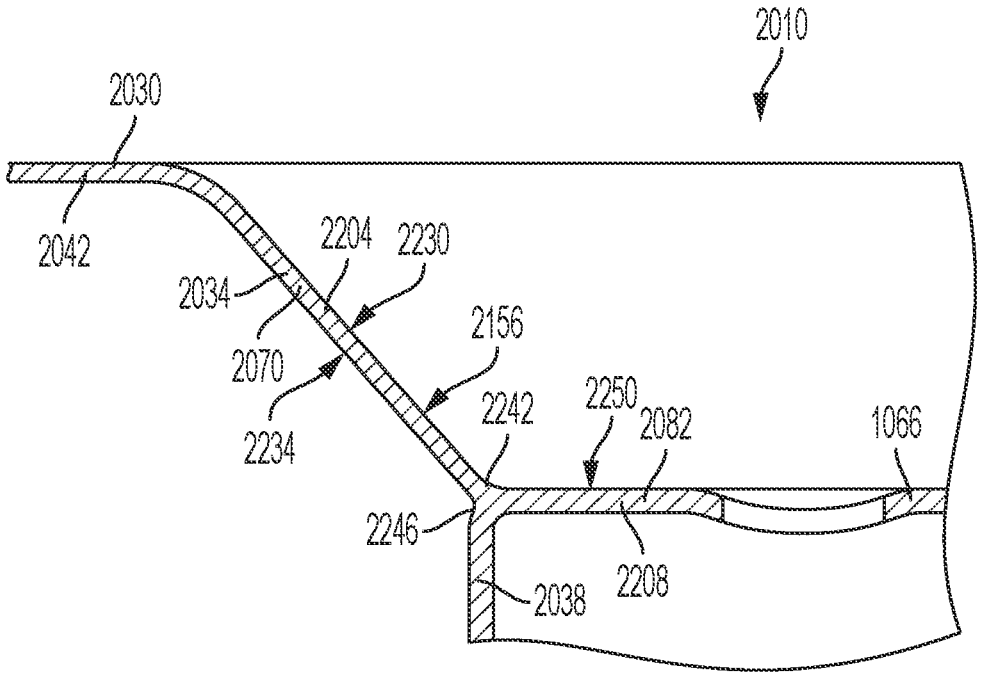

As shown in FIG. 13A, 13F-13G, the interface between the strainer plate 2082 and the adapter 2038 forms an edge 2246. In the illustrated embodiment, the edge 2246 extends in a substantially circular shape along the entire exterior of the strainer plate 2082. While the illustrated embodiment shows the edge 2246 having a radiused shape, in other embodiments the edge 2246 may be sharp or be chamfered. As shown in FIG. 13F, the strainer plate 2082 includes an upstream surface 2250 that at least partially produces a portion of the interior surface 2156 of the vessel volume 2018.

Furthermore, the side wall 2070 of the cup 2034 of the first piece of sheet material 2204 extends from the base wall 2042 to produce an inner surface 2230, an outer surface 2234, and an end surface 2238 at a distal edge 2242 thereof. As shown in FIG. 13F, the inner surface 2230 of the side wall 2070 at least partially produces a portion of the interior surface 2156 of the vessel volume 2018.

As described above, the two pieces of materials 2204, 2208 are formed separately (e.g., via various pressing, forming, and punching actions) and then fused together (e.g., welded, brazed, soldered, and the like). To fuse the first piece of sheet material 2204 to the second piece of sheet material 2208, the end surface 2238 of the side wall 2070 is placed opposite the edge 2246 so that the end surface 2238 is immediately adjacent and facing the edge 2246 (see FIG. 13F), producing a tee joint orientation. The two pieces of material 2204, 2208 are then fused by welding, soldering, brazing and the like so that the interior surface 2230 of the side wall 2070 becomes continuous with the upstream surface 2250 of the strainer plate 2082 (see FIG. 13G). More specifically, the fusing process causes the two surfaces to blend together so that no gaps or grooves exist therebetween. In some embodiments, the fused joint between the two pieces may also be polished or ground so that the joint is no longer visible. In instances where welding is used, he weld may be applied on the outside of the joint between the first piece 2204 and the second piece 2208 or on the inside so long as the surfaces are made continuous.

As shown in FIG. 13C, the second piece of material 2208' may be a casting forming both the strainer 2082' and the adapter 2032'. In such embodiments, the casting body may have increased or varying wall thickness and strength over a similarly formed sheet materials. The casting also allows additional elements, like the strainer boss 1316', internal re-enforcing elements, and the like, to be formed as a single piece. As shown in FIG. 13C, the casting 2208' may also be fused (e.g., welded, brazed, and the like) to the first piece of material 2204'. The casting 2208' may be formed from or be treated to have hygienic properties.

FIGS. 13D and 13E illustrate another embodiment of the sink 2010". The sink 2010" is substantially similar to the sink 2010' and therefore only the difference will be described herein. The sink 2010" includes a strainer insert 800" defining a plurality of apertures 804" therein and configured to be positioned atop the strainer 2082". The strainer insert 800" is substantially sized such that is corresponds with the exterior of the strainer 2082" of the casting element (see FIG. 13D). In other embodiments, the strainer insert 800" may include a flange 808" extending therefrom that extends beyond the strainer 2082" and substantially corresponding with the side walls 2070 of the cup 2034. In some embodiments, the insert 800" and strainer 2082" may have similar aperture patterns formed therein to strain the fluids as they pass therethrough. However, in alternative embodiments, the strainer insert 800" may define an aperture pattern for straining fluids while the strainer 2082" itself may only include sufficient cross members to support the inert 800". In such embodiments, only the insert 800" would be configured to provide straining capabilities. Still further, the strainer 800" may be formed from material having hygienic properties, or be coated to have hygienic properties.

Figure 14:
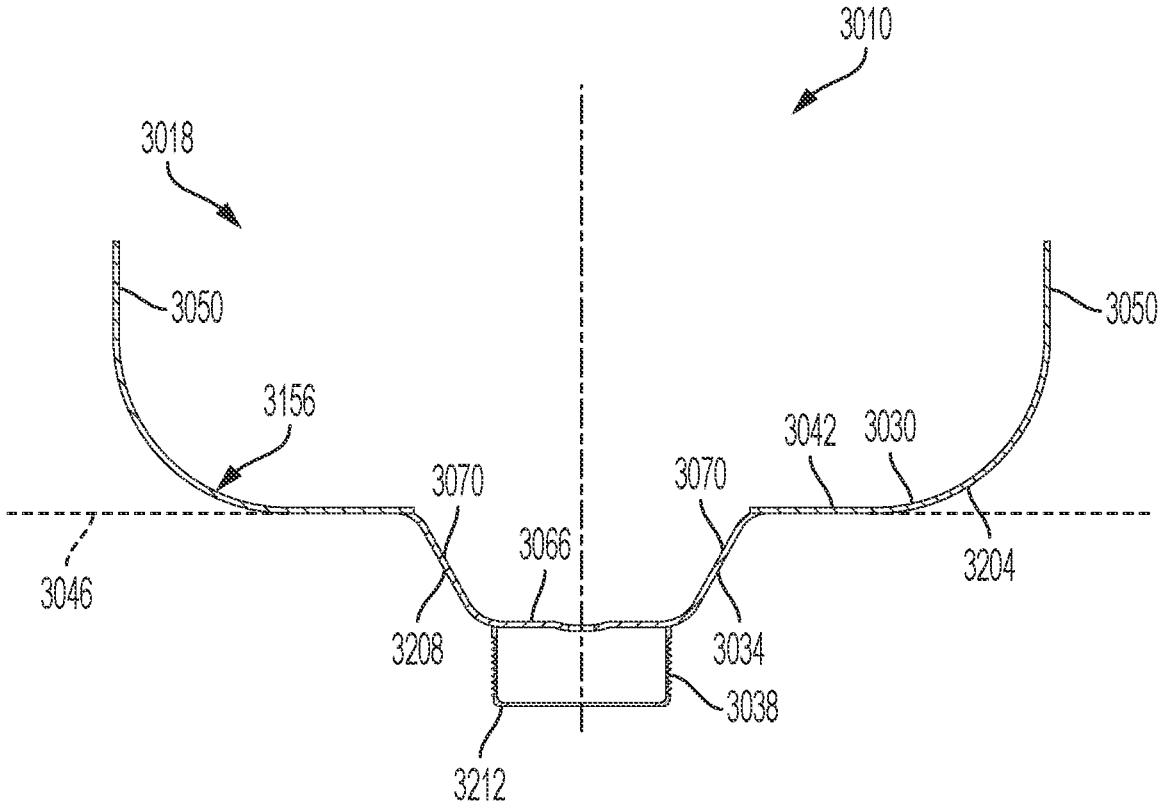
Figure 14A:
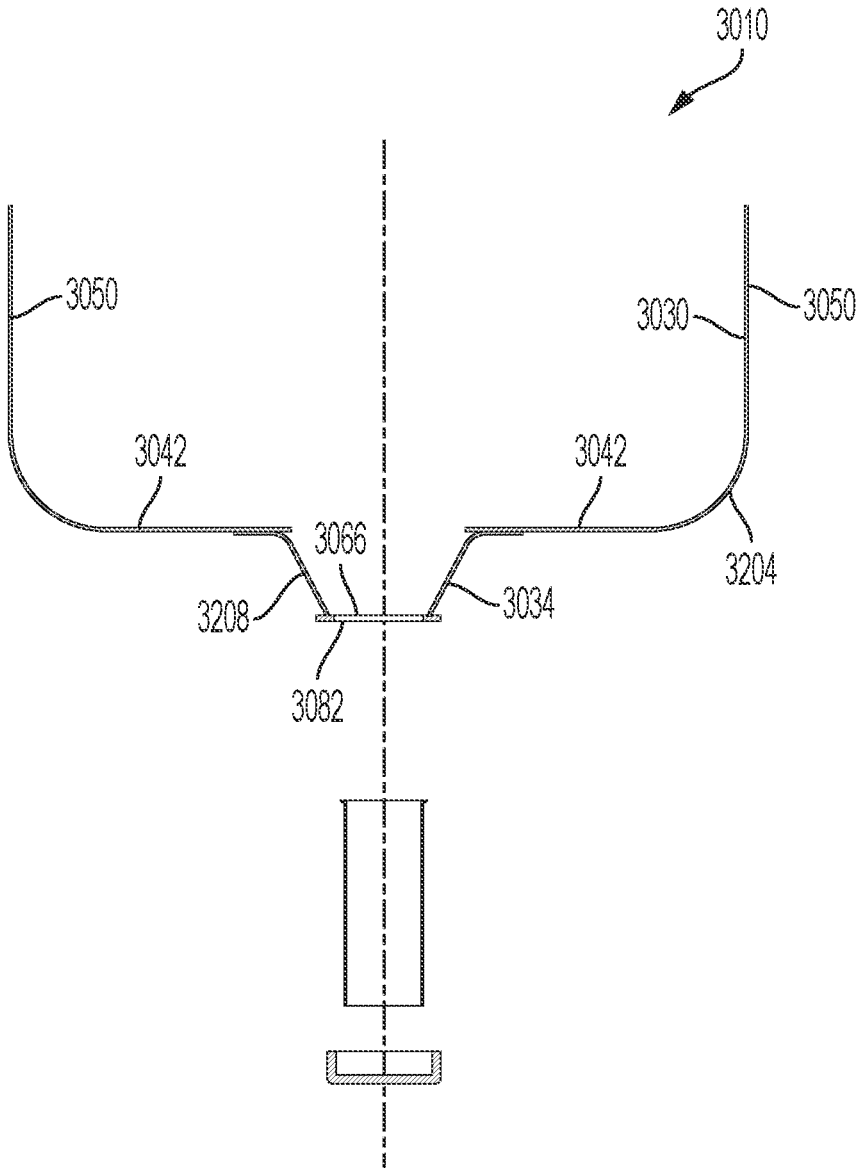

FIGS. 14 and 14A illustrate another embodiment of the sink 3010. The sink 3010 is substantially similar to the sink 1010 so only the differences will be discussed in detail herein. As shown in FIG. 14, the first piece of sheet material 3204 forms the bowl 2030 (e.g., the side walls 3050 and base wall 3042) while the cup 3034 is formed from the second piece of sheet material 3208 (e.g., the side walls 3070 and floor 3066). In such an embodiment, the adapter 3038 is formed from a third piece of sheet material 3212. As described above, the two pieces of material 3204, 3208 are formed separately (e.g., via various pressing, forming, and punching actions) and then joined (e.g., welded, brazed, soldered, and the like) together to form a water-tight joint. FIG. 14 illustrates the sink 3010 using a butt weld while FIG. 14A illustrates a lap weld connection. The resulting structure produces a vessel volume 3018 where the interior surfaces of the cup 3034 have hygienic properties while the interior surfaces of the bowl 3030 do not. The adapter 3038 is attached separately as described above.

Figure 14B:
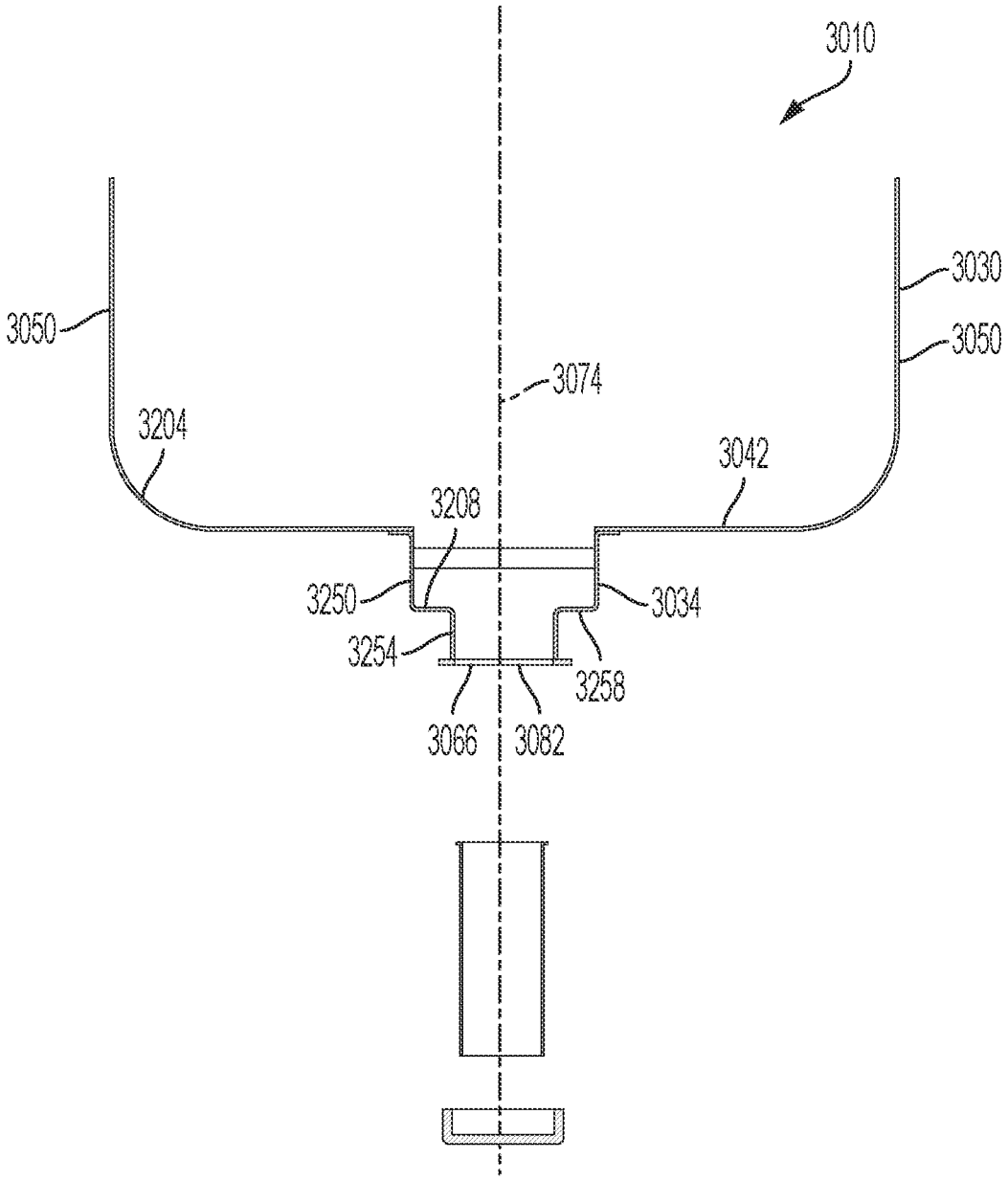

While the cup 3034 of the sink 3010 may have a substantially frusto-conical shape in other embodiments other shapes may be used. For example, FIG. 14B illustrates the cup 3034 with a "stepped" cross-sectional shape. The stepped shape includes a first cylindrical portion 3250 having a first diameter and a second cylindrical portion 3254 having a second diameter less than the first diameter. The two portions 3250, 3254 are interconnected by an intermediate wall 3258 extending therebetween. The intermediate wall 3258 may be perpendicular to the cup axis 3074 or oblique to the axis 3074.

Figure 15:
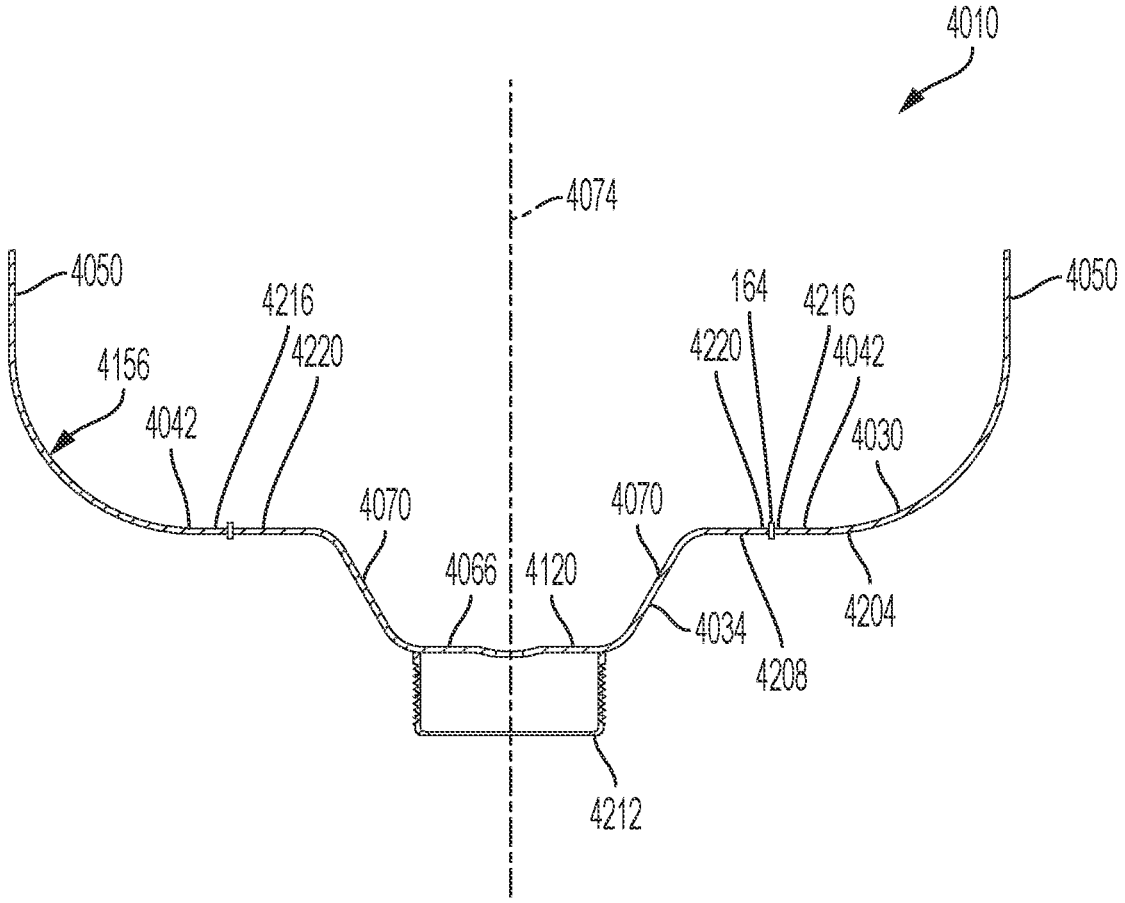

FIG. 15 illustrate another embodiment of the sink 4010. The sink 4010 is substantially similar to the sink 1010 so only the differences will be discussed in detail herein. As shown in FIG. 15, the first piece of sheet material 4204 forms a portion of the bowl 4030 (e.g., the side walls 4050 and a portion of the base wall 4042 while the second piece of sheet material 4208 forms the remainder of the base wall 4042 and the cup 4034 (e.g., the side walls 4070 and the floor 4066).

To manufacture the sink 4010, the first piece of sheet material 4204 undergoes one or more forming processes (e.g., stamping and the like) to produce the desired shape of the side walls 4050 and portion of the base wall 4042. The resulting piece then undergoes a second processes whereby an inner aperture 4216 is formed (e.g., cut) into the base wall 4042.

With the first piece of material 4204 formed, the second piece of material 4208 undergoes one or more forming processes (e.g., stamping, shaping, trimming, and the like) to produce the desired shape of the side walls 4070, floor 4066, strainer apertures 4120, and base wall 4042. The resulting structure also includes an outer periphery 4220 that substantially corresponds with the size and shape of the inner aperture 4216 of the first piece of sheet material 3204.

With the two pieces formed, the inner aperture 4216 of the first sheet 4204 is aligned with the outer periphery 4220 of the second sheet 4208 and joined (e.g., welded) together to form a water-tight joint. The resulting combined structure results in a bowl 4030 where the side walls 4050 and outer portions of the base wall 4042 do not have hygienic properties while the cup 4034 and the portions of the base wall 4042 immediately adjacent the cup 4034 do have hygienic properties.

In the illustrate embodiment, the outer periphery 4220 of the second piece of sheet material 4208 forms a circular shape centered on the cup axis 4074 of the resulting cup 4034. As such, the cup 4034 and an annular portion of the base wall 4042 immediately adjacent the cup 4034 are all formed of the second material 4208 and have hygienic properties. In some embodiments, the periphery 4220 forms a diameter between 2" and 5". In still other embodiments, the second piece of sheet material 4208 may include a different coating than the first piece of sheet material 4204. In such embodiments, the coating may have hygienic properties.

Figure 16:
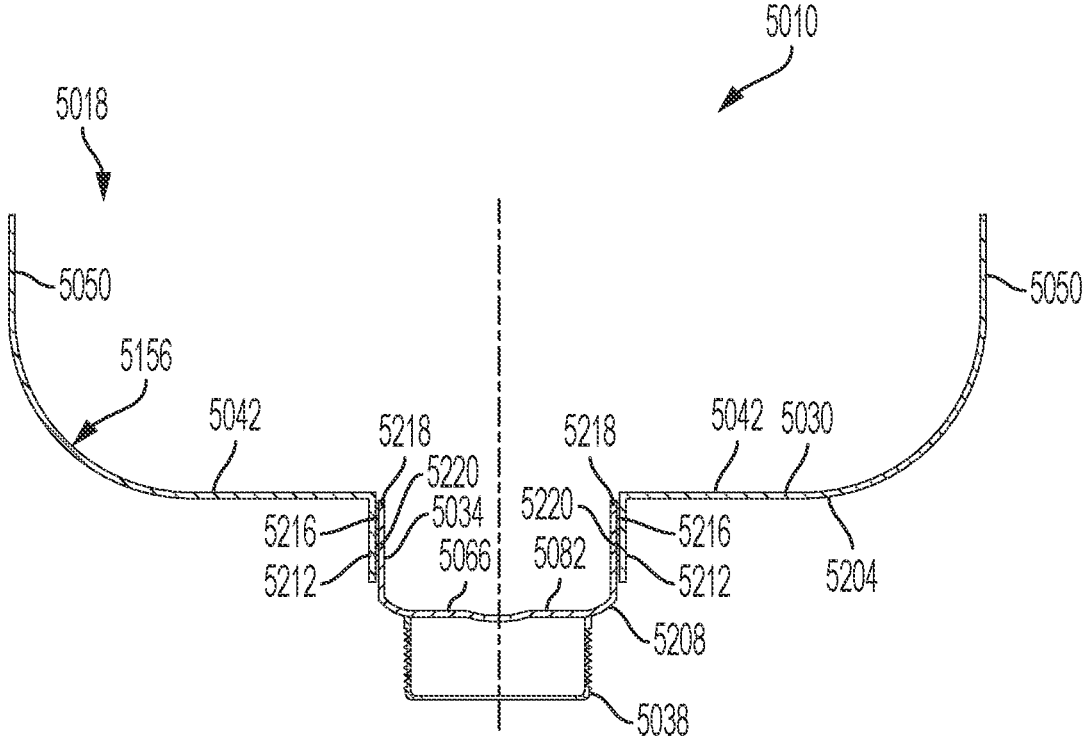

FIG. 16 illustrates another embodiment of the sink 5010. The sink 5010 is substantially similar to the sink 1010 so only the differences will be discussed herein. As shown in FIG. 16, the first piece of sheet material 5204 forms the bowl 5030 (e.g., the side walls 5050 and base wall 5042) and a threaded flange 5212 extending from the bowl 5030. Furthermore, the second piece of sheet material 5208 forms an embodiment of the cup 5034 having a floor 5066 forming a strainer 5082, as discussed above, and a threaded side wall

5218 extending therefrom. More specifically, the bowl 5030 includes a threaded flange 5212 extending from the base wall 5042 and below the base plane 5046 that includes a set of internal threads 5216. In turn, the cup 5034 includes a floor 5066, as discussed above, with one or more threaded side walls 5218 extending therefrom. As shown in FIG. 16, the side walls 5218 have external threads 5220 substantially corresponding with the internal threads 5216 of the threaded flange 5212.

The two pieces of material 5204, 5208 are formed separately (e.g., via various pressing, forming, and punching actions). Once formed, the separately formed cup 5034 is threaded into the threaded flange 5212 of the bowl 5030 to complete the vessel volume 5018. The resulting structure produces a vessel volume 2018 where the interior surfaces of the cup 5034 (e.g., the floor 5066 and threaded side wall 5218) have hygienic properties while the interior surfaces of the bowl 3030 (e.g., the side wall 5050 and base wall 5042) do not. The connection between the cup 5034 and flange 5212 is water-tight and may be produced by any one of interaction between contacting faces, the use of seals or gaskets (not shown), and the like. The adapter 3038 is attached separately as described above.

Figure 17:
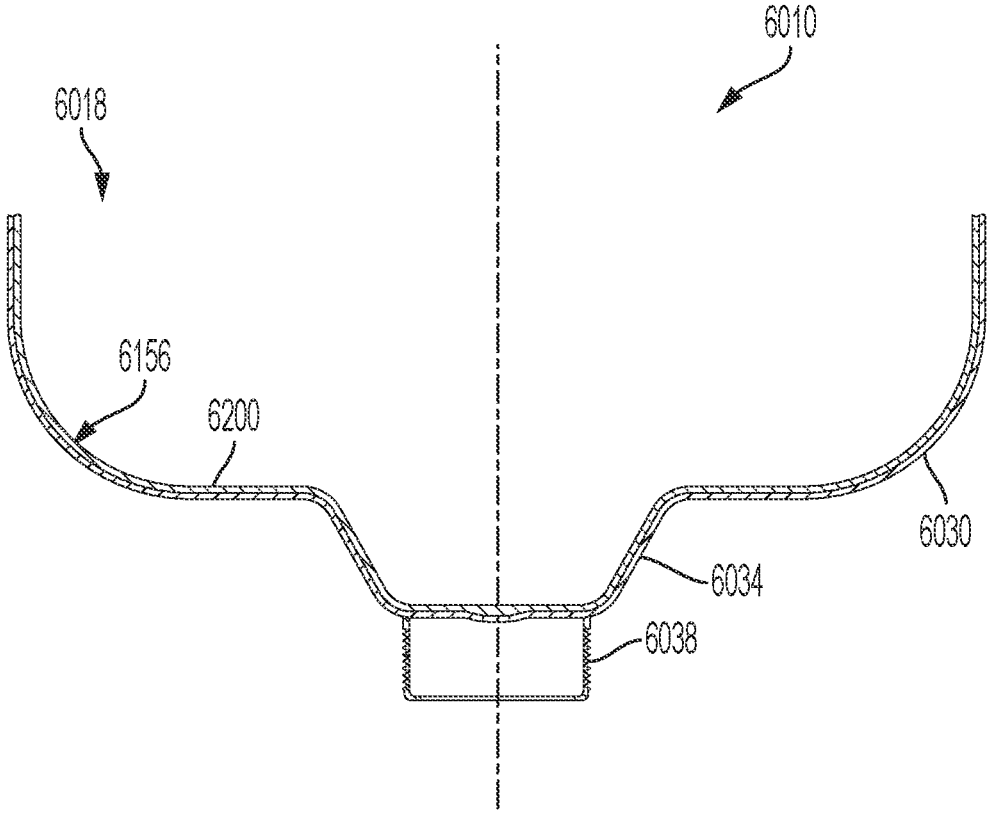

FIG. 17 illustrates another embodiment of the sink 6010. The sink 6010 is substantially similar to the sink 10 and therefore only the differences will be discussed in detail herein. As shown in FIG. 16, the sink 6010 includes a liner 6200 positioned within the vessel volume 6018. More specifically, the liner 6200 is formed from a material having hygienic properties while the underlying bowl 6030 is formed from a different material that does not have hygienic properties. As such, the resulting interior surface 6156 of the vessel volume 6018 is provided by the liner 6200 allowing the vessel volume 6018 to have hygienic properties. In such embodiments, the liner 6200 may be coupled to the underlying bowl 6030 by welding, mechanical fasteners, and the like. In alternative embodiments, the liner 6200 may only correspond with a portion of the vessel volume 6018. For example, the liner 6200 may include a disk positioned only above the strainer of the sink 6010. In still other embodiments, the liner 6200 may be only cover the cup of the sink 6010.

While the illustrated sink 6010 is formed from a single piece of material, the liner 6200 may also be attached to sinks with portions formed from two or more pieces of material (e.g., the cup, strainer, and the like). In still other embodiments, the sink 6010 may include an interior coating in place of the liner 6200. In such embodiments, all or a portion of the interior surface of the vessel volume 6018 may be coated. The coating may have hygienic properties.

Figure 17A:
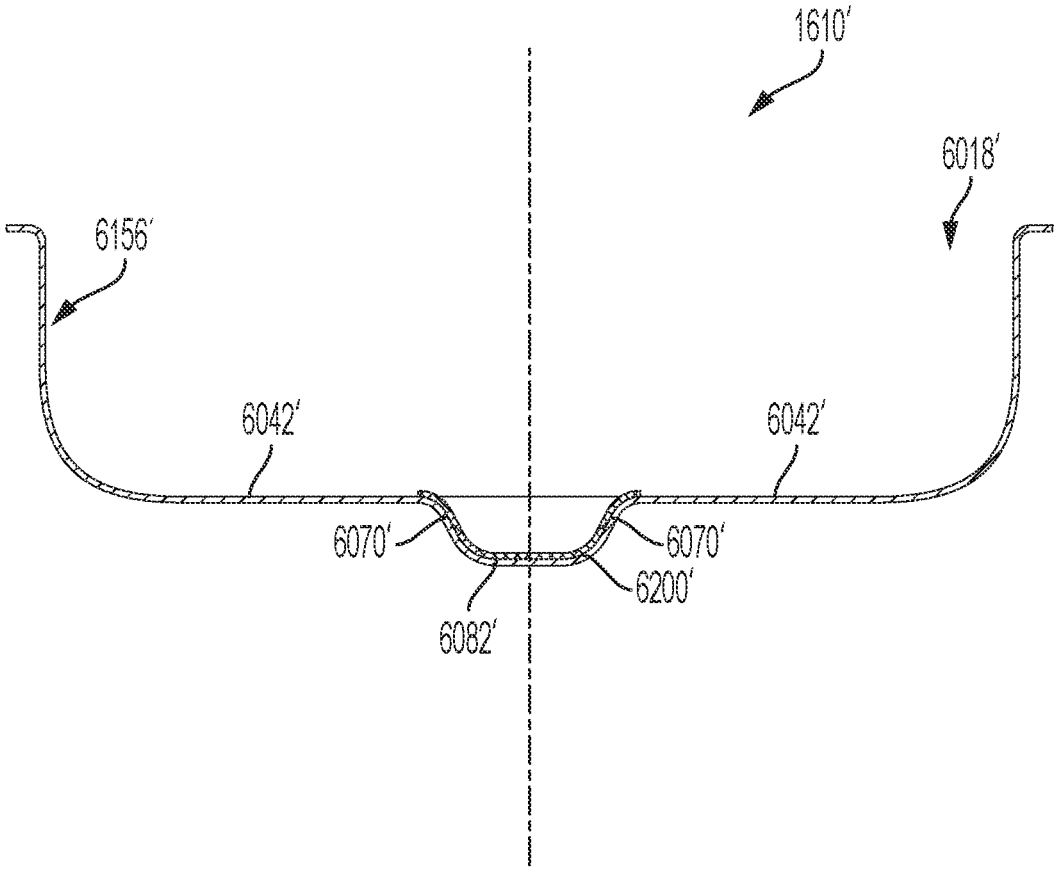

FIG. 17A illustrates a sink 6010' where only a portion of the interior surface 6156' of the vessel volume 6018' is covered by the liner 6200'. More specifically only the side walls 6070' and strainer 6082' of the cup 6034' are covered by the liner 6200'. However, in alternative embodiments, other portions of the vessel volume 6018' may be covered. In still other embodiments, multiple individual areas may be covered by multiple, separate liners.

Figure 18:
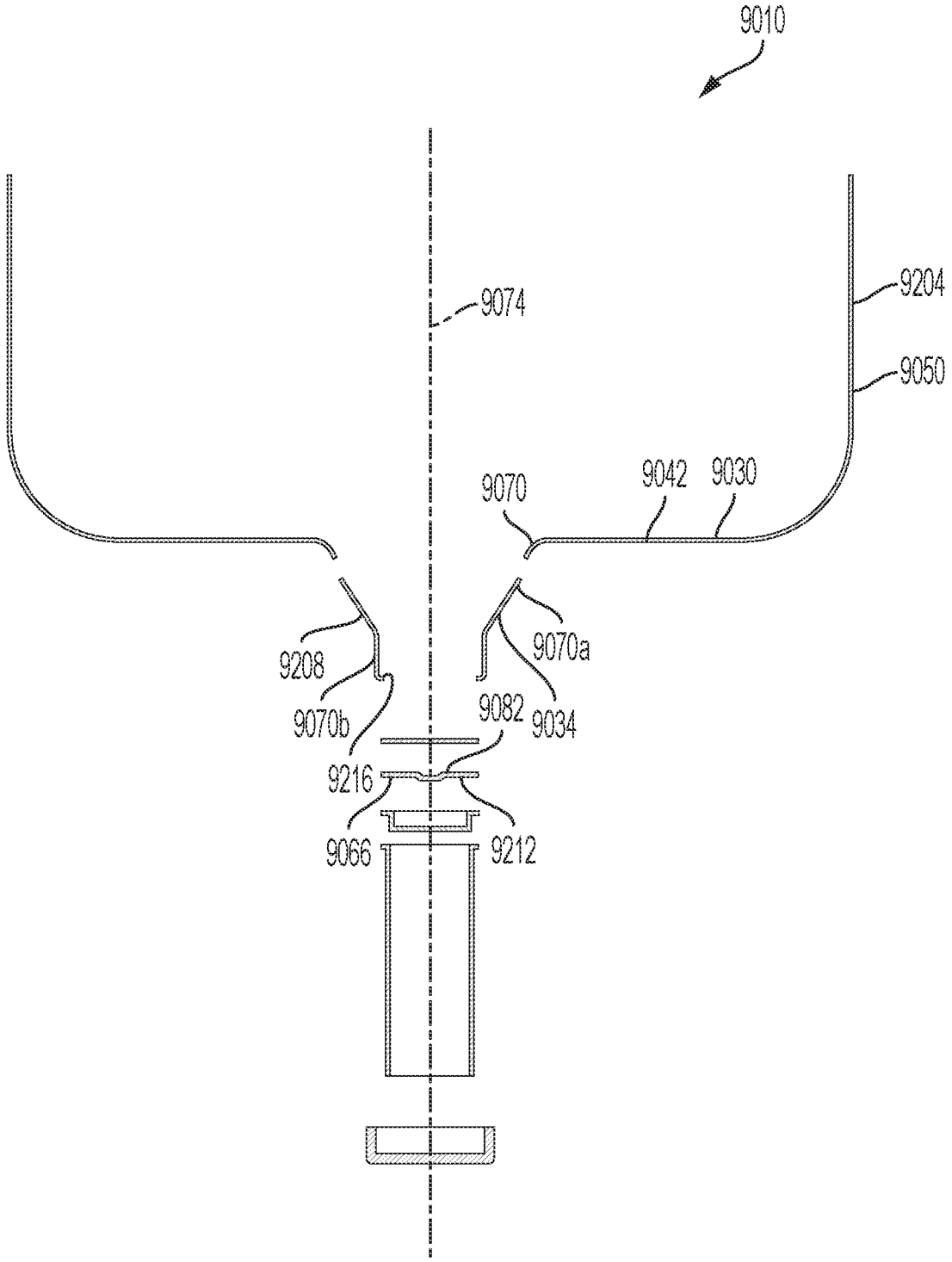

FIG. 18 illustrates another embodiment of the sink 9010. The sink 9010 is substantially similar to the sink 1010 so only the differences will be discussed in detail herein. As shown in FIG. 18, the first piece of sheet material 9204 forms the bowl 9030 (e.g., the side walls 9050 and the base wall 9042) and a portion of the cup 9034 (e.g., a portion of the side wall 9070). The second piece of sheet material 9208 forms a portion of the side wall 9070 of the cup 9034 and a bottom lip 9216. Finally, a third piece of sheet material 9212 forms the strainer 9082. In the illustrated embodiment, the first material 9204 does not have hygienic properties while both the second and third materials 9208, 9212 do have hygienic properties. However, in alternative embodiments just the third material 9212 may have hygienic properties.

Figure 18A:
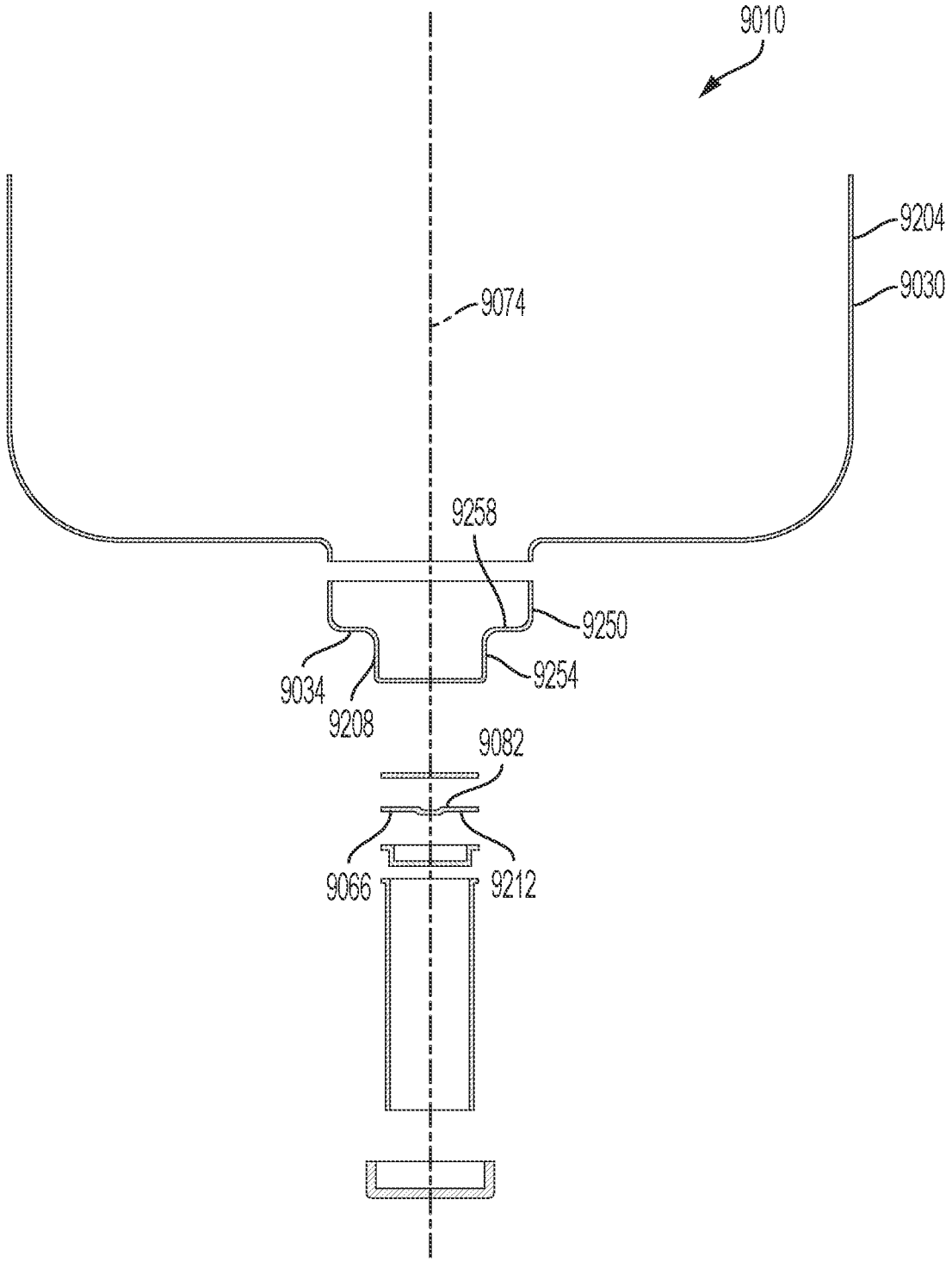

As shown in FIG. 18, the cup 9034 has a "funnel" cross-sectional shape including a first wall portion 9070*a* that is oriented oblique to the cup axis 9074, and a second wall portion 9070*b* that is oriented substantially parallel to the cup axis 9074. In still other embodiments, the cup 9034 of the sink 9010 may have a substantially frusto-conical shape (e.g., see sink 9010, above) or other cross-sectional shapes. For example, FIG. 18A illustrates the cup 9034 with a "stepped" cross-sectional shape. The stepped shape includes a first cylindrical portion 9250 having a first diameter and a second cylindrical portion 9254 having a second diameter less than the first diameter. The two portions 9250, 9254 are interconnected by an intermediate wall 9258 extending therebetween. The intermediate wall 9258 may be perpendicular to the cup axis 9074 or oblique to the axis 9074.

As described above, the three pieces of material 9204, 9208, 9212 are formed separately (e.g., via various pressing, forming, and punching actions) and then joined together (e.g., via welding, brazing soldering and the like) to form water-tight joints. More specifically, the second piece of sheet material 9208 is joined to the first piece of sheet material 9204 via a lap or butt joint. The strainer 9082 is then placed in the cup 9034 such that it is at least partially supported and located by the bottom lip 9216 of the second piece of sheet material 9204. With the strainer 9082 in place, the strainer 9082 may then be joined to the second piece of sheet material 9208.

Figure 19:
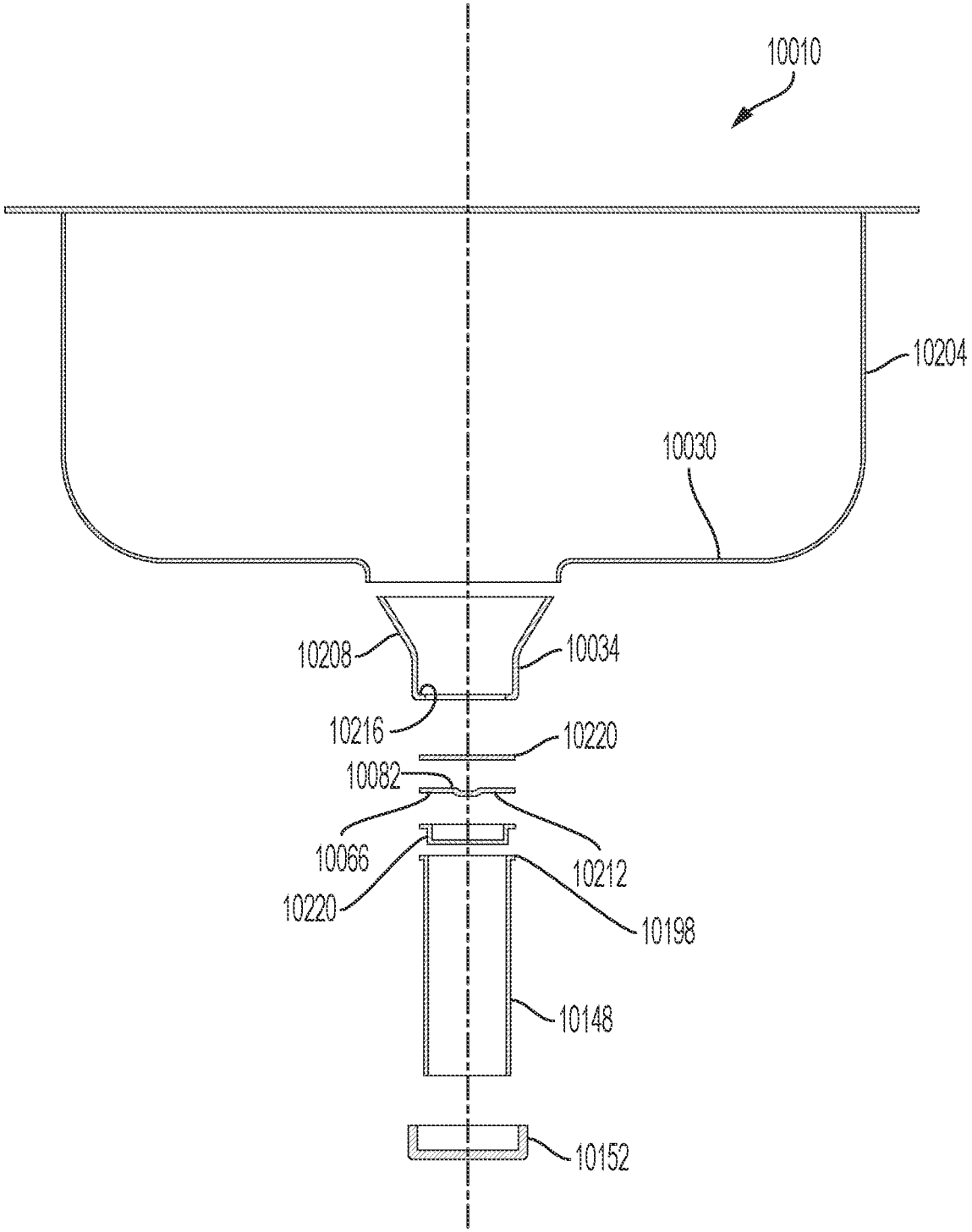

FIG. 19 illustrates another embodiment of the sink 10010. The sink 10010 is substantially similar to the sink 9010 so only the differences will be discussed herein. To assembly the sink 10010 the second piece of sheet material 10208 is joined (e.g., welded brazed soldered, and the like) to the first piece of sheet material 10204 as discussed above. The strainer 10082 is mechanically coupled to the second piece of sheet material 10208 by securing the strainer 10082 between the bottom lip 10216 of the cup 10034 and the flange 10198 of the tail pipe 10148. The resulting assembly is then secured by the coupling nut 10152. As shown, one or more gaskets 10220 may be present to provide a seal between the elements and ensure a water-tight fit. By having a mechanically combined assembly, the strainer 10082 can be swapped out or changed as necessary when things become clogged or to change the type and size of openings therein.

While not shown, it is understood that the various embodiments of the sink described herein may employ gaskets or sealants at any resulting joints to help seal the surface from leaks. In such embodiments, the baskets or sealants may also be formed from materials having hygienic properties.

FIGS. 20A-20J illustrates another embodiment of the sink 11010 where the vessel volume 11018 is formed from multiple pieces of sheet material. The sink 11010 is substantially similar to the sink 1010 so only the differences will be discussed herein. The sink 11010 includes a first piece of sheet material 11204 forming the bowl 11030 (e.g., the side walls 11050 and base wall 11042), a portion of the cup 11034 (e.g., the side walls 11070), and a bottom lip 11500. The sink 11010 also includes a second piece of sheet material 11208 forming the strainer 11082 (e.g., the floor 11066 of the cup 11034). In such embodiments, the adapter 11038 is formed from a third piece of material 11212. In the illustrated embodiment, the first, second, and third pieces of sheet material 11204, 11208, 11212 may all have different material properties or combinations of properties. More specifically, the second piece of sheet material 11208 (e.g., the strainer 11082) may be formed from material having hygienic properties while the first and third pieces of material 11204, 11212 may be formed from materials that do not have hygienic properties. However, in other embodiments, all three may have hygienic properties. In still other embodiments, any sub-combination of the materials may be used.

The bottom lip 11500 of the sink 11010 includes an edge extending radially inwardly from the sidewalls 11070 of the cup 11034. In the illustrated embodiment, the bottom lip 11500 includes a radiused edge formed radially inwardly along the entire inner circumference of the cup 11034 to form a central aperture 11510. In alternative embodiments, the lip 11500 may only extend along a portion of the inner circumference forming tabs and the like. Furthermore, while the illustrated lip 11500 defines an inner diameter that substantially corresponds with the outer diameter of the strainer 11082, in alternative embodiments the lip 11500 may extend radially inward beyond the outer diameter of the strainer 11082 so that the two items overlap and form an annular contact surface.

To manufacture the sink 11010, the user first forms the first piece of sheet material 11204 into the desired shape using one or more stamping, forming, and/or punching processes. To form the first piece of sheet material 11204, the sheet 11204 undergoes a multi-step stamping process. First, the raw stock sheet material 11204 (e.g., stainless steel, CuVerro, and the like) is placed in and secured relative to a press. (See FIG. 20B). The stock sheet material then undergoes a first pressing action whereby the bowl 11030 is formed (e.g., the side walls 11050 and base wall 11042). No cup 11034 is present (see FIG. 10C).

With the bowl 11030 formed, the sheet 11204 is then re-secured to a press such that a portion of the base wall 11042 is mechanically isolated from the rest of the sink body 11014 forming an isolated zone 11168. (See FIG. 20D). More specifically, a pair of clamps 11172 are clamped down onto the base wall 11042 and against a die 11176 forming the isolated zone 11168 therein. The clamps 11172 are configured such that any forces applied to the material located within the isolated zone 11168 are not transmitted to the material positioned outside the isolated zone 11168. More specifically, the clamping action (e.g., grasping an enclosed perimeter of material in direct contact with the clamps 11172) isolates the forces from inside the isolated zone 11168 with the material located outside the isolated zone 11168. As shown, the clamps 11172 of the illustrated embodiment are substantially annular in shape forming a circular isolated zone 11168 within the base wall 11042 of the sink 10. With the isolated zone 11168 prepared, a punch 11178 then presses the material to form the cup shape (see FIGS. 20E and 20F).

While forming of the bowl 11034, the central aperture 11510 of the cup 11034 may be formed (e.g., punched) during the first stamping process, during the second stamping process, or as a separate process.

With the first sheet 11204 formed, the second piece of sheet material 11208 may be formed into the strainer 11082 using one or more separate stamping, forming, and/or punching processes. More specifically, the second piece of sheet material 11208 undergoes one or more stamping, forming, and/or punching processes whereby the overall contour, shape, and apertures 11120 of the strainer 11082 are formed. (See FIG. 20G)

With the two pieces prepared, the second piece of sheet material 11208 is placed in contact with the bottom lip 11500, whereby the lip 11500 is used to at least partially position and support the strainer 11082 relative to the first piece of sheet material 11204. For example, in the illustrated embodiment the strainer 11082 is placed in contact with the bottom surface 11504 of the lip 11500 so the lip 11500 axially locates the strainer 11082 (e.g., relative to the cup axis 11074). However, in alternative embodiments, the strainer 11082 may be placed on the top surface 11508 of the lip 11500 so that the strainer 11082 is located axially by the lip 11500 and radially by the sidewalls 11070 of the cup 11034. In some embodiments, the lip 11500 may be a continuous annular shape, while in other embodiments the lip 11500 may be multiple individual tabs and the like.

With the strainer 11082 in position, the user may then join the strainer 11082 to the first piece of sheet material 11204 (e.g., by welding, brazing, soldering, and the like; see FIG. 20H) to produce a water-tight joint. When doing so, the welding may occur on the bottom surface 11504 so that strainer 11082 remains flat against the bottom lip 11500 and minimizes any locations for water or debris to collect. The resulting structure could produce a vessel volume 11018 where the surfaces of the strainer 11082 have hygienic properties while the interior surfaces 11156 of the rest of the vessel volume 11018 do not.

With the vessel volume 11018 created, the remainder of the sink 11010 can be manufactured and installed as described above (e.g., the adapter 11038 can be subsequently joined to the underside of the strainer 11082; see FIG. 20I). While the above described assembly process includes fusing the strainer 11082 to the first piece of sheet material 11204 and then fusing the adapter 11038 to the strainer 11082; in alternative embodiments the strainer 11082 and adapter 11038 may first be joined to produce a sub-assembly whereby the subassembly is then fused to the first piece of sheet material 11204 using the bottom lip 11500 for alignment and support as described above.

Figure 20A:
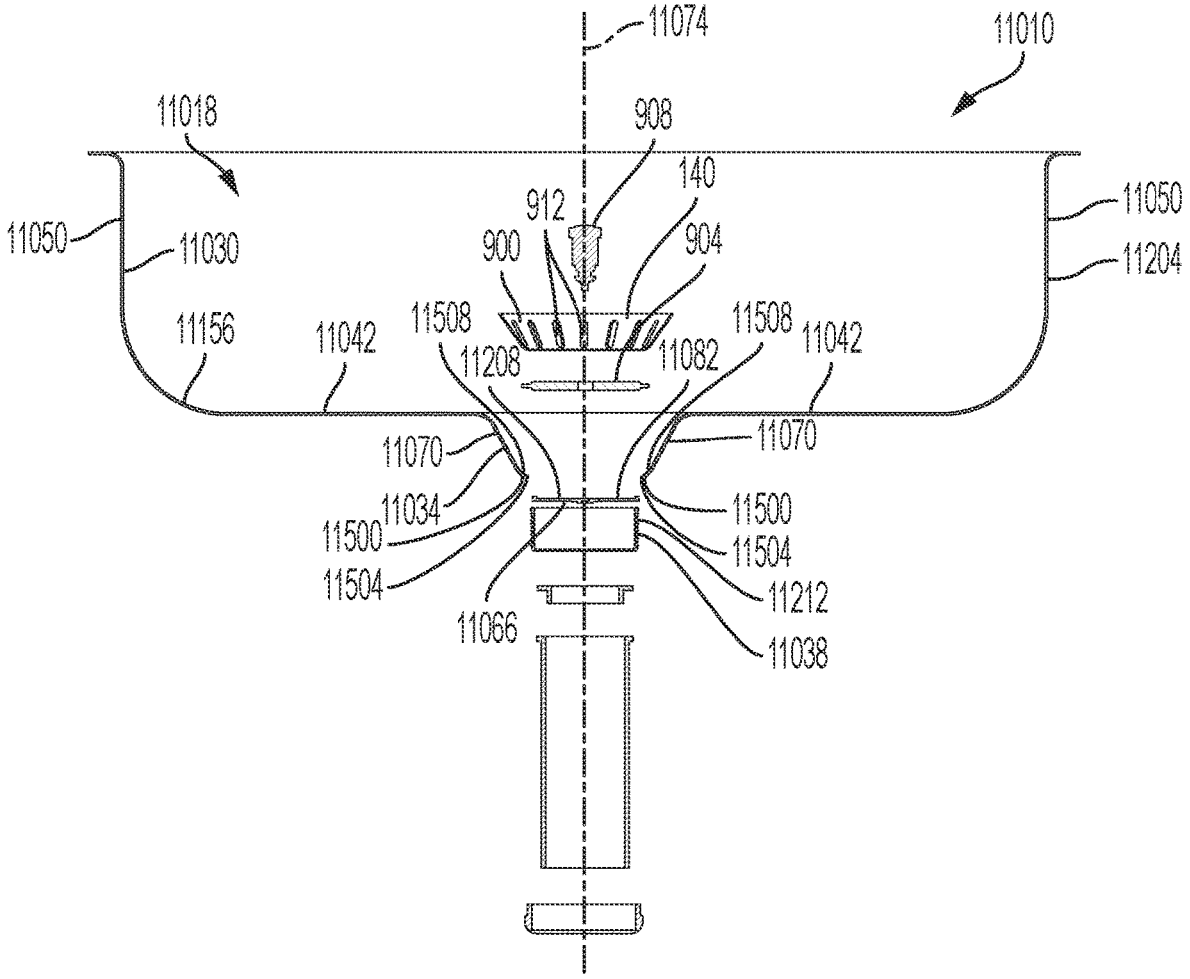
Figure 20B:
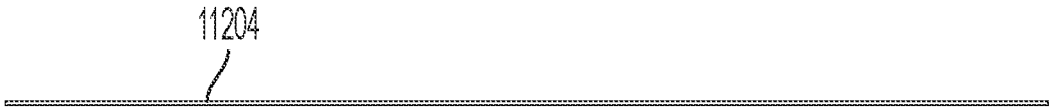
Figure 20C:
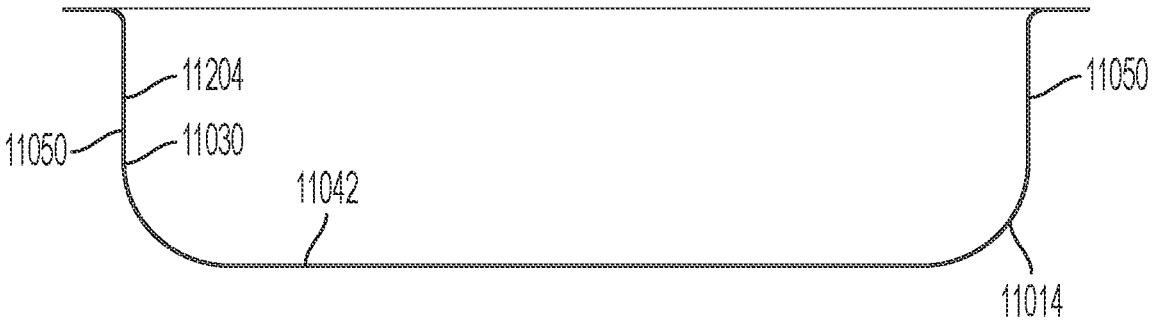
Figure 20D:
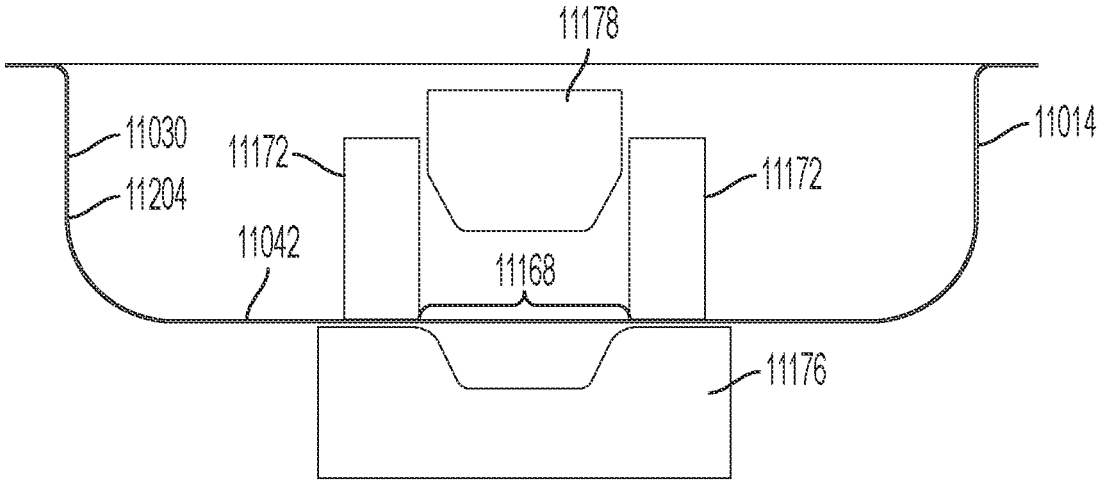
Figure 20E:
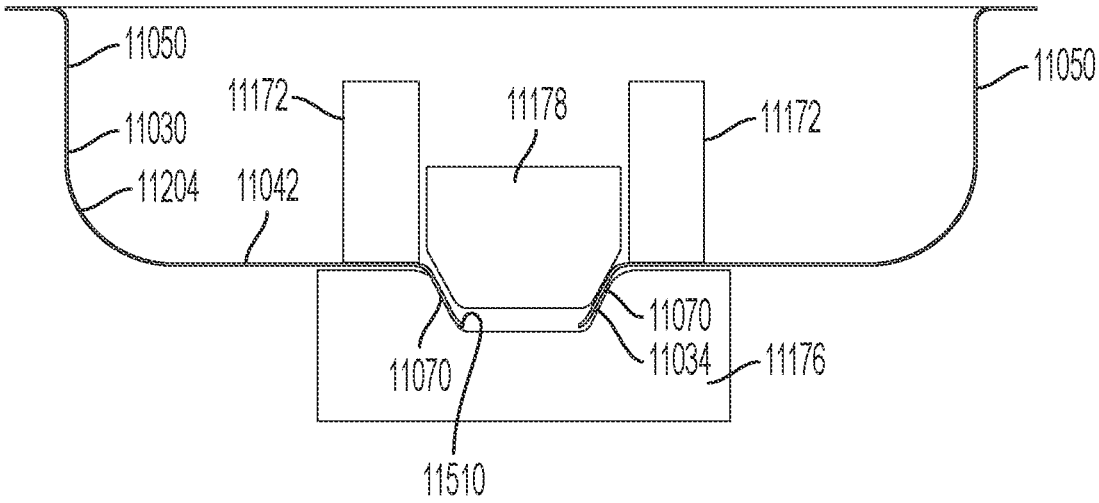
Figure 20F:
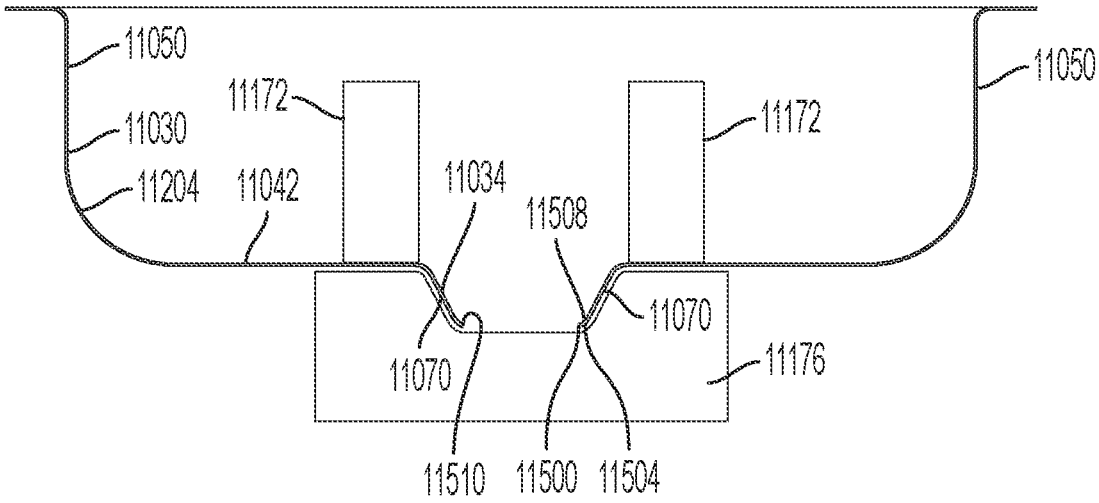
Figure 20G:
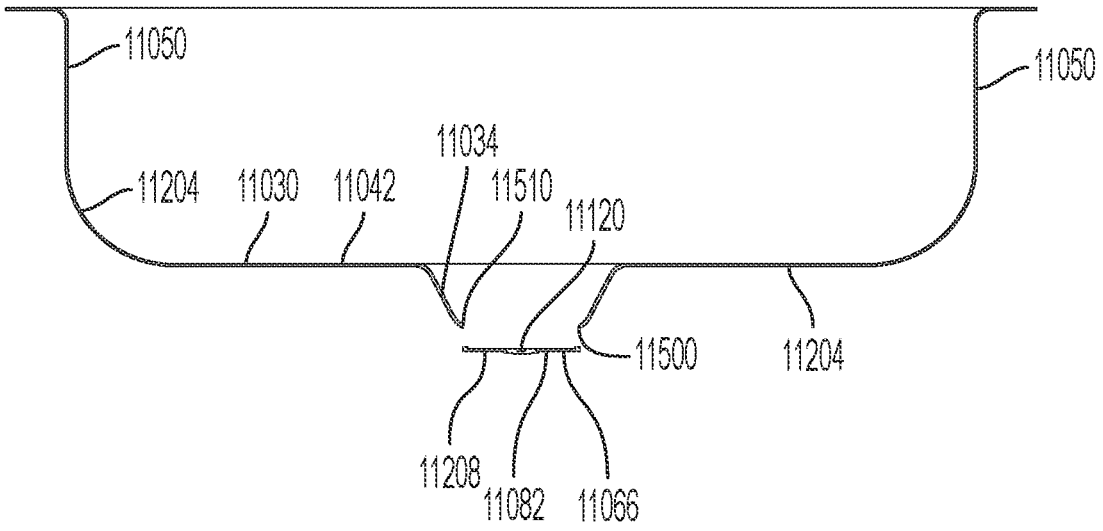
Figure 20H:
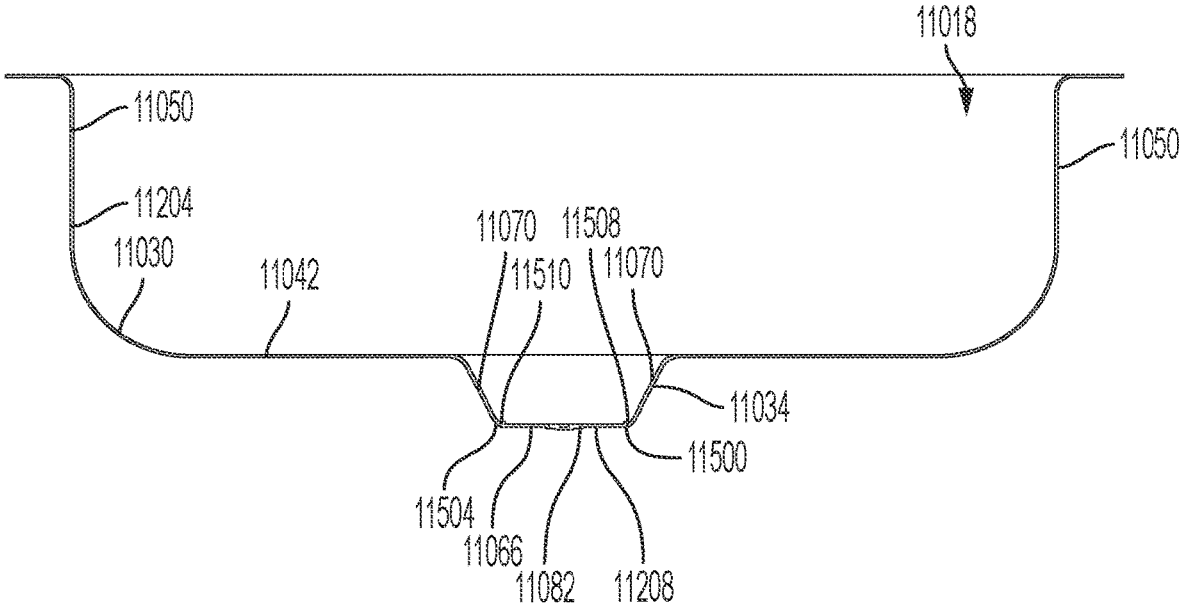
Figure 20I:
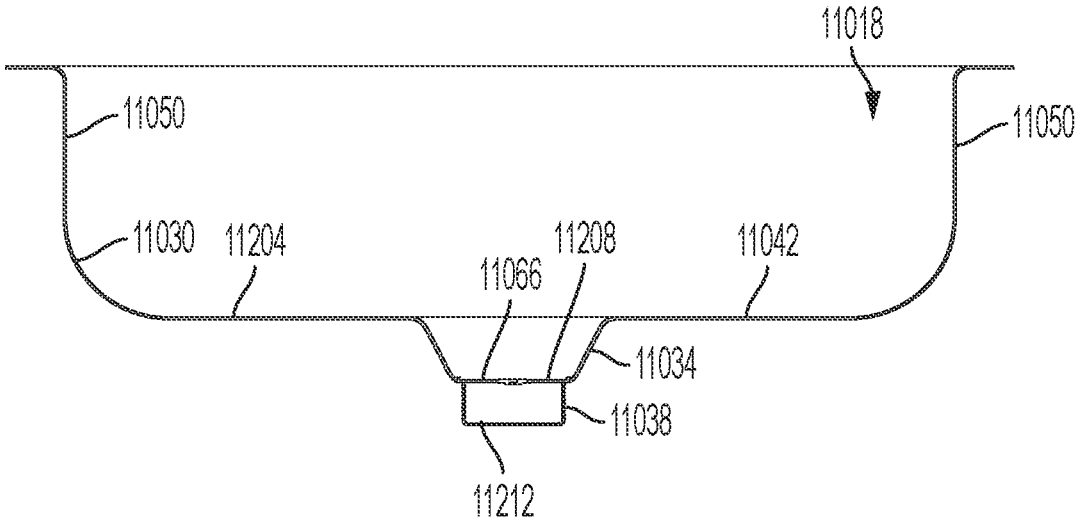
Figure 20J:
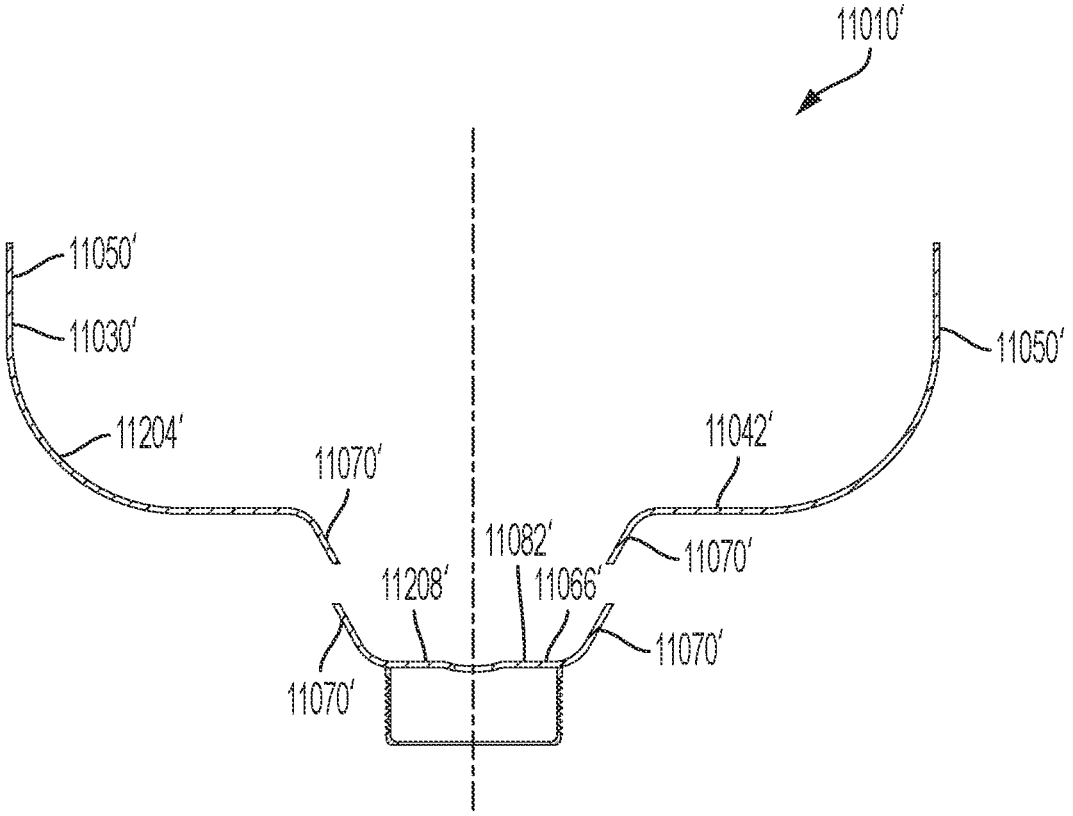

FIG. 20J illustrates another embodiment of the sink 11010' where the first piece of sheet material 11204' does not include a bottom lip. Rather, the second piece of sheet material 11208' includes both the strainer 11082' or floor 11066' and a portion of the side wall 11070' of the cup 11034'. In the illustrated embodiment, the seam between the first piece of sheet material 11204' and the second piece of sheet material 11208' is approximately one inch below the base wall 11042'.

As shown in FIG. 20A, the strainer cup 140 is sized and shaped to be at least partially received within the cup 11034 of the sink 11010. More specially, the strainer cup 140 includes a basket 900, a stopper or seal 904, and a strainer stem 908. The basket 900 of the strainer cup 140 is sized and shaped to substantially correspond with the size and shape of the inside of the cup 11034 of the sink 11010 such that when the basket 900 is positioned therein it rests against the sidewalls 11070 thereof. The basket 900 also defines a plurality of apertures 912 therein to allow fluid and small debris to pass therethrough. The size and shape of the apertures 912 may be adjusted depending on the size, shape, and type of debris the basket 900 is intended to allow to pass therethrough and restrict.

The stopper 904 of the strainer cup 140 has an exterior shape that substantially corresponds with the interior shape of the cup 11034 of the sink 11010. During use, the stopper 904 is configured to selectively engage and form a seal with the cup 11034 to restrict the flow of fluid through the strainer 11082 and out the drain 11022.

In the illustrated embodiment, at least one of the basket 900, the stopper 904, and the stem 908 is formed from material having hygienic properties.

Figure 21A:
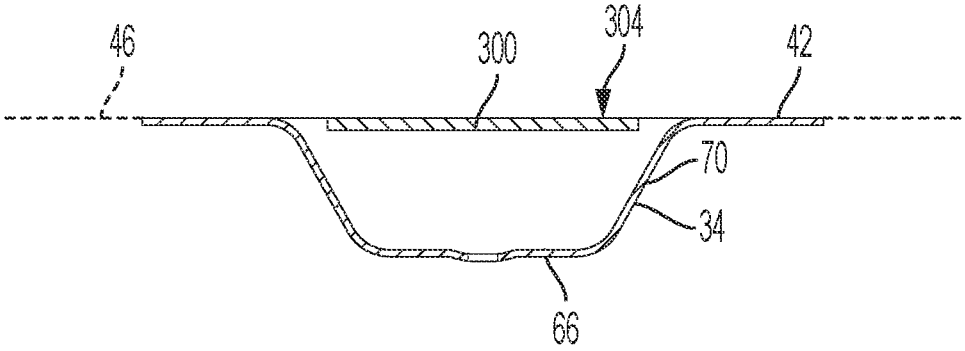
FIGS. 21A and 21B illustrate the sink of FIG. 1 with a cup cover.
Figure 21B:
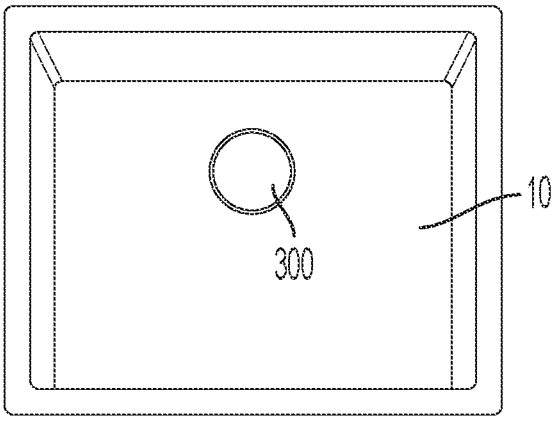

As shown in FIGS. 21A-21B, the sinks disclosed herein may include a drain cover 300 to at least partially enclose at least a portion of the inlet 90 of the cup 34. Such a cover may be formed from material having hygienic properties or be coated to have hygienic properties. The cover 300 also serves a hygienic purpose by stopping the flow of water or other liquids from falling directly into the cup 34, limiting any splashing or spray caused by interacting with drained fluids. In the illustrated embodiment, the cover 300 is oriented such that the top surface 304 thereof is substantially co-planar with the base wall 42 immediately surrounding the cup 34.

Figure 22A:
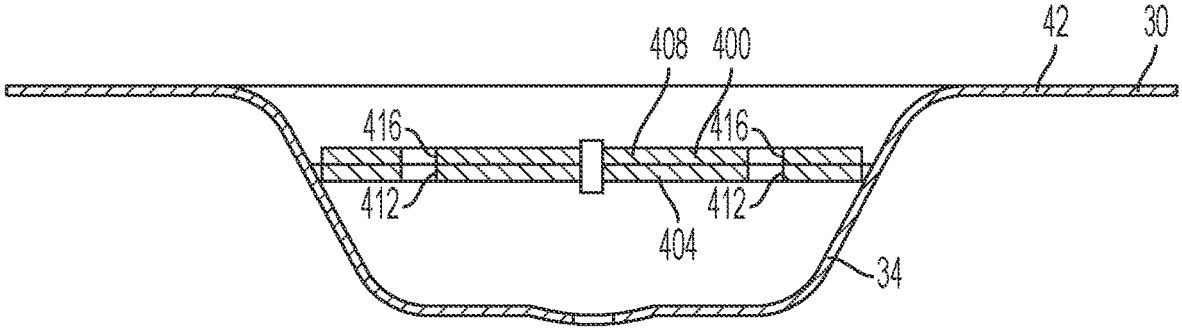
FIGS. 22A-22C illustrate a rotary sink strainer.
Figure 22B:
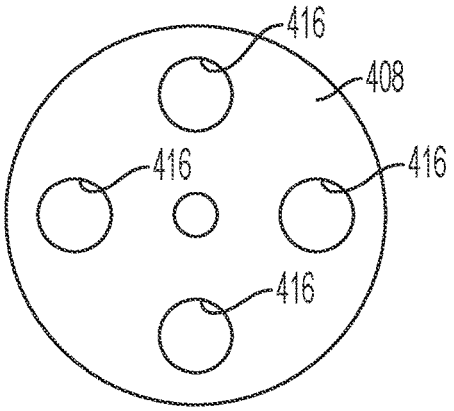
Figure 22C:
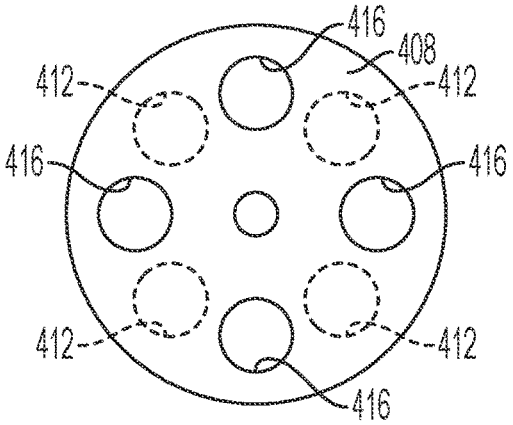

As shown in FIGS. 22A-22C, the sinks disclosed herein may also include a rotary strainer 400. The rotary strainer 400 includes a pair of elements 404, 408 that are rotatable relative to one another between an open position (see FIG. 22B), in which fluid may flow therethrough, and a closed position (see FIG. 22C), in which fluid may not flow therethrough. As shown in FIG. 22A, the first or stationary element 404 of the strainer 400 is fixedly coupled to the cup 34. The first element 404 includes a substantially disc-shaped body defining one or more apertures 412 therein. The apertures 412 are sized and shaped to permit smaller debris and liquid to pass therethrough but does not allow larger items to do so.

The strainer 400 also includes a second or movable element 408 that is rotatably coupled to the first element 404. The second element 408 includes a substantially disc-shaped body defining one or more apertures 416 therein. In the illustrated embodiment, the size and shape of the apertures 416 of the second element 408 substantially correspond with the size and shape of the apertures 412 of the second element 404 such that when the second element 408 is placed in a first position (e.g., the open position) the apertures 416 of the second element 408 align with the apertures 412 of the first element 404 allowing fluid to flow therethrough. In contrast, when the second element 408 is rotated into a second position (e.g., the closed position) the apertures 416 of the second element 408 do not align with the apertures 412 of the first element 404—thereby restricting the flow of fluids through the strainer 400.

In some embodiments, the strainer 400 may be formed into the cup 34 (e.g., the first element 404 is integrally formed with the cup 34 in place of the floor 66). In other embodiments, the strainer 400 may be a separate assembly that can be selectively placed in the cup 34 when desired (e.g., forming a seal therewith) or removed when not needed.

Figure 23:
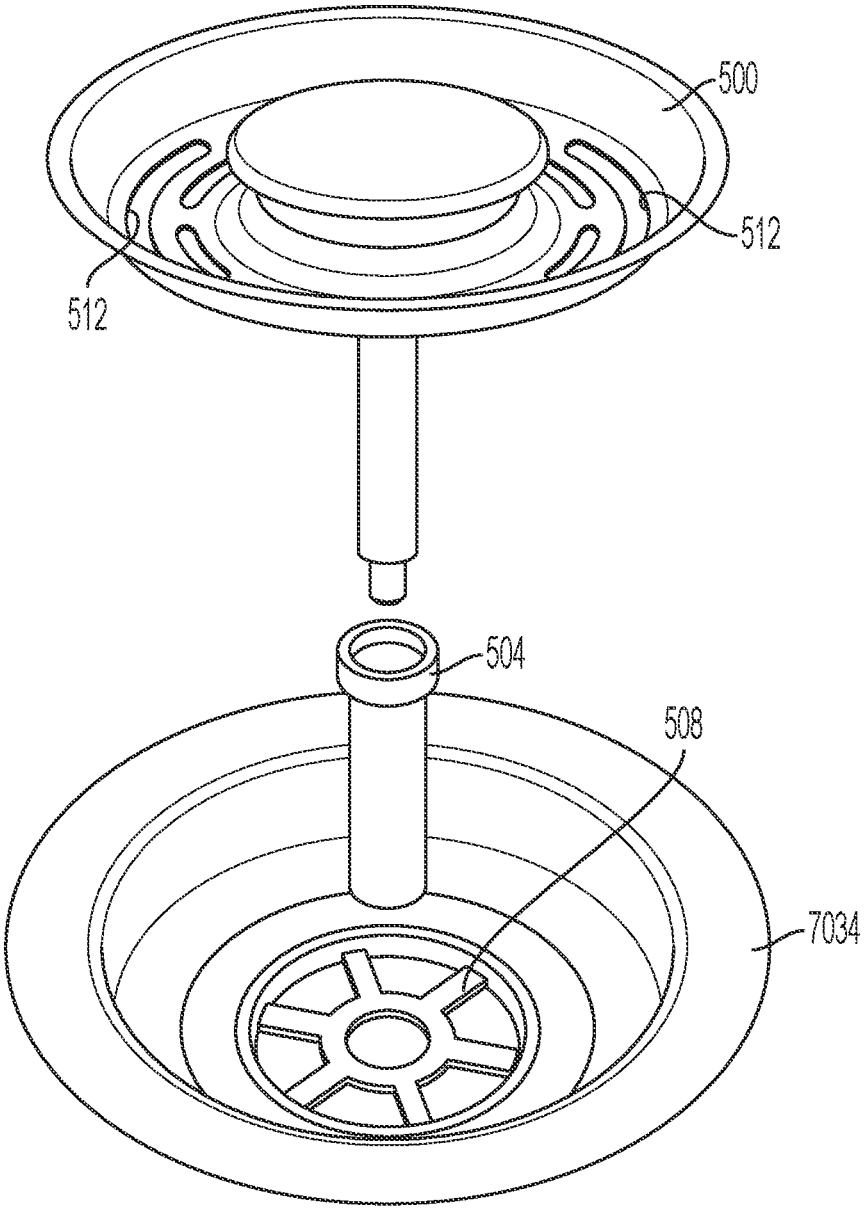
FIGS. 23-24 illustrate another embodiment of the cup.

FIG. 23 illustrates another embodiment of the cup 7034. The cup 7034 includes strainer 500 that is coupled to the cup 7034 via an internal mount 504 positioned downstream of the strainer 500 itself. More specifically, the internal mount 503 is secured by a downstream strainer 508 fixed relative to the cup 7034. During use, the mount 504 is configured to axially raise and lower the strainer 500 relative to the cup 7034 between a closed position, in which the strainer 500 engages the cup 7034 such that fluids are forced to flow through the apertures 512 defined by the strainer 500, and an open position, in which the strainer 500 is lifted axially away from the cup 7034 to allow fluid to bypass the strainer 500. In some embodiments, the strainer 500, mount 504, and/or downstream strainer 508 may be formed form a material having hygienic properties. In still other embodiments, the strainer 500 may include a ball-type detent for releasably securing the strainer 500 to the cup 7034 (see FIG. 12E).

Figure 24:
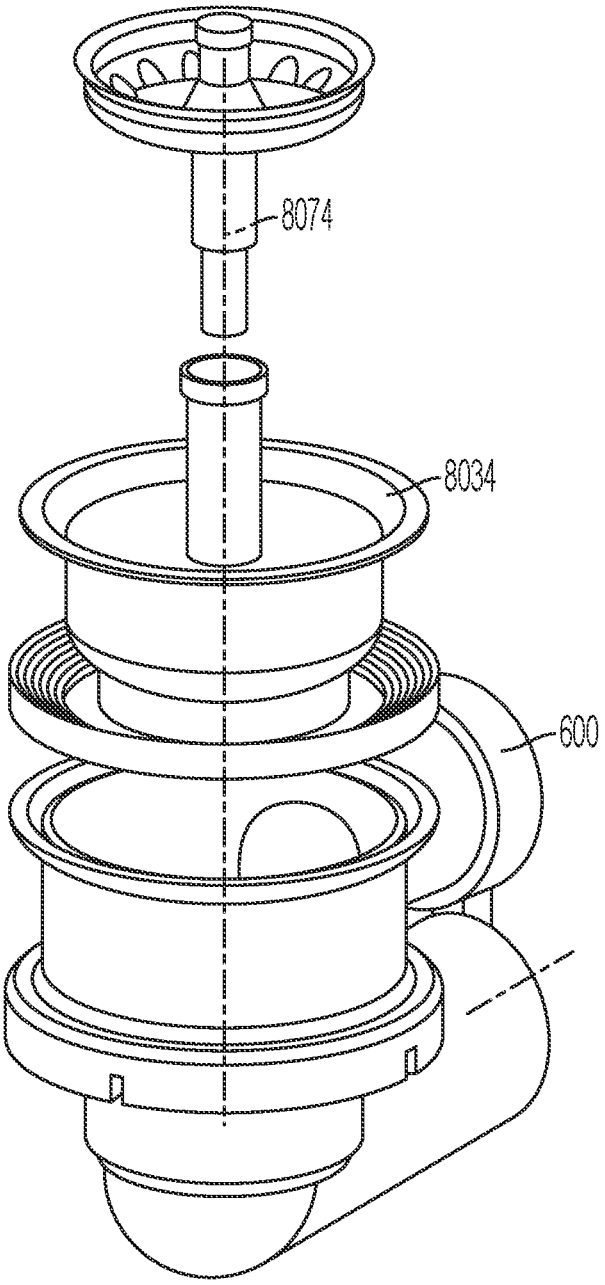

FIG. 24 illustrates yet another embodiment of the cup 8034 for low-profile sinks. The cup 8034 includes an outlet passageway 600 that is angled relative to the cup axis 8074. In the illustrated the passageway 600 is angled 90 degrees relative to the axis 8074.

Figure 25:
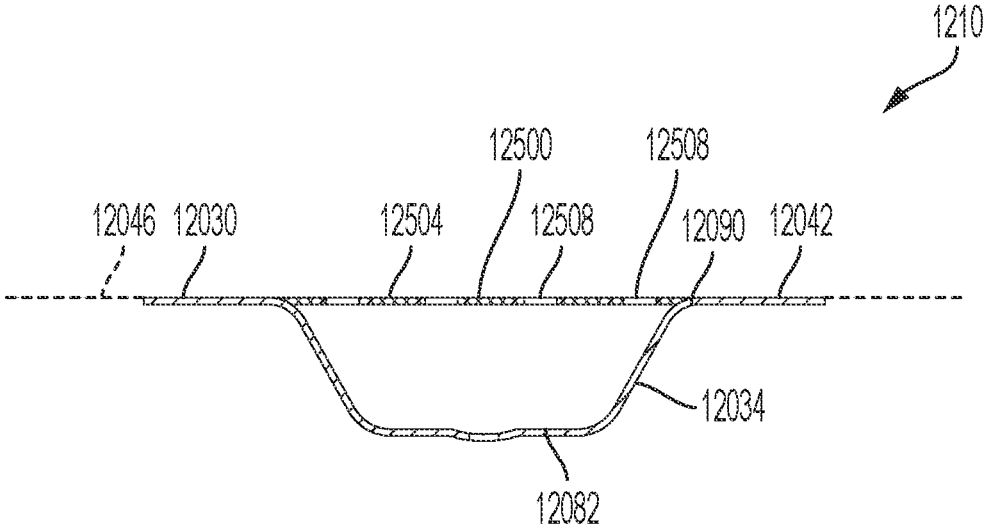
FIG. 25 illustrates another embodiment of the sink.
Figure 26A:
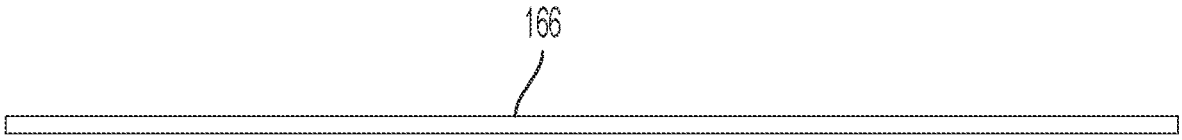
FIGS. 26A-27E illustrate other manufacturing embodiments of the sink.
Figure 26B:
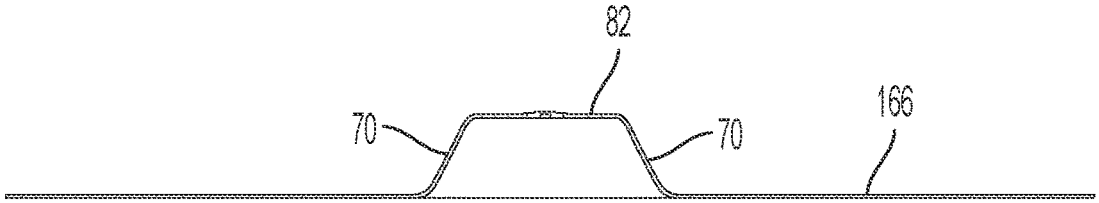
Figure 26C:
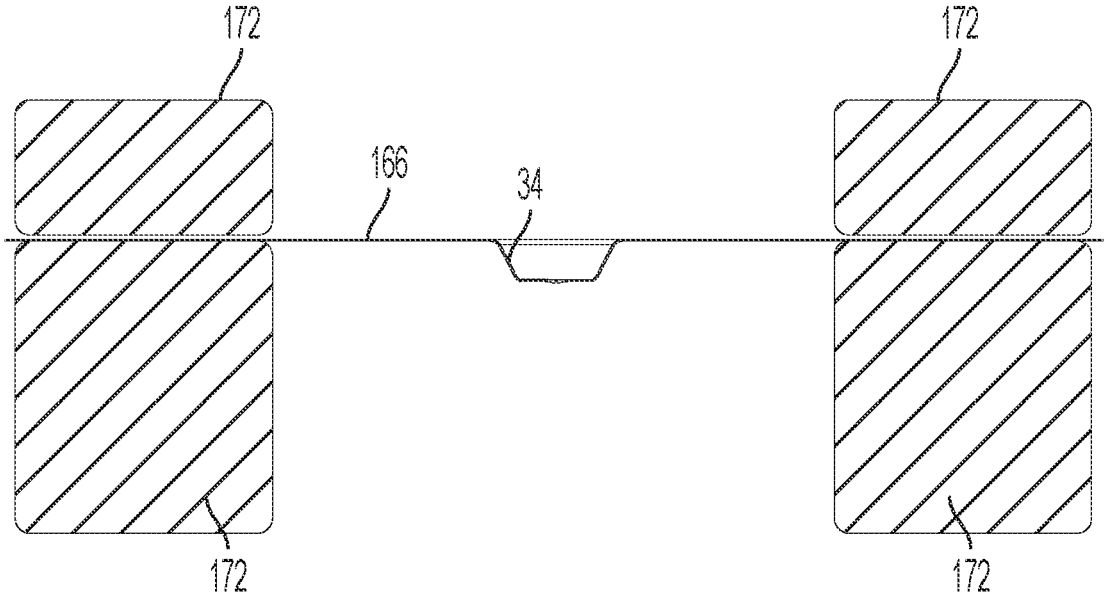
Figure 26D:
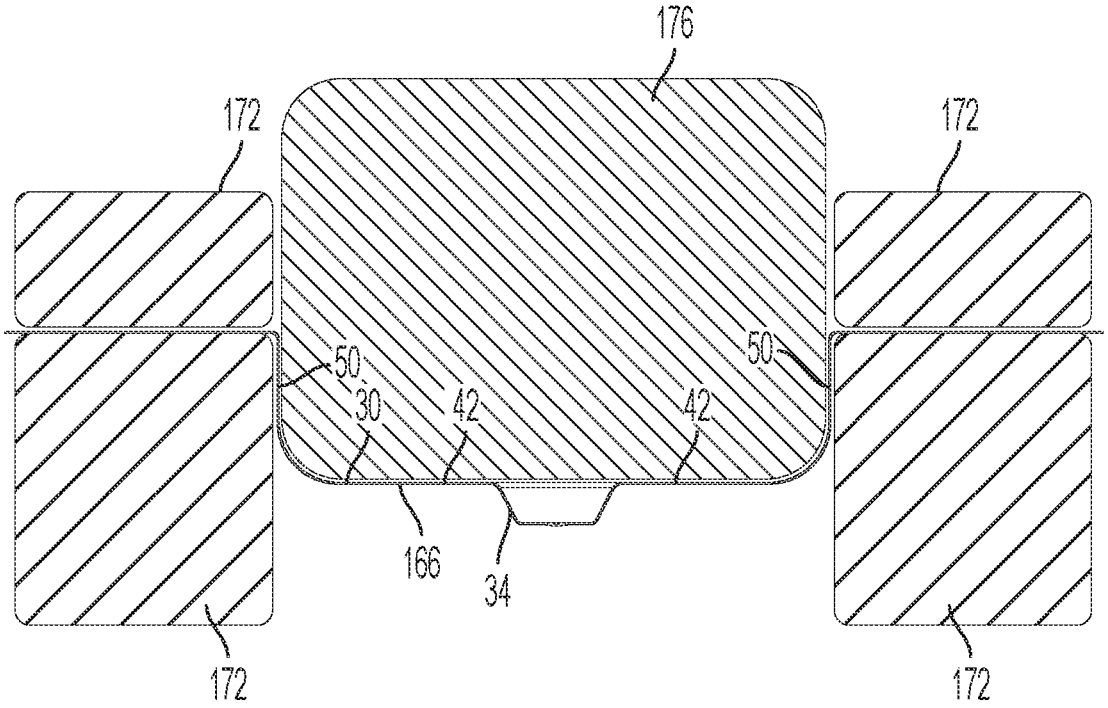
Figure 26E:
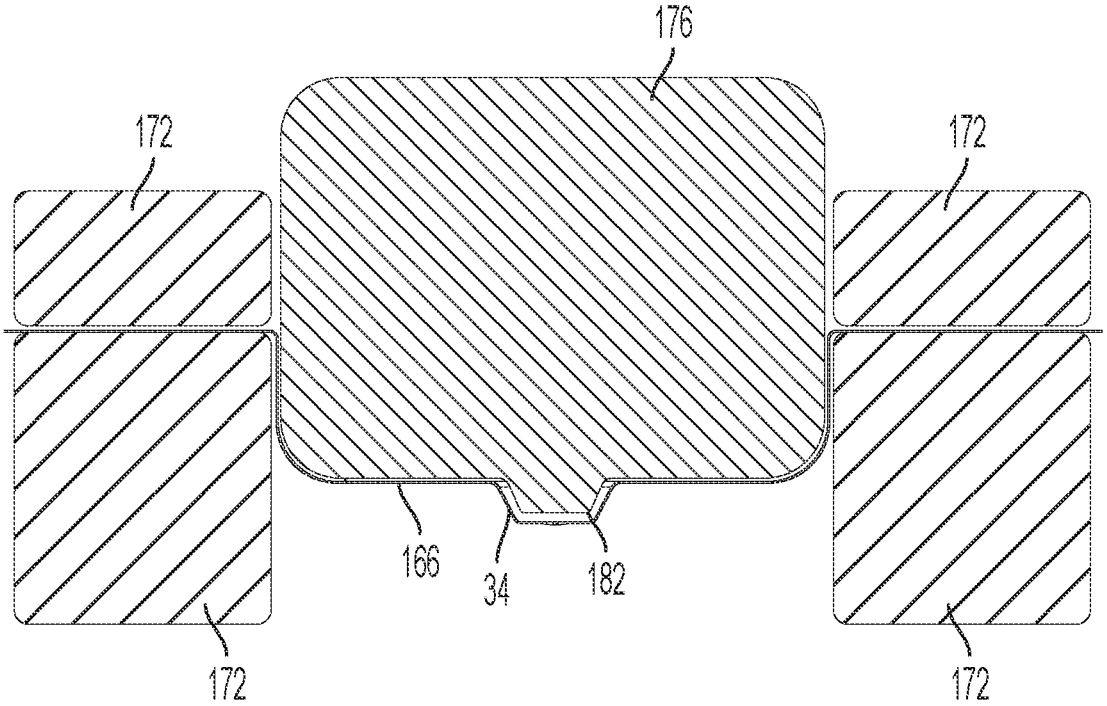
Figure 26F:
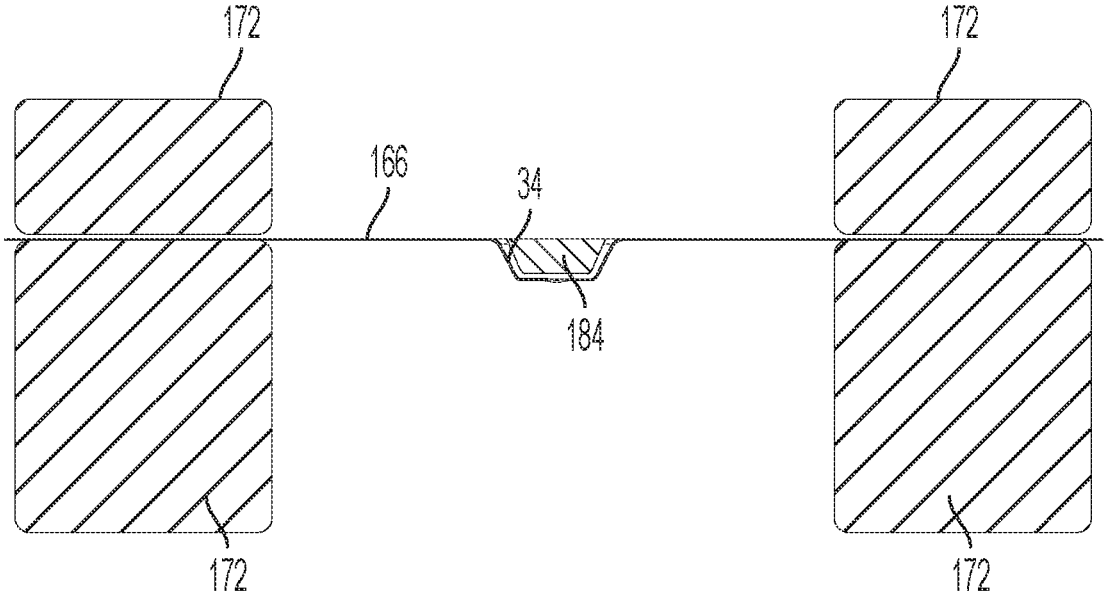
Figure 26G:
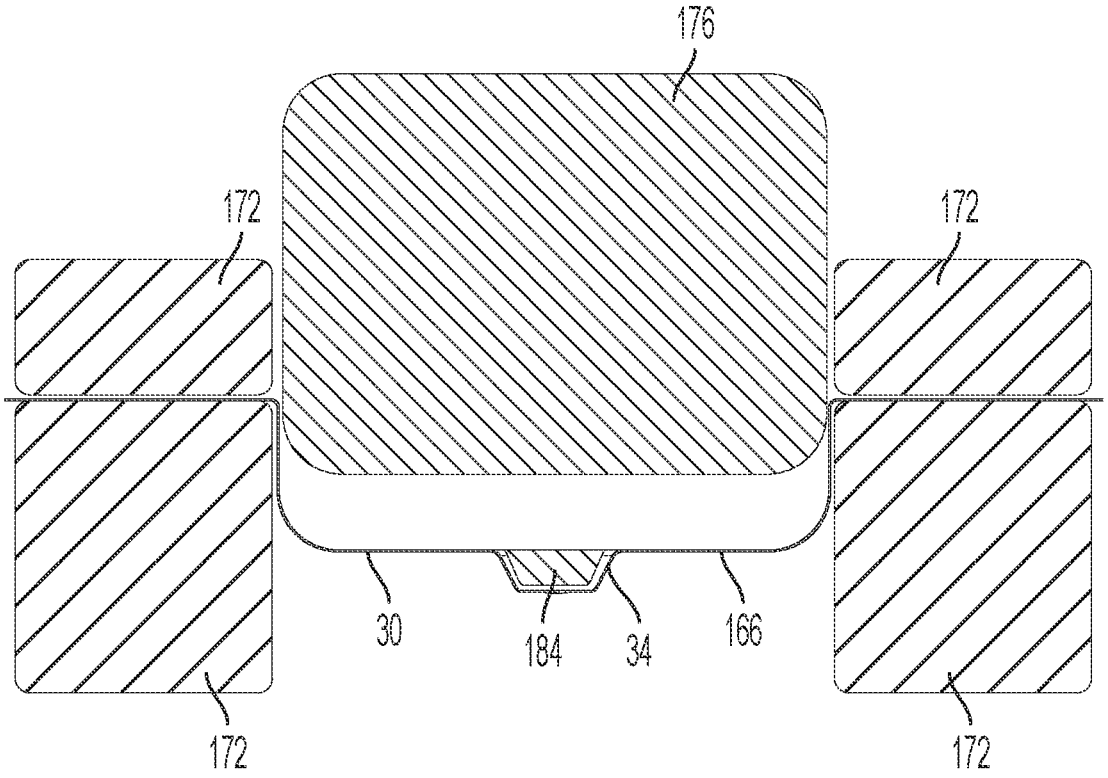
Figure 26H:
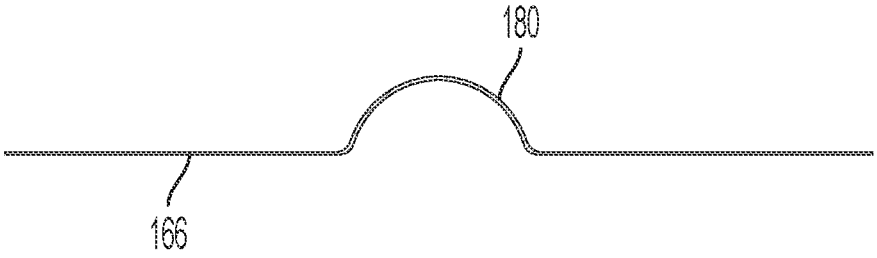

FIG. 25 illustrates another embodiment of the sink 12010. The sink 12010 is substantially similar to the sink 10 so only the differences will be discussed herein. Sink 12010 includes a two-tiered strainer system. More specifically, the sink 12010 includes a cup 12034 with a strainer 12082, and a second strainer plate 12500 positioned upstream of the strainer 12082 and substantially aligned with the base wall 12042 of the bowl 12030. By doing so, fluid attempting to drain from the sink 12010 must first pass through the second strainer plate 12500 and then through the strainer 12082. The second strainer plate 12500 is separate from and removable from the sink 12010.

As shown in FIG. 25, the second strainer plate 12500 includes a substantially disk-shaped body 12504 defining a plurality of apertures 12508 therein. The body 12504 also has an outer periphery sized and shaped to correspond with the inlet 12090 of the cup 12034. As such, when installed in place, the second strainer plate 12500 covers the inlet 12090 and is substantially aligned with the base plane 12046 of the base walls 12042. While the illustrated embodiment is substantially planar, other embodiments may have a general convex or concave shape. Furthermore, the second strainer plate 12500 may be formed from material having hygienic properties. In some embodiments, the apertures 12508 of the second strainer plate 12500 may be more coarse (e.g., larger in size) so that it acts as a coarse filter to the smaller (finer) apertures of the strainer 12082 positioned downstream While the strainer system of FIG. 25 is shown on the one piece sink 10 of FIG. 3, it is understood that the strainer system may be installed other sink embodiments including each of those described herein.

FIGS. 26A-26H illustrate a construction technique to form the vessel 18 from a single piece of sheet material 166. First, the raw stock sheet material 166 is placed in and secured relative to a press (see FIG. 26A). The stock sheet material then undergoes a first pressing action whereby at least a portion of the side walls 70 and strainer 82 of the cup 34 is formed. No bowl 30 is present. (See FIG. 26B.

With the cup 34 formed, the piece of sheet material 166 is then re-secured to a press with clamps 172. The clamps 172 are positioned against the sheet material 166 in a pattern substantially corresponding to and at least partially enclosing the exterior shape of the desired bowl 30 shape. The sheet material 166, in turn, is positioned so that the pre-formed cup 34 is positioned within the enclosed area of the clamps 172 (see FIG. 26C).

With the sink 10 secured by the clamps 172, the sink then undergoes a second pressing action whereby the bowl 30 is formed into the sheet material 166 with the pre-formed cup 34 therein. More specifically, a pressing apparatus 176 presses down onto the sheet material forming the side walls 50 and base wall 42 of the bowl 30 (see FIG. 26D). During the second pressing action, the pressing apparatus 176 is configured so that it does not disturb the size and shape of the cup 34 already formed into the sheet material 166. In some embodiments, the pressing apparatus 176 may include a protrusion 182 extending therefrom to accommodate the pre-formed cup 34 (see FIG. 26E). In still other embodiments, a separate fill block 184 may be pre-set into the cup 34 before the pressing action (see FIGS. 26F and 26G). In such embodiments, the pressing apparatus 176 would potentially be shaped to correspond with the bowl 30 shape and the separate block 184 would maintain the cup 34 shape during the pressing action.

With the contour of the bowl 30 and cup 34 of the sink 10 formed, the sheet material 166 may be trimmed to final shape. In the illustrated embodiment, the single-piece of sheet material 166 forming the sink 10 has hygienic properties. However, in alternative embodiments, the sheet material 166 may not have hygienic properties but may, rather, be coated in material having hygienic properties so that the resulting exposed surfaces, including the interior surface 156 forming the vessel volume 18 have hygienic properties. In still other embodiments, only a portion of the interior surface 156 may be coated. In still other embodiments, at least a portion of the sink 10 may have cladding applied thereon where the cladding has hygienic properties. Such cladding may cover a portion or multiple portions of the sink 10 (e.g., the cup 34, and the like).

In some embodiments, the first or second pressing action may also include a punch or punches to form apertures into the sheet material 166. For example, the first or second pressing actions may incorporate a punch configured to form the apertures 120 of the strainer 82 therein. In still other embodiments, the apertures 120 of the strainer 82 may be formed in a completely separate punching action, before the first pressing action, between the first and second pressing actions, and/or after the second pressing action.

With the bowl 30 and cup 34 formed from the single piece of stock material, the adapter 38 is then coupled to the underside of the strainer 82 (e.g., opposite the vessel volume 18). In the illustrated embodiment, the adapter 38 is joined to the cup 34 (e.g., by welding, soldering, brazing, and the like) such that fluid flowing through the apertures 120 of the strainer 82 are directed into and flow through the adapter 38 (see FIG. 4). In alternative embodiments, the adapter 38 may be attached to the cup 34 using alternative methods such as, but not limited to, pressing the adapter 38 onto the cup 34, threading the adapter 38 onto the cup 34, crimping the adapter 38 onto the cup 34, and/or using rivets or other types of mechanical fasteners. In still other embodiments, a combination of attaching methods may be used.

Figure 11:
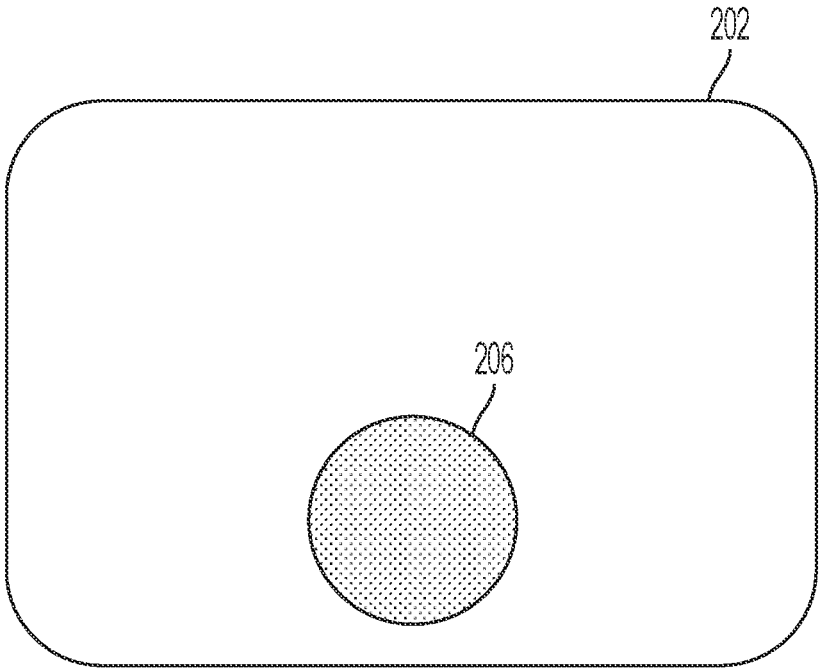
FIG. 11 illustrates a piece of hybrid stock material before the manufacturing process.

While the illustrated single piece of material is formed from a continuous single type of material (e.g., entirely stainless steel or entirely CuVerro), in alternative embodiments, the vessel 18 may be formed from a single piece of hybrid material formed from two or more types of materials joined together (see FIG. 11, described above).

While the illustrated embodiment shows the first pressing action forming the final cup 34 shape (e.g., with side walls 70 and base walls 82). In alternative embodiments, the first pressing action may be used to form an intermediate shape 180 (see FIG. 26H). The intermediate shape 180 includes a contour that is not as aggressive as the finished cup shape 34 but does include the general overall shape. For example, a hemispherical intermediate shape would provide the general overall shape of the cup 34. I such embodiments, the second pressing action could be used to further form the sheet material 166 and produce the final cup 34 shape. To do so, the pressing apparatus 176 of the second pressing action could include a protrusion 182 as disclosed in FIG. 26E, above. In still other embodiments, additional pressing actions may be used to form the final cup shape 34 before the sheet 166 enters the second pressing action.

FIGS. 27A-27E illustrate a construction technique to form the vessel 18. First, a first piece of raw stock sheet material 700 undergoes a first pressing action whereby the side walls 70 and strainer 82 of the cup 34 and a portion of the base wall 42 is formed. No bowl 30 is present. (See FIG. 27A).

Second, a second piece of raw stock sheet material 704 undergoes a punching process whereby an aperture 708 is formed therein while maintaining the overall planar contour sheet (e.g., substantially no forming actions are performed). The size and shape of the aperture 708 is configured to generally correspond with the size and shape of the outer periphery 712 of the first piece of sheet material 700 after it has been formed into the general cup shape (see FIG. 27B).

Figure 27A:
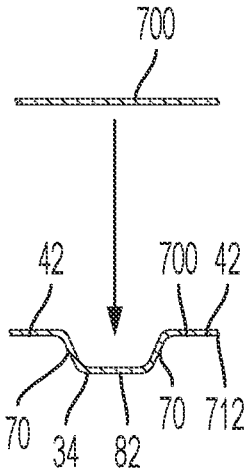
Figure 27B:
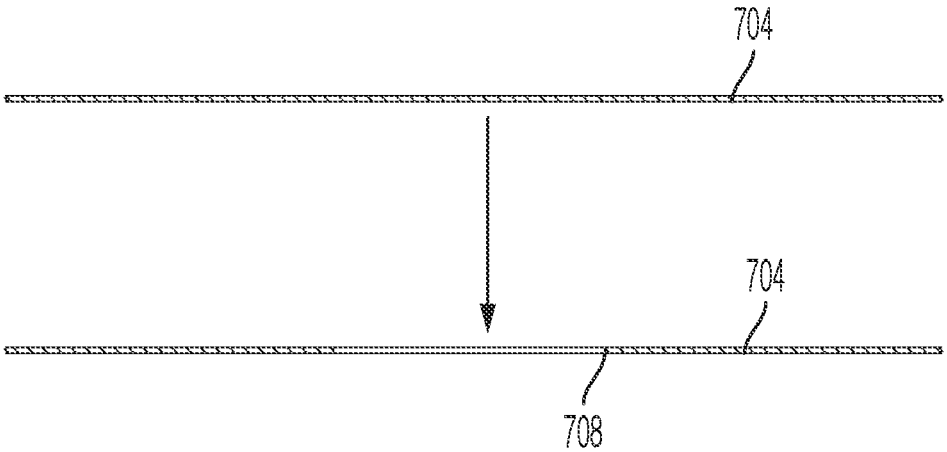
Figure 27C:
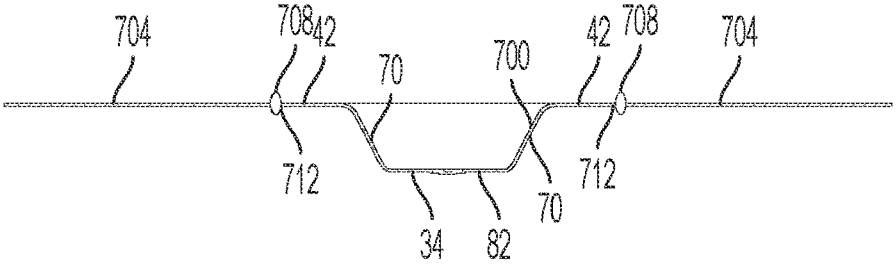
Figure 27D:
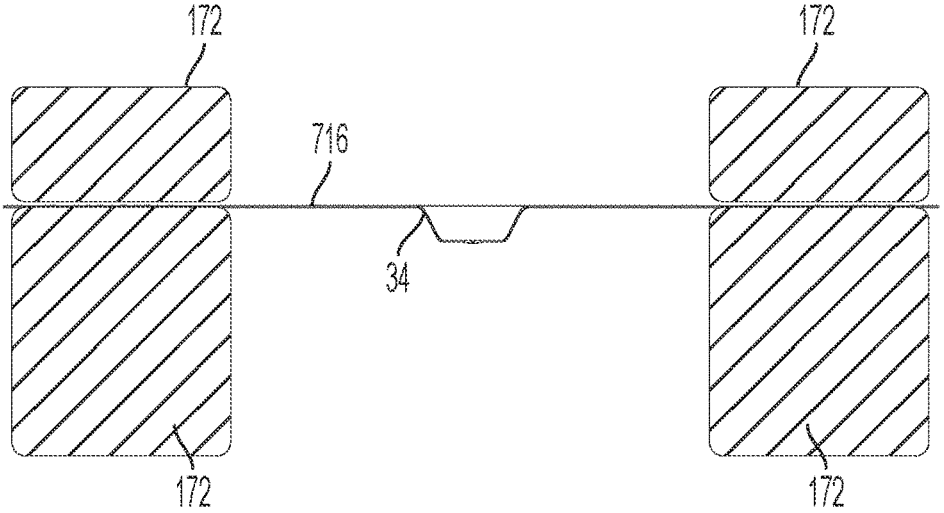
Figure 27E:
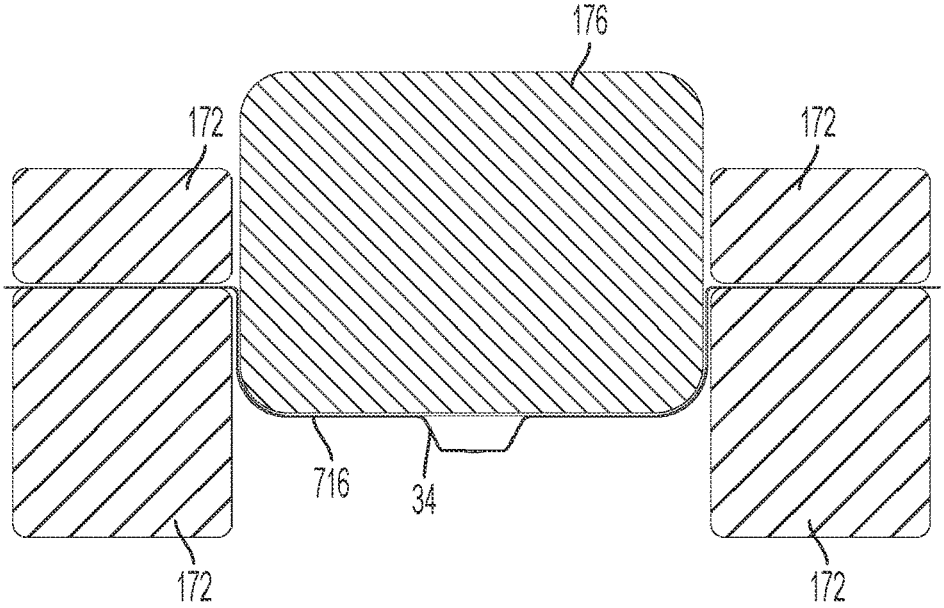

After the second piece of raw stock sheet material 7084 has been punched and the aperture 708 formed, the first piece of sheet material 700 is positioned within the aperture 708 and the two pieces are fused together (e.g., welded, brazed, soldered, and the like) at the periphery 712 and aperture 708 interface to form a combined piece of sheet material 716 (see FIG. 27C).

With the combined piece of sheet material formed 716, the combined piece of sheet material 716 is then re-secured to a press with clamps 172. The clamps 172 are positioned against the combined sheet material 716 in a pattern substantially corresponding to and at least partially enclosing the exterior shape of the desired bowl 30 shape. The sheet material 716, in turn, is positioned so that the pre-formed cup 34 welded therein is positioned within the enclosed area of the clamps 172 (see FIG. 27D).

With the material 716 secured by the clamps 172, the material 716 then undergoes a second pressing action whereby the bowl 30 is formed into the sheet material 716 with the pre-formed cup 34 therein. More specifically, a pressing apparatus 176 presses down onto the sheet material forming the side walls 50 and base wall 42 of the bowl 30 (see FIG. 27E). During the second pressing action, the pressing apparatus 176 is configured so that it does not disturb the size and shape of the cup 34 already formed into the sheet material 166 (see FIGS. 26E-26H, described above).

With the contour of the bowl 30 and cup 34 of the sink 10 formed, the sheet material 716 may be trimmed to final shape. In the illustrated embodiment, only the portion of the combined sheet material 716 formed from the first piece of sheet material 700 (e.g., the region forming the cup 34 and a portion of the base wall 42 immediately surrounding the cup 34) has hygienic properties while the remaining portions of the sheet material 716 (e.g., the portion formed from the second sheet 704) does not. In other embodiments, the entire combined sheet material 716 may have hygienic properties. In still other embodiments, none of the combined sheet material 716 may have hygienic properties. In such embodiments, all or one or more portions of the resulting interior surface 156 may be coated or cladded with material having hygienic properties.

In some embodiments, the first pressing action for the first piece of sheet material 700 or the second pressing action with the combined piece of sheet material 716 may also include a punch or punches to form apertures into the sheet material 166. For example, the first or second pressing actions may incorporate a punch configured to form the apertures 120 of the strainer 82 therein. In still other embodiments, the apertures 120 of the strainer 82 may be formed in a completely separate punching action, before the first pressing action, after the first pressing action, before the second pressing action, and/or after the second pressing action.

Figure 28:
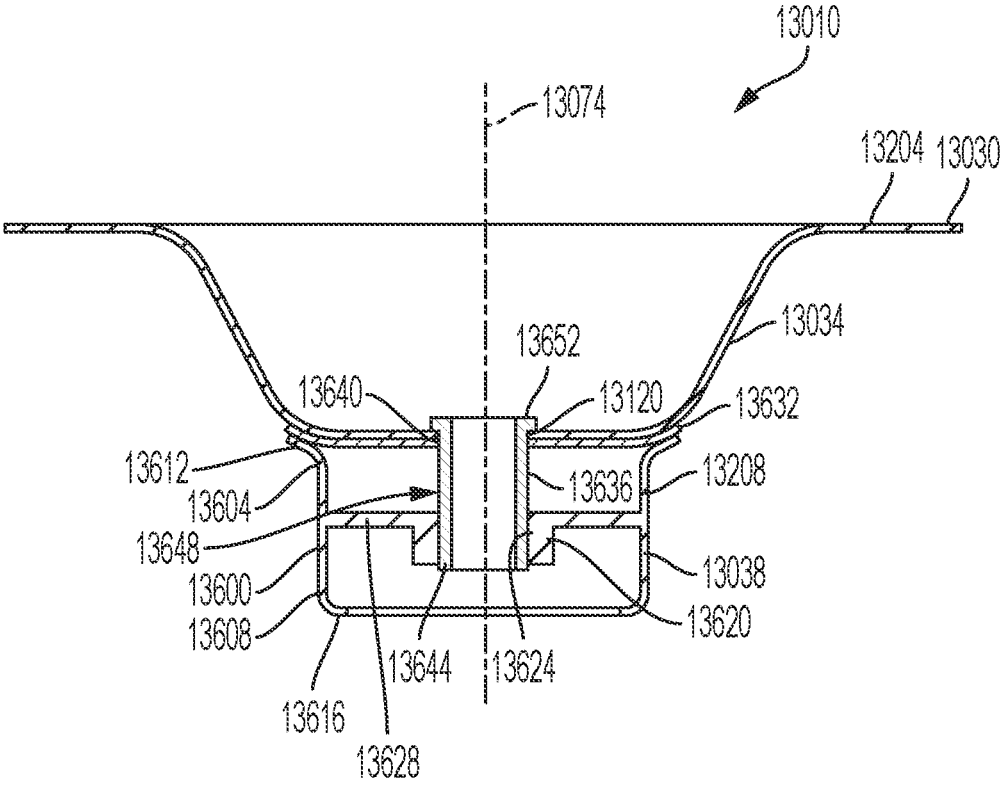
FIGS. 28-33C illustrate other embodiments of the sink.
Figure 29:
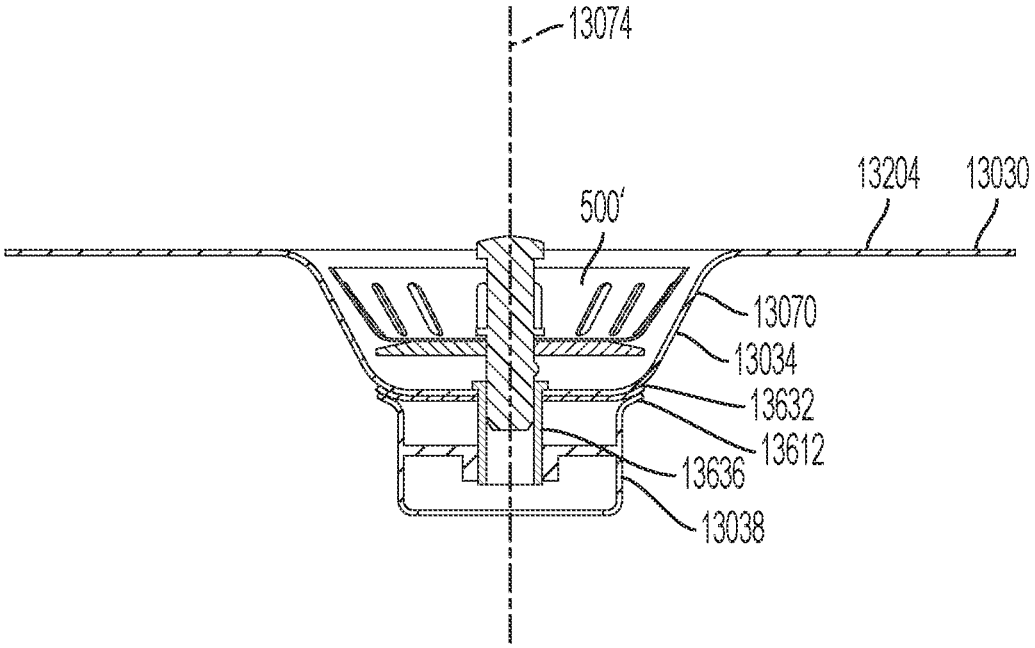

With the bowl 30 and cup 34 formed, the adapter 38 is then coupled to the underside of the strainer 82 (e.g., opposite the vessel volume 18). In the illustrated embodiment, the adapter 38 is joined to the cup 34 (e.g., by welding, soldering, brazing, and the like) such that fluid flowing through the apertures 120 of the strainer 82 are directed into and flow through the adapter 38 (see FIG. 4). In alternative embodiments, the adapter 38 may be attached to the cup 34 using alternative methods such as, but not limited to, pressing the adapter 38 onto the cup 34, threading the adapter 38 onto the cup 34, crimping the adapter 38 onto the cup 34, and/or using rivets or other types of mechanical fasteners. In still other embodiments, a combination of attaching methods may be used FIGS. 28 and 29 illustrate another embodiment of the sink 13010. The sink 13010 is substantially similar to the sink 10 so only the difference will be discussed herein. The sink 13010 includes an adapter 13038 formed from a second piece of material 13208 separate from the material 13204 forming the sink bowl 13030 and cup 13034. In the illustrated embodiment, the adapter 13038 is formed as a single piece casting; however, in alternative embodiments the adapter 13038 may be formed as a sub-assembly of separate pieces of sheet material welded or otherwise coupled together.

The adapter 13038 includes an annular outer wall 13600 having a first end 13604 and a second end 13608 opposite the first end 13604. The adapter 13038 also includes a mounting flange 13612 extending radially outwardly from the first end 13604 and a sealing flange 13616 extending radially inwardly from the second end 13608. In the illustrated embodiment, the mounting flange 13612 is configured to substantially correspond with the size and shape of the bottom of the cup 13034.

The adapter 13038 also includes a boss 13620 positioned axially between the first end 13604 and the second end 13608. The boss 13620, in turn, includes a threaded aperture 13624 that is substantially aligned with the cup axis 13074. The boss 13620 is generally maintained within the adapter 13038 with a plurality of radially extending arms 13628. While the illustrated boss 13620 is threaded, it is understood that in alternative embodiments different forms of connection may be used such as, but not limited to, bayonet fits and the like.

The adapter 13038 also includes a locking member 13636 configured to mechanically couple the adapter 13038 to the cup 13034 without welding. More specifically, the locking member 13636 extends through at least one aperture 13120 of the cup 13034 and is coupled to the adapter 13038 such that the locking member 13636 exerts a compressive axial force between the two members 13636, 13034—pulling them into engagement with each other and forming a water-tight seal therebetween. The locking member 13636 of the illustrated embodiment also serves as a support element for the strainer 500' (e.g., via an internal passageway).

In the illustrated embodiment, the locking member 13636 includes a first end 13640, and a second end 13644 opposite the first end 13640, and a set of external threads 13648 proximate the second end 13644. The locking member 13636 also includes a flange 13652 extending radially outwardly from the first end 13640 of the locking member 13636. In the illustrated embodiment, the locking member 13636 is sized so that the body of the member 13636 can pass through at least one aperture 13120 (e.g., the central aperture) of the cup 13034 while the flange 13652 can not.

To install adapter 13038, the user first positions an annular gasket 13632 between the bottom of the cup 13034 and the mounting flange 13612 of the adapter 13038 and aligns the adapter 13038 with the cup 13034. With the adapter 13038 and gasket 13632 aligned, the user then passes the second end 13644 of the locking member 13636 through the central aperture 13120 of the cup 13034. As discussed above, the body of the member 13636 is sized so that it can pass through the aperture 13120.

With the body of the member 13636 through the aperture 13120, the user may then begin threading the external threads of the cylinder 13636 into the threaded aperture 13624 of the boss 13620. The user then screws the member 13636 into the boss 13620 until the flange 13652 of the locking member 13636 engages the upper surface of the cup 13034.

With the flange 13652 in contact with the upper surface of the cup 13034, any further threading of the member 13636 into the boss 13620 clamps the adapter 13038 against the underside of the cup 13034—capturing the gasket 13632 between the mounting flange 13612 and the underside of the strainer plate 13082 of the cup 13034 and forming a seal therebetween so that the channel formed by the adapter 13038 is in fluid communication with the apertures formed by the strainer 13082 of the cup 13034.

While the illustrated connection between the member 13636 and the boss 13620 is threaded, it is understood that in alternative embodiments other forms of connection, such as but not limited to bayonet fittings, lugs, and the like, may be used to apply the axial compressive force between the two members 13034, 13038.

Figure 29A:
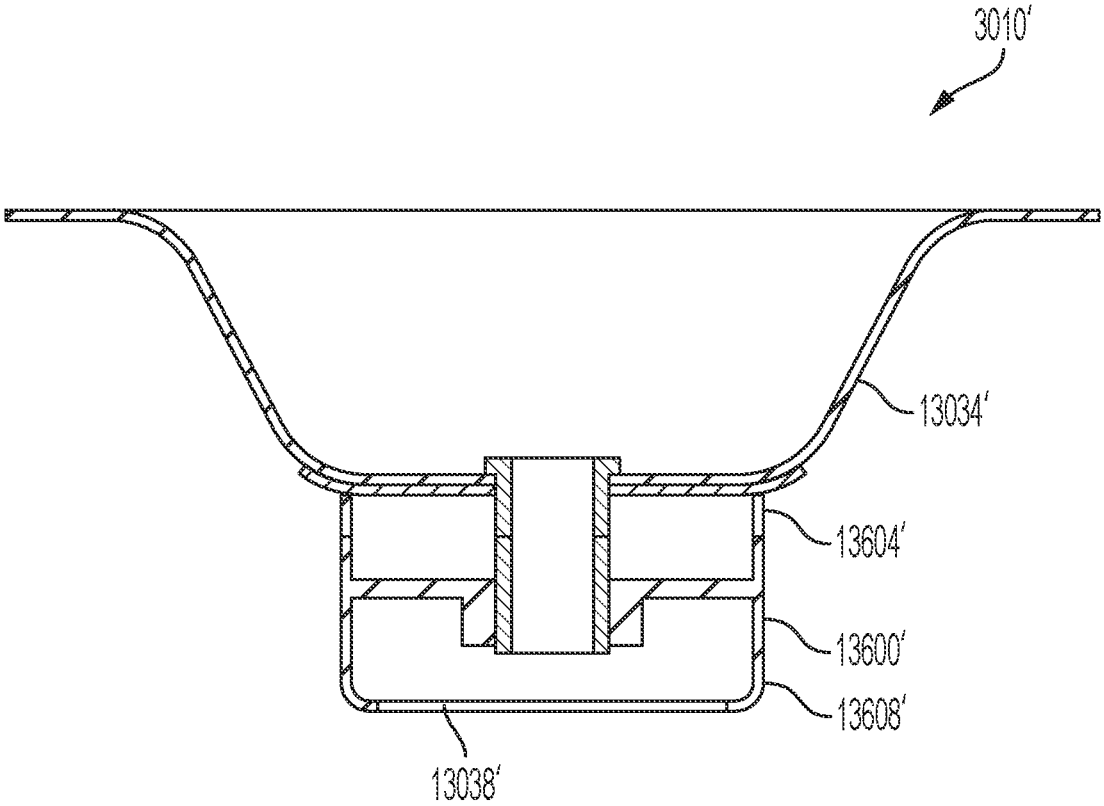

FIG. 29A illustrates another embodiment of the sink 13010'. The adapter 13038' of the sink 13010' includes an annular outer wall 13600' extending axially between the first end 13604 and the second end 13608. In such an embodiment, the end of the wall 13600' directly engages and forms a water-tight seal with the underside of the cup 13034'.

Figure 29B:
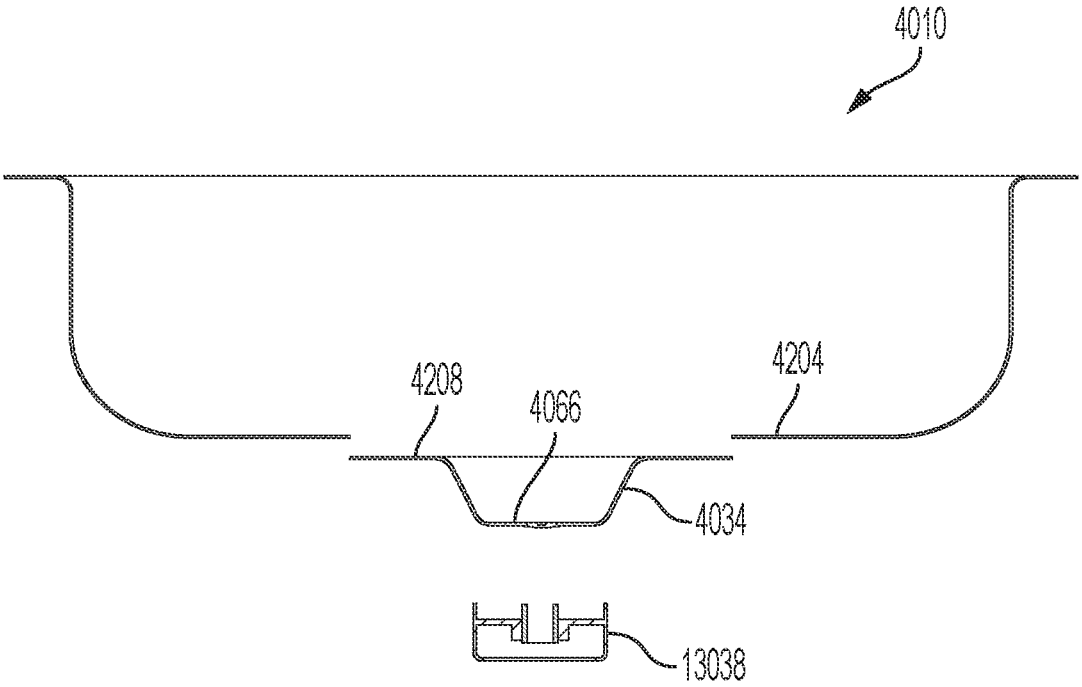

FIG. 29B illustrates another embodiment where the adapter 13038 is mechanically coupled to the cup 4034 of a two-piece sink body such as the body described in FIG. 15 (e.g., sink 4010) to produce a water-tight seal. In still other embodiments, the adapter 13038" may be mechanically coupled to other sink body embodiments.

Figure 30:
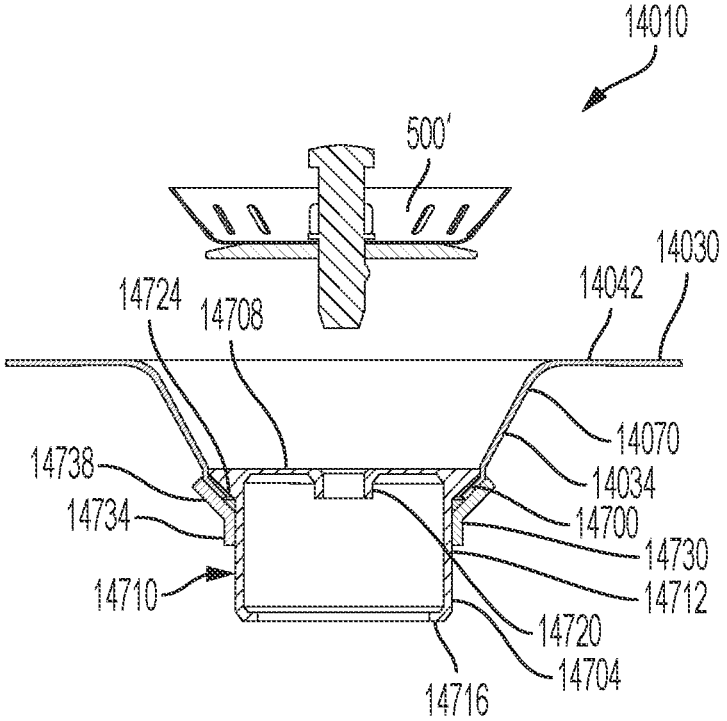
Figure 31:
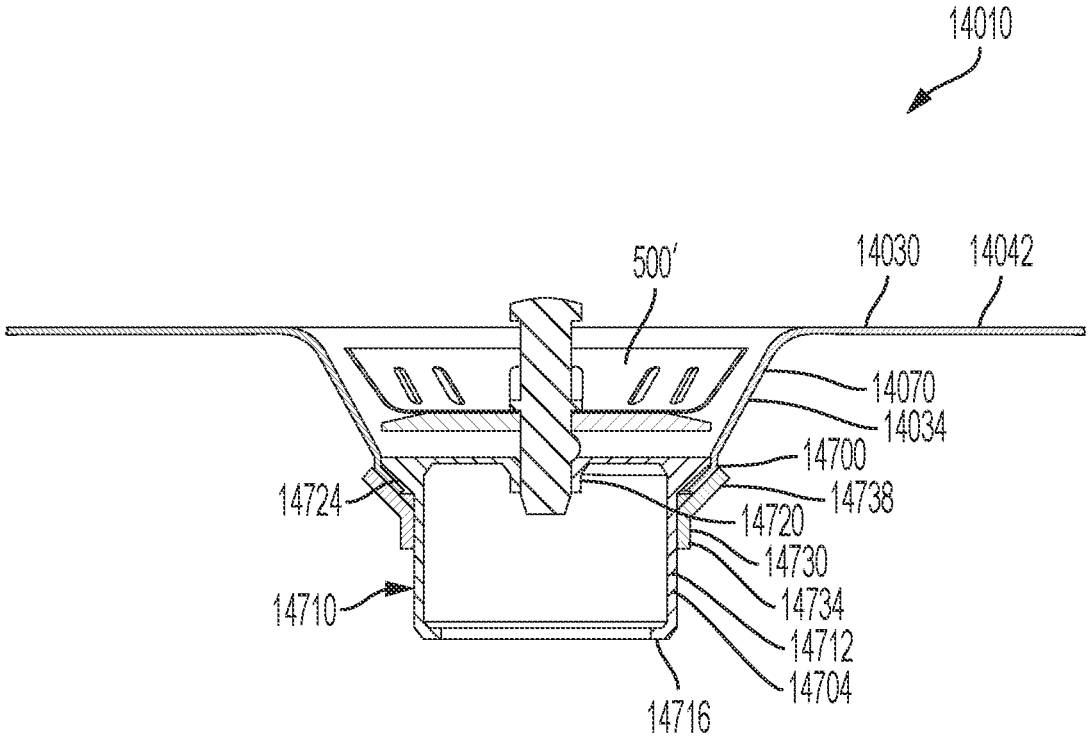

FIGS. 30 and 31 illustrate another embodiment of the sink 14010. The sink 14010 is substantially similar to the sink 2010 so only the differences will be discussed in detail herein. The cup 14034 of the sink 14010 include sidewalls 14070 extending downwardly from the base wall 14042 of the bowl 14030 and locating surfaces 14700 extending axially downwardly (e.g., away from the bowl 14030) and radially inwardly from the bottom of the sidewalls 14070. During use, the locating surfaces 14700 are configured to support and align the strainer assembly 14704 relative to the cup 14034.

The strainer assembly 14704 includes a strainer plate 14708, an adapter body 14712 extending axially downwardly from the strainer plate 14708, a set of external threads 14710 on the outside of the adapter body 14712, and a sealing flange 14716 extending radially inwardly from the adapter body 14712 opposite the strainer plate 14708. The strainer assembly 14704 also includes a strainer boss 14720 for interacting with a strainer 500 and the like. In the illustrated embodiment, the strainer plate 14708 extends radially outwardly from the adapter body 14712 to produce a locating surface 14724 therebetween. As shown in FIGS. 30 and 31, the size and shape of the locating surface 14724 of the strainer assembly 14704 substantially corresponds with the size and shape of the locating surfaces 14700 of the cup 14034. More specifically, both locating surfaces 14724,

14700 have a substantially frusto-conical shape which helps to both radially and axially locate the strainer assembly 14704 relative to the cup 14034.

The sink 14010 also includes a locking collar 14730 configured to couple the strainer assembly 14704 to the cup 13034. More specifically, the locking collar 14730 includes a first portion 14734, and a second portion 14738 extending radially outwardly from the first portion 14734 to form a sealing surface. As shown in FIGS. 30 and 31, the second portion 14738 of the locking collar 14730 generally includes a size and shape that substantially corresponds with the size and shape of the locating surface 14724 of the strainer assembly 14704 and the locating surfaces 14700 of the cup 14034. More specifically, the second portion 14738 is substantially frusto-conical in shape.

In the illustrated embodiment, the first portion 14734 of the locking collar 14730 includes internal threads configured to engage with external threads 14710 of the strainer assembly 14704. However, in alternative embodiments, different type and styles of connection between the locking collar 14730 and the strainer assembly 14704 may be used.

To assemble the sink 14010, the user first introduces the strainer assembly 14704 into the cup 14034, passing it axially through the bottom thereof until the locating surface 14724 of the strainer assembly 14704 is in contact with the locating surface 14700 of the cup 13034. As discussed above, the orientation and shape of the locating surfaces 14724, 14700 axially and radially orients the strainer assembly 14704 relative to the cup 13034.

With the strainer assembly 14704 in position, the user then begins to thread the locking collar 14730 onto the external threads 14710 of the adapter body 14712. The user then continues the thread the collar 14730 axially upwardly until the second portion 14738 engages the locating surfaces 14700 of the cup 14034 opposite the locating surfaces 14724 of the strainer assembly 14704, capturing the cup 14034 therebetween. The user may then tighten the locking collar 14730 until a water-tight seal is formed between the locking collar 14730, the strainer assembly 14704, and the cup 14034. Although not shown, a seal or gasket may also be positioned between the strainer assembly 14704 and the cup 14034 to improve the sealing attributes therebetween.

Figure 32:
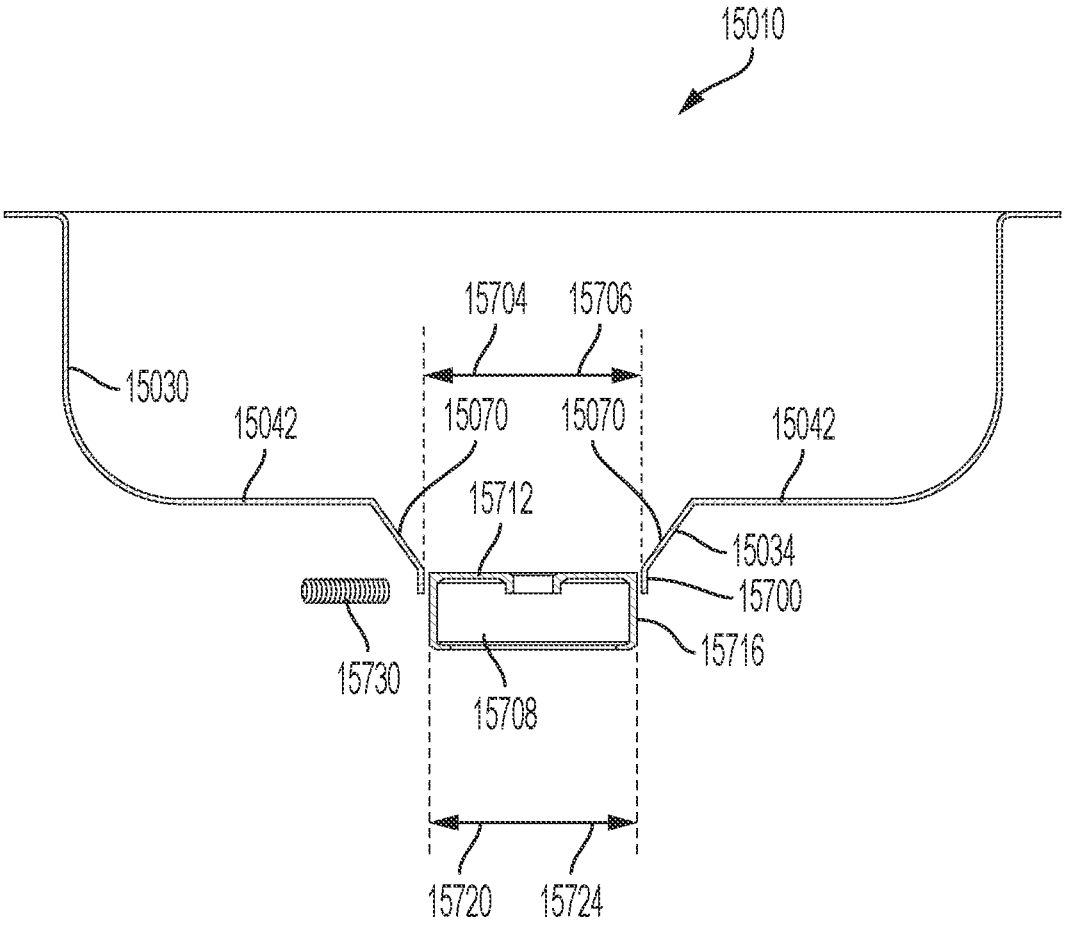

FIG. 32 illustrates another embodiment of the sink 15010. The sink 15010 is substantially similar to the sink 2010 so only the differences will be discussed in detail herein. The cup 15034 of the sink 15010 includes sidewalls 15070 extending downwardly and radially inwardly from the base wall 15042 of the bowl 15030 and a locating wall 15700 extending axially downwardly (e.g., away from the bowl 15030) from the bottom of the sidewalls 15070 relative to the cup axis 15 to produce an inner periphery 15704. In the illustrated embodiment, the locating wall 15700 is substantially annular in shape and defines an inner diameter 15706. During use, the locating wall 15700 is configured to locate and couple a strainer assembly 14708 relative to the cup 15034.

The strainer assembly 15708 includes a strainer plate 15712 and an adapter body 15716 extending axially downwardly from the periphery of the strainer plate 15712 to produce an exterior periphery 15720. In the illustrated embodiment, the strainer plate 15712 and adapter body 15716 together form a substantially cylindrical shape defining an exterior diameter 15724. As shown, the exterior diameter 1572 substantially corresponds with the inner diameter 15706 of the locating wall 15700.

During use, the strainer assembly 15708 is mechanically coupled to the cup 15034 of the sink 15010 via the locating wall 15700. In the illustrated embodiment, the relative sizes of the inner periphery 15704 and the exterior periphery 15720 are such that the strainer assembly 15708 may be pressed axially into place such that the locating wall 15700 and strainer assembly 15708 axially overlap (see FIG. 32). By doing so, the resulting interference fit produces a water-tight seal therebetween and maintains the strainer assembly 15708 in place. Still further, one or more fasteners or pins 15730 may be used (e.g., inserted radially between the items) to further secure the strainer assembly 15708 in place. In other embodiments, other forms of mechanical attachment such as, but not limited to, adhesives, crimping, bayonet connections, fasteners, riveting, threading, roll-pins, and the like may also be used in place of or together with a press fit to secure the strainer assembly 15708 relative to the locating wall 15700. While the illustrated embodiments are substantially circular in cross-sectional shape, it is understood that other shapes may also be present (e.g., squares, octagons, and the like).

Figure 33A:
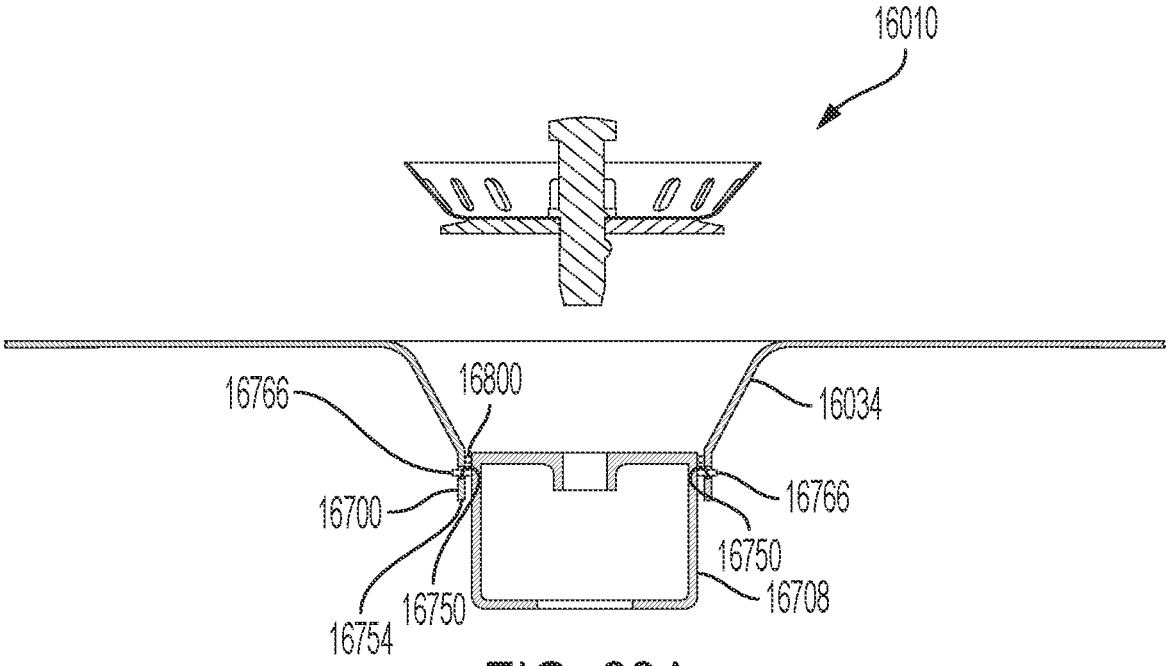
Figure 33B:
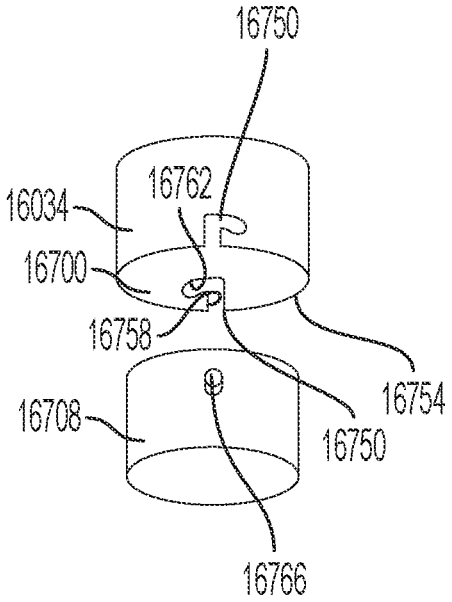
Figure 33C:
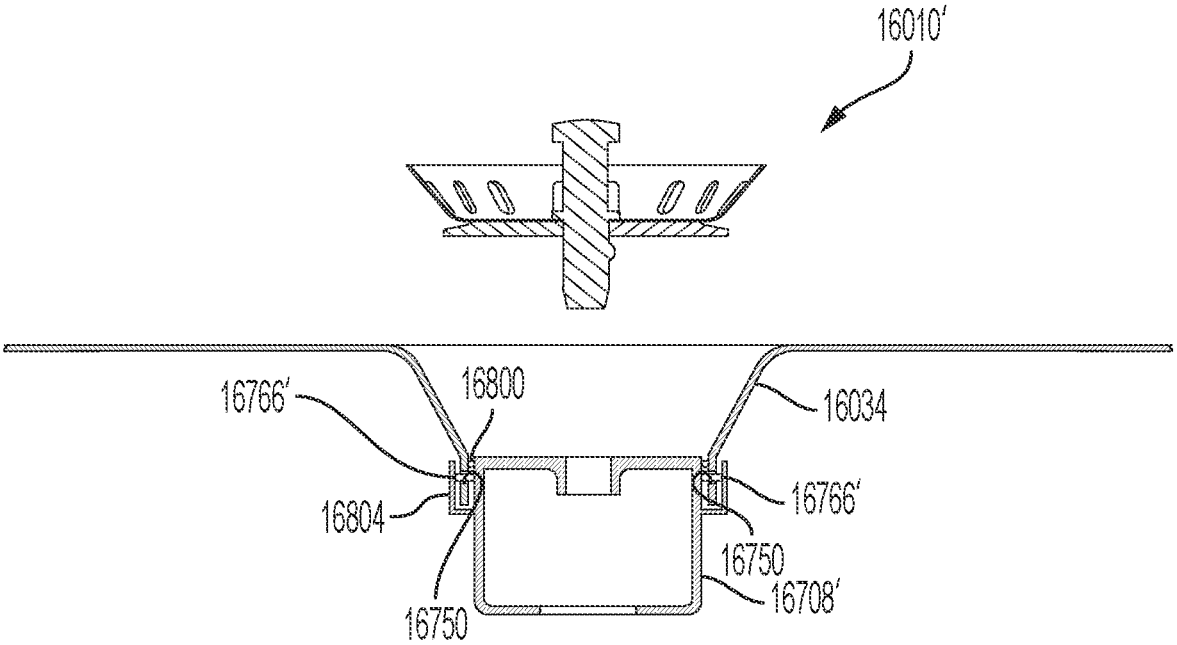

FIGS. 33A-33C illustrate another embodiment of a sink 16010. The sink 16010 is substantially similar to sink 15010 so only the differences will be discussed herein. As shown in FIG. 33A, the locating wall 16700 of the cup 16034 defines one or more tortuous paths or channels 16750 therein that are open to the bottom edge 16754 thereof. As shown in FIG. 33B, each path 16750 is substantially "L" shaped and includes an axial leg 16758 open to the bottom edge 16754 and a locking leg 16762 oriented at an angle relative to the axial leg 16758. While the illustrated paths 16750 are L shaped, in alternative embodiments other sizes and shapes may be used so long as the tortuous path 16750 provides the desired locking capabilities.

The strainer assembly 16708 of the sink 16010 includes one or more pins 16766 extending radially outwardly therefrom. As shown, the number and location of the pins 16766 is such that each pin 16766 substantially corresponds to and aligns with a corresponding path 16750 of the locating wall 16700. Together, the pins 16766 of the strainer assembly 16708 and the paths 16750 of the locating wall 16700 produce a twist-lock mechanism whereby axially inserting and relatively rotating the strainer assembly 16708 relative to the cup 16034 couples the two elements together. More specifically, to attach the strainer assembly 16708 to the cup 16034, the user first aligns each of the pins 16766 with its corresponding path 16750. The user then axially introduces the strainer assembly 16708 into the cup 16034 so that each pin 16766 travels axially along the axial leg 16758 of the path 16750.

The sink 15010 also includes a seal 16800 positioned between the strainer assembly 16708 and the cup 16034. The seal may be a compression seal such that the action of attaching the strainer assembly 16708 to the cup 16034 causes the seal to be compressed between the two members. In other embodiments, the seal may be formed by the application of sealant, glue, and the like at the interface between the two members.

Once inserted, the user then rotates the strainer assembly 16708 relative to the cup 16034 causing the pins 16766 to enter the locking leg 16762 of each respective path 16750. By doing so, the pins 16766 are axially restricted such that the strainer assembly 16708 becomes locked into place relative to the cup 16034. Although not shown, pins or other fasteners may be used to further secure the strainer assembly 16708 in place.

FIG. 33C illustrates another embodiment of the 16010'. The sink 16010' is substantially similar to the sink 16010 so only the differences will be discussed in detail herein. The sink 16010' includes a secondary flange 16804' forming a channel into which the locating wall 16700 of the cup 16034 may be at least partially received therein. In some embodiments, the locating wall 16700 may form a water-tight seal with the channel (e.g., any one of the side walls forming the channel, a gasket positioned in the channel, and/or a combination thereof).

While the illustrated embodiment shows the paths 16750 associated with the cup 16034 and pins 16766 associated with the strainer assembly 16708, it is understood that in alternative embodiments the orientation may be reversed such that the paths 16750 are associated with the strainer assembly 16708 and the pins 16766 are associated with the cup 16034.

What is claimed is:

1. A sink comprising:

a body defining a vessel volume having an interior surface, the body including:

a bowl formed from sheet material, where the bowl includes a base wall and at least one side wall extending from the base wall, wherein the bowl includes a cylindrical first locating wall, and wherein the bowl at least partially defines the interior surface, and a cup, where the cup includes a strainer plate defining one or more apertures therein, wherein the cup includes a cylindrical second locating wall, wherein the cup at least partially defines the interior surface, and wherein the cup is mechanically coupled to the bowl by a press-fit connection where the first locating wall directly contacts the second locating wall, and where the interference between the first locating wall and the second locating wall forms a water-tight connection therebetween without the use of a gasket.

2. The sink of claim 1, wherein the cup defines a cup axis, wherein the cup axis is normal to the base wall, and wherein at least a portion of the bowl axially overlaps at least a portion of the cup.

3. The sink of claim 1, wherein the strainer plate is offset from the base wall.

4. The sink of claim 1, wherein an adhesive is used with the press-fit to secure the first piece of sheet material relative to the second piece of sheet material.

5. The sink of claim 1, wherein the cup is configured to be directly coupled to a tail pipe.

6. The sink of claim 1, wherein the press-fit connection does not include a crimp.

7. A sink comprising:

a vessel volume having an interior surface;

a bowl, where the bowl includes a base wall and at least one side wall extending from the base wall, wherein the bowl at least partially defines the interior surface;

a cup, where the cup includes a strainer plate defining one or more apertures and at least one side wall, wherein the cup at least partially defines the interior surface;

a first piece of sheet material forming the base wall of the bowl, and the at least one side wall of the bowl; and a second piece of sheet material forming the strainer plate, and wherein the second piece of sheet material is mechanically coupled to the first piece of sheet material by a press-fit connection, where an adhesive is used with the press-fit to secure the first piece of sheet material relative to the second piece of sheet material, and where the interference fit between the first piece of sheet material and the second piece of sheet material forms a water-tight connection therebetween.

8. The sink of claim 7, wherein the first piece of sheet material includes a first locating surface, wherein the second piece of sheet material includes a second locating surface, and wherein the first locating surface cooperates with the second locating surface to radially position the second piece of sheet material relative to the first piece of sheet material.

9. The sink of claim 8, wherein the first locating surface defines a first diameter, wherein the second locating surface defines a second diameter, and wherein the first diameter substantially corresponds with the second diameter.

10. The sink of claim 9, wherein at least a portion of the first locating surface axially overlaps with the second locating surface.

11. The sink of claim 8, wherein the cup defines a cup axis, and wherein the first locating surface is parallel to the cup axis.

12. The sink of claim 7, wherein one of the first piece of sheet material and the second piece of sheet material includes a pin, wherein the other of the first piece of sheet material and the second piece of sheet material defines a tortuous path, and wherein the pin is configured to travel along the tortuous path to couple the first piece of sheet material to the second piece of sheet material.

13. The sink of claim 7, wherein the first piece of sheet material further includes a locating wall and wherein the second piece of sheet material is press-fit onto the locating wall.

14. The sink of claim 13, wherein the cup defines a cup axis, and wherein the locating wall is parallel the cup axis.

15. The sink of claim 13, wherein the cup includes at least one side wall extending from the strainer plate.

16. The sink of claim 15, wherein the at least one side wall is perpendicular to the strainer plate.

17. The sink of claim 13, wherein the locating wall is annular in shape.

18. A sink comprising:

a vessel volume having an interior surface;

a bowl, where the bowl includes a base wall and at least one side wall extending from the base wall, wherein the bowl at least partially defines the interior surface;

a cup, where the cup includes a strainer plate defining one or more apertures, wherein the cup at least partially defines the interior surface, and wherein the cup defines an axis;

a first piece of sheet material at least partially forming the bowl, wherein the first piece of material forms a locating wall that is parallel to the axis and cylindrical in shape; and a second piece of sheet material at least partially forming the cup, and wherein the second piece of sheet material is mechanically coupled to the first piece of sheet material such that the locating wall of the first piece of sheet material directly contacts the second piece of sheet material to form a press-fit connection, and wherein the interference between the locating wall of the first piece of sheet material and the second piece of sheet material produces a water-tight connection therebetween.

19. The sink of claim 18, wherein at least a portion of the first piece of sheet material and the second piece of sheet material axially overlap.

20. The sink of claim 18, wherein the strainer plate is axially offset from the base wall of the bowl.

21. The sink of claim 18, wherein the second piece of sheet material includes a second locating surface, and wherein the locating surface of the first piece of sheet material axially overlaps the second locating surface.

22. The sink of claim 21, wherein the locating surface of the first piece of sheet material cooperates with the second locating surface to radially position the second piece of sheet material relative to the first piece of sheet material.

23. The sink of claim 18, wherein the axis is normal to the base wall.

24. The sink of claim 18, wherein an adhesive is used with the press-fit to secure the first piece of sheet material relative to the second piece of sheet material.

* * * * *